US006321935B1

(12) United States Patent
Yoshie

(10) Patent No.: US 6,321,935 B1
(45) Date of Patent: Nov. 27, 2001

(54) CLIP DEVICE FOR BENDING A CLIP PLATE AND CLIPPING A BUNDLE OF SHEETS TOGETHER WITH THE BENT CLIP PLATE AND METHOD OF ITS USE

(75) Inventor: Toru Yoshie, Chuo-ku (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 09/120,333

(22) Filed: Jul. 22, 1998

(30) Foreign Application Priority Data

Jul. 22, 1997 (JP) ..... 9-196103
Jul. 22, 1997 (JP) ..... 9-196104

(51) Int. Cl.[7] ..... B65H 1/00

(52) U.S. Cl. ..... 221/197; 270/58.08; 227/82; 227/135; 227/136

(58) Field of Search ..... 227/135, 134, 227/137, 119, 120, 131, 138, 139, 155, 154, 82, 83, 85, 88, 89; 221/197; 270/58.08; 29/243.5, 243.56, 243.88, 707, 715

(56) References Cited

U.S. PATENT DOCUMENTS 3,903,580 * 9/1975 Lam ..... 29/243.58
4,573,625 * 3/1986 Olesen et al. ..... 227/131
4,588,121 * 5/1986 Olesen ..... 227/120
4,623,082 * 11/1986 Kurosawa ..... 227/131 X
4,716,813 * 1/1988 Prudencio ..... 227/139 X
4,946,154 * 8/1990 Nakamura ..... 270/58.08
4,993,616 * 2/1991 Yoshie et al. ..... 227/120
5,346,114 * 9/1994 Udagawa et al. ..... 227/120
5,474,222 * 12/1995 Kanai et al. ..... 227/131
5,501,387 * 3/1996 Yoshie ..... 227/120
5,560,529 * 10/1996 Udagawa et al. ..... 227/136
6,039,230 * 3/2000 Yagi et al. ..... 227/120
6,044,546 * 4/2000 Yoshie ..... 29/707
6,050,471 * 4/2000 Yagi ..... 227/119
6,112,939 * 9/2000 Yoshie ..... 221/197
6,164,513 * 12/2000 Yoshie ..... 227/155

FOREIGN PATENT DOCUMENTS

0845337A1 * 6/1998 (EP) .
47-12089 5/1972 (JP) .

* cited by examiner

*Primary Examiner*—Christopher P. Ellis
*Assistant Examiner*—Patrick Mackey
(74) *Attorney, Agent, or Firm*—Jacobson Holman, PLLC

(57) ABSTRACT

A clip device is provided which is capable of clipping a sheet bundle with more than a predetermined clipping force independent of the thickness of the sheet bundle. This clip device is equipped with a cartridge for housing a plurality of substantially flat clip plates, a slider for feeding the clip plates from the cartridge into a predetermined position, a bending mechanism for bending the clip plate into a shape in which only point end portions are closed and also a rear portion is bulged, and a widening mechanism for clipping a sheet bundle by opening the point end portions of the bent clip and then inserting the sheet bundle into the opened point end portions.

7 Claims, 71 Drawing Sheets

131B
135
131
136
136
132
131A

A
131
131A
136
136
132
132
135
133A
133
134
134
133B
A 131B
131A
132
131
132
135
133
133A
133B

CLIP DEVICE FOR BENDING A CLIP PLATE AND CLIPPING A BUNDLE OF SHEETS TOGETHER WITH THE BENT CLIP PLATE AND METHOD OF ITS USE

BACKGROUND OF THE INVENTION

1. Field of the Invention

The present invention relates to a clip device that bends a clip plate and clips a bundle of sheets together with the bent dip plate.

2. Description of the Related Art

Conventionally, a clip machine which clips the end portions of a plurality of sheet members together is known (see Japanese Utility Model Publication No. SHO 47-12089). This clip machine, as shown in FIGS. 76 and 77, is equipped with a handle 2 provided in one end of a base 1 so that it is rotatable, and a cover 3 provided between the base 1 and the handle 2. A guide groove 4 is formed in the upper surface of the base 1, and between this guide groove 4 and the cover 3, a clip-connected member 5 is housed. This clip-connected member 5 is formed by connecting a plurality of clip members 5N together with an adhesive agent as in staples, each clip member 5N being bent into a U shape.

The other end (rear end) of the dip-connected member 5 is in contact with a clamp member 7 provided slidably on a push rod 6 shown in FIG. 78. This clamp 7 urges the clip-connected member 5 in the left direction (in FIG. 77) by a sprig 9 provided on the push rod 6. This urging causes one end (front end) of the clip-connected member 5 to be in contact with one end 4A of the guide groove 4.

A push plate 8 is provided on the lower surface of the handle 2. If the handle 2 is rotated from a solid line position in FIG. 76 to a broken line position, the push plate 8 will make contact with the bent proximal portion of the leading clip member 5N of the clip-connected member 5 and separate the clip member 5N from the clip-connected member 5. And this separated clip member 5N alone is further compressed and deformed by the pushing force of the push plate 8, so that the end portions of a sheet bundle are clipped together by the deformed clip member 5N.

Incidentally, if sure clipping by the clip member 5N is to be obtained, the clip member 5N must be widened and formed into a plate shape. However, if the clip member 5N is widened, the number of clip members 5N that can be housed will be reduced and the clip-connected member 5 must be frequently supplied. Accordingly, there is a problem in that it will result in a great inconvenience.

Also, this clip member 5N clamps a sheet bundle by inserting the sheet bundle into the clip member 5N and crushing the bent proximal portion 5N*a*. Therefore, if the sheet bundle thickens, the bent proximal portion Na cannot be sufficiently crushed. For this reason, there is a problem in that sufficient clipping force cannot be obtained, so that the sheet bundle is easily separated from the clip member 5N.

SUMMARY OF THE INVENTION

It is an object of the present invention to provide a clip device which is capable of clipping a sheet bundle with more than a predetermined clipping force independent of the thickness of the sheet bundle.

Another object of the invention is to provide a clip device which is capable of housing a great number of clip plates into a cartridge so that frequent supply of the clip plates to the cartridge is not needed The clip device according to the present invention comprises: a cartridge for housing a plurality of substantially flat clip plates; feed means for feeding the clip plates from the cartridge into a predetermined position; bending means for bending the clip plate into a shape in which only point end portions are closed and also a rear portion is bulged; and dip means for clipping a sheet bundle by opening the point end portions of the bent clip and then inserting the sheet bundle into the opened point end portions.

BRIEF DESCRIPTION OF THE DRAWINGS

The above and other objects and advantages will become apparent from the following detailed description when read in conjunction with the accompanying drawings wherein.

DETAILED DESCRIPTION OF THE PREFERRED EMBODIMENTS

Figure 1:
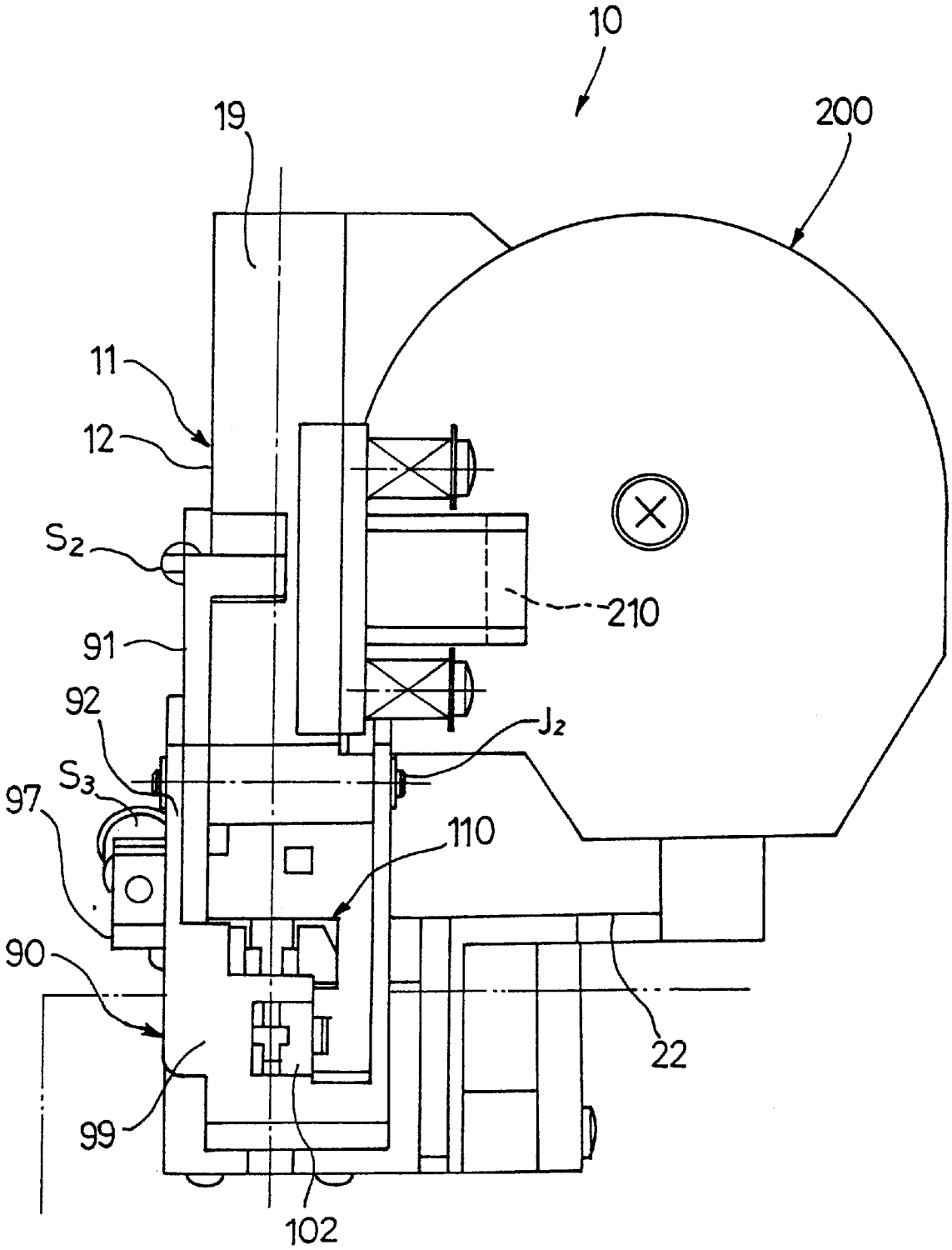
FIG. 1 is a plan view showing a clip device according to the present invention.
Figure 2:
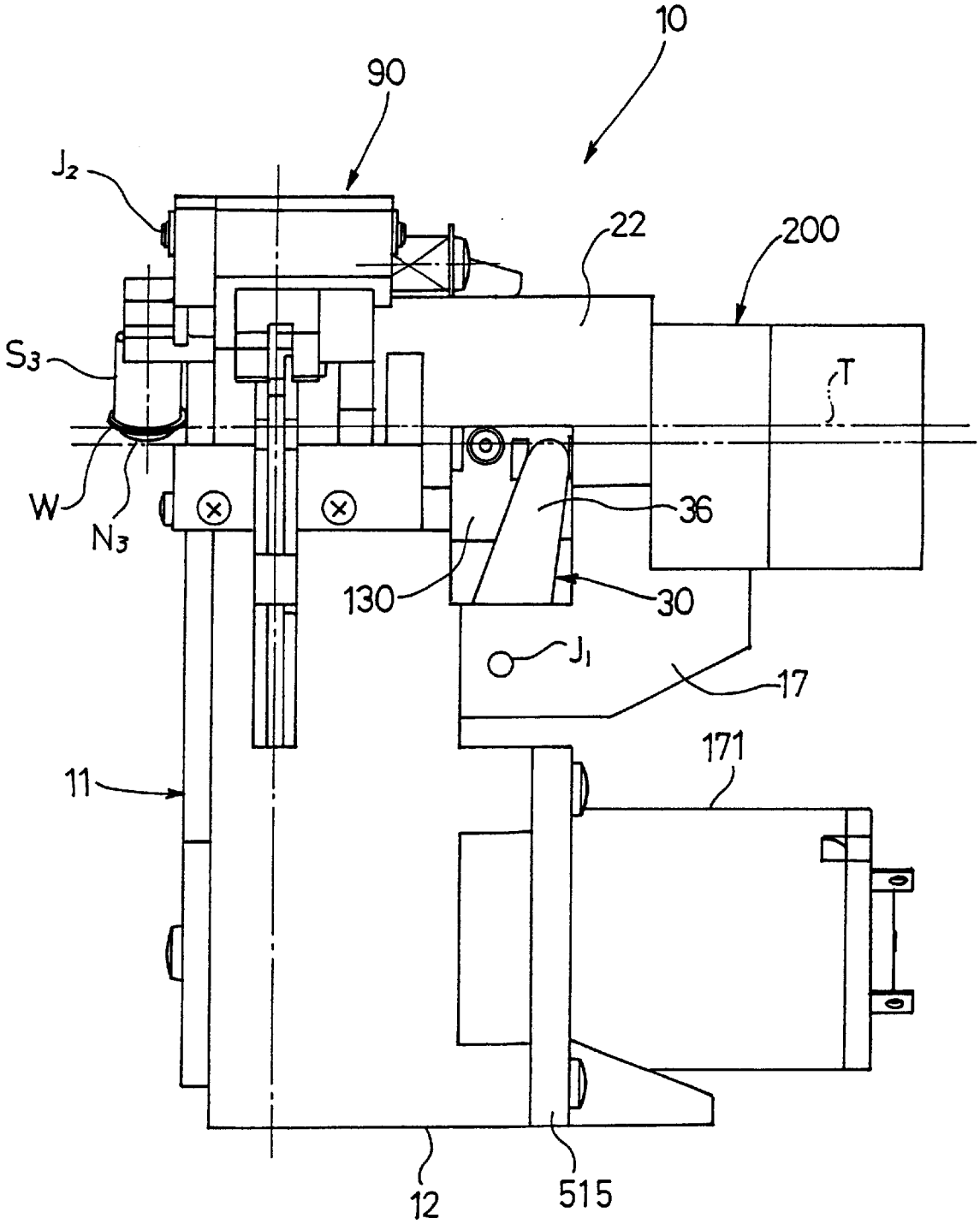
FIG. 2 is a front view of the clip device shown in FIG. 1.
Figure 3:
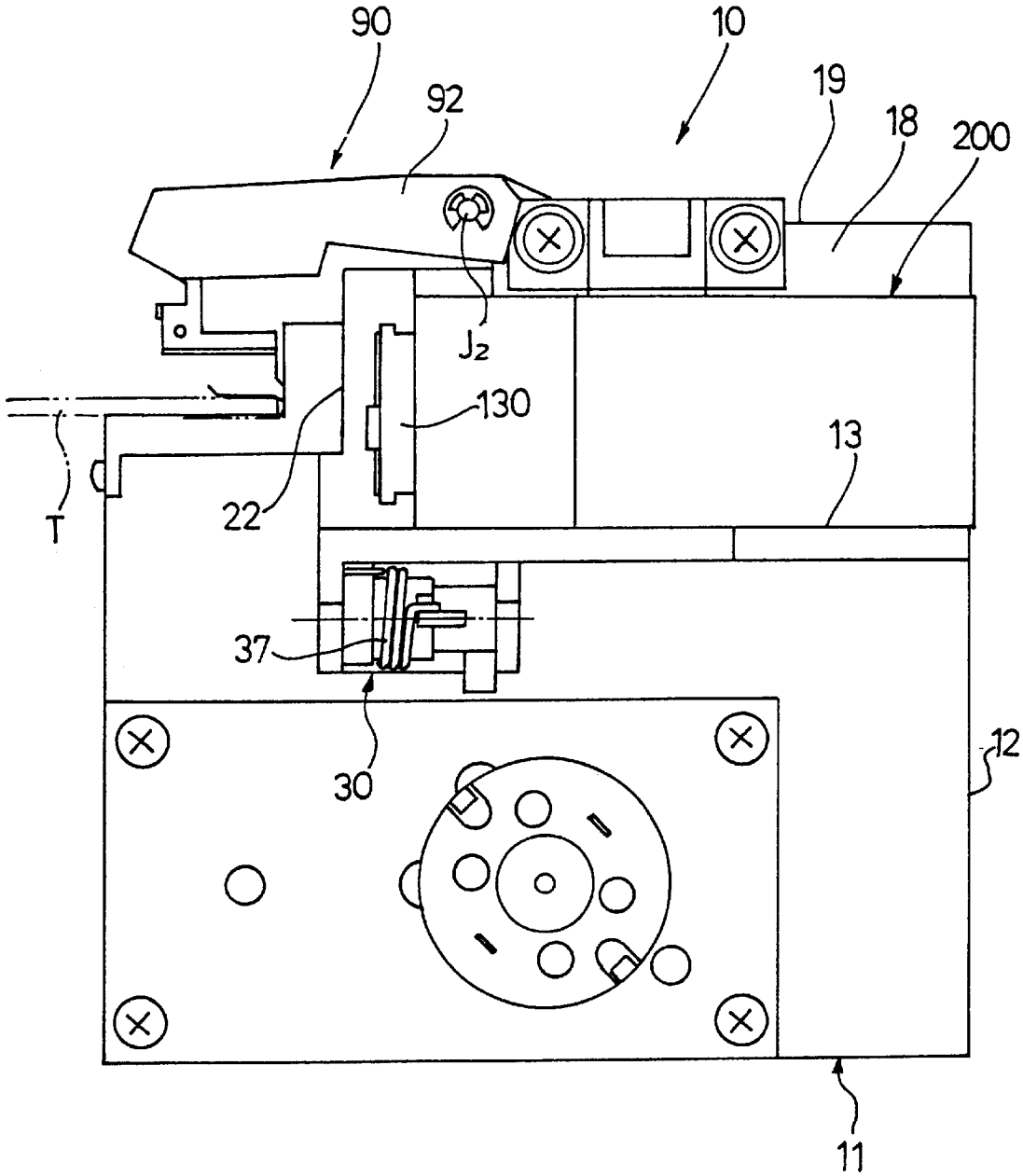
FIG. 3 is a right side view of the clip device shown in FIG. 1.
Figure 4:
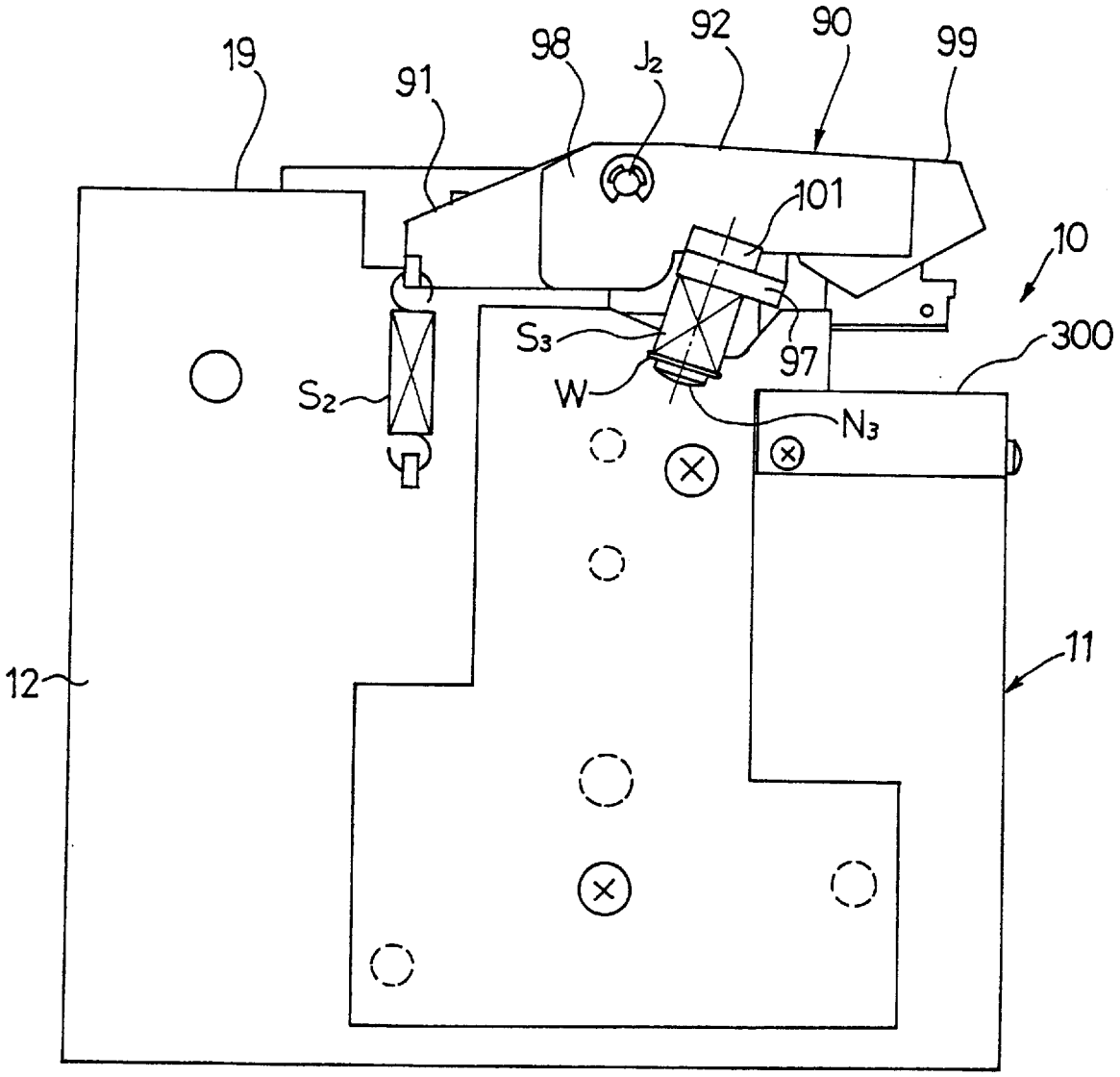
FIG. 4 is a left side view of the clip device shown in FIG. 1.
Figure 5:
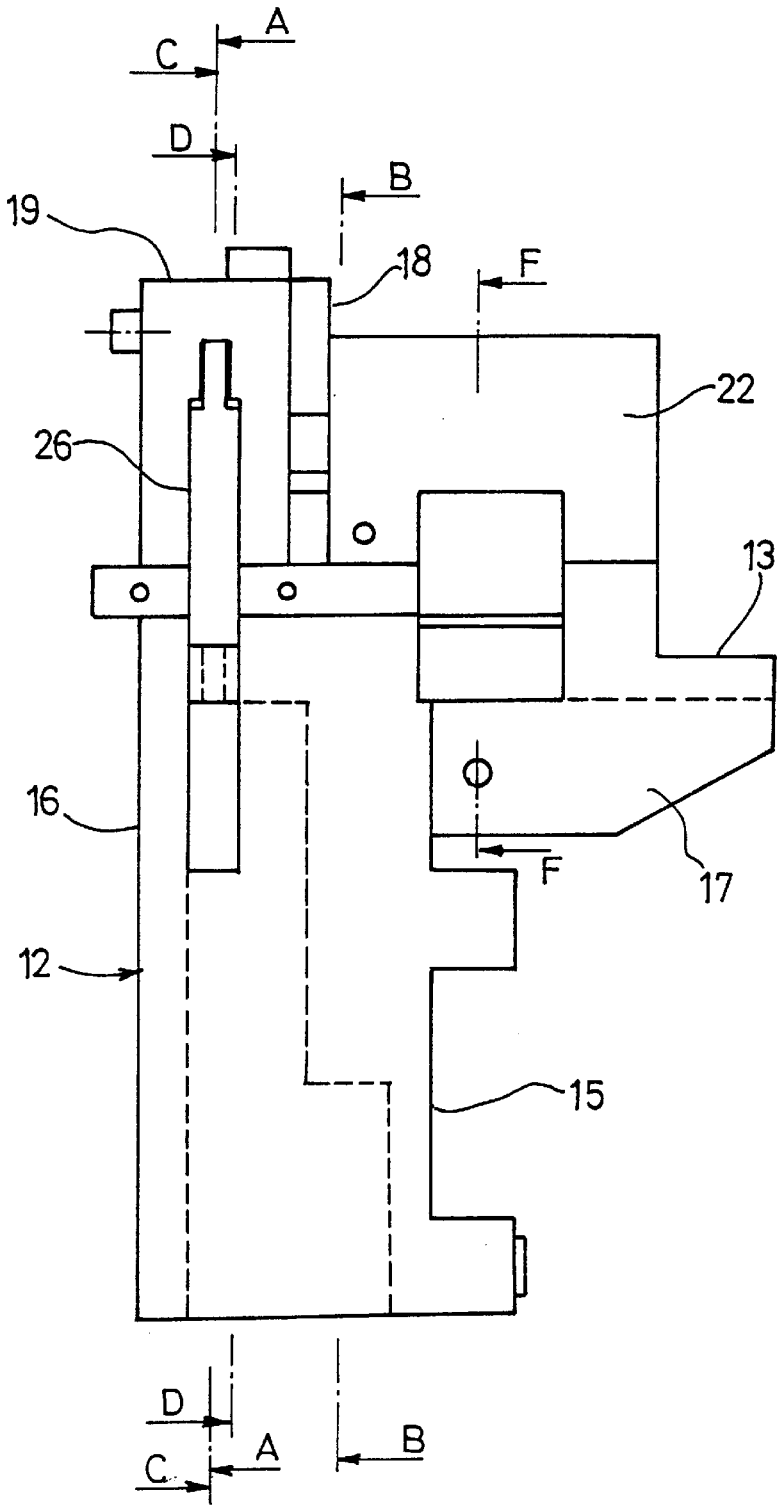
FIG. 5 is a front view showing the housing of the device main body.

A clip device according to an embodiment of the present invention will hereinafter be described based on the drawings.

In FIGS. 1 through 4, reference numeral 10 denotes a clip device which clips a sheet bundle. This clip device 10 is constituted by a device main body 11 and a cartridge 200 detachably attached to the device main body 11.

Figure 10:
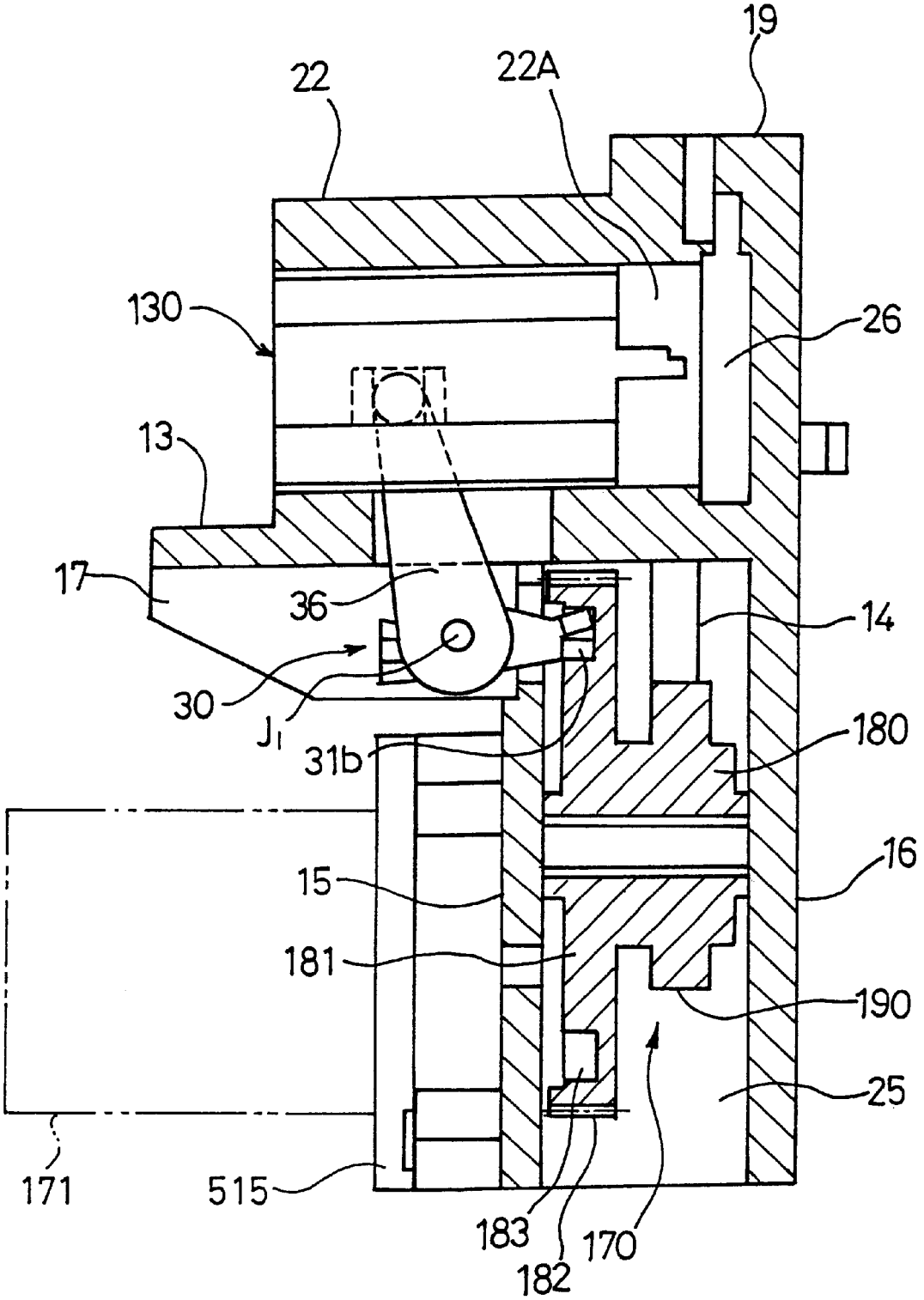
FIG. 10 is a sectional view of the housing taken substantially along line E—E of FIG. 8.
Figure 46A:
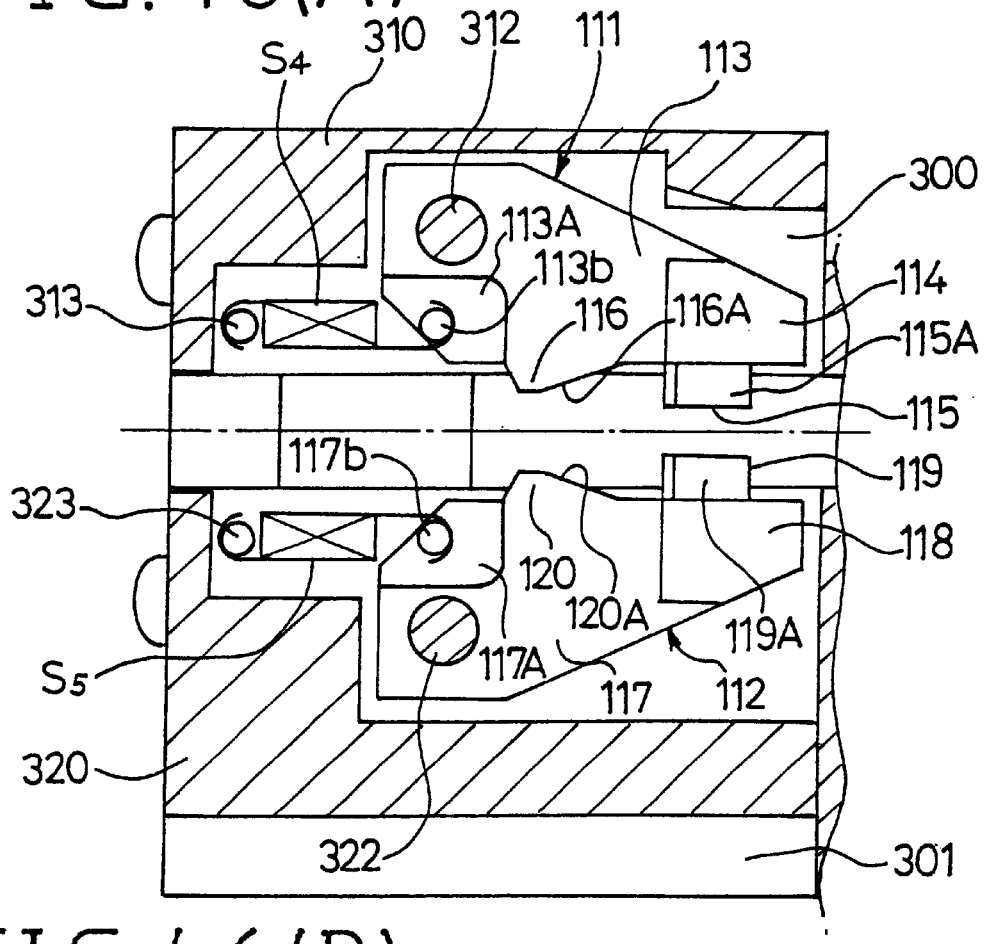
FIG. 46(A) is a sectional plan view showing the clip mechanism.

The housing 12 of the device main body 11 is provided with a feed mechanism 30 (see FIG. 10) which feeds out into a predetermined position a flat clip plate 231 (see FIG. 19) housed in the cartridge 200, a forming mechanism 60 (see FIG. 11) which bends the clip plate 231 into a predetermined shape, a press mechanism 90 which presses a sheet bundle T, a widening mechanism 110 (see FIG. 46) for widening the point ends of the bent clip plate and inserting the sheet bundle T into between the point ends, and a drive mechanism 170 (see FIG. 10) for driving the feed mechanism 30 and the forming mechanism 60.

(Housing)

The housing 12, as shown in FIGS. 5 through 11, is provided with a table 13 on which the cartridge 200 is placed. An engagement groove 13A is formed in the upper surface of this table 13. The table 13 is also formed with side walls 15 and 16, the side wall 16 extending upward beyond the table 13. The front upper portion of the side wall 16 is formed with a square hole 16H into which the point end portion 161A of an anvil portion 161 (see FIG. 25) to be described later is inserted Between the side wall 15 and the side wall 16 a drive chamber 25 is formed. The drive chamber 25 is provided with the drive mechanism 170. A drive motor 171 (see FIG. 2) is attached to a side plate 515 (in FIG. 10) spaced at a predetermined distance from the side wall 15. Also, a pair of hold wall portions 17 and 17, spaced at a predetermined distance, is formed on the front lower surface of the table 13.

On the left side (in FIG. 6) of the table 13 an upwardly protruding side wall 18 is formed. Between the front end of the side wall 18 and a front wall 22 to be described later, there is formed a hole 18H into which the front end portions 212A and 214A of the side wall 212 and 214 (see FIG. 15) of the cartridge 200 (described later) and a slider 150 are inserted.

Between the side wall 18 and the upper portion of the side wall 16 a forming chamber 26 for housing the forming body 70 of the forming mechanism 60 is formed. The front surface of this forming chamber 26 is opened, and on the front side between the side wall 16 and the side wall 18 an intermediate wall 14 is formed. A recess 20 is formed from the ceiling wall 19 of the forming chamber 26 to the side wall 16. Within this recess 20 a hole 21 open to the forming chamber 26 is formed. On the ceiling wall 19 a protrusion 19T is formed.

At the front end of the upper surface 13A of the table 13 a front wall 22 is formed The back surface of the front wall 22 has a surface 22A opposed to a slider 130 to be described later and a protrusion 23 for pushing out a feed pawl 153 to be described later (see FIG. 26). This protrusion 23 is formed with a groove 23A extending in a right-and-left direction (in FIG. 7) and upper and lower protruding portions 23B and 23B arranged across the groove 23A and also extending in the right-and-left direction. Each protruding portion 23B is formed with an inclined surface 23*b* (see FIG. 26) at one end thereof Also, on the back surface of the front wall 22 upper and lower protruding portions 22T and 22T are formed. The upper and lower protruding portions 22T and 22T protrude rearward and extend in the right-and-left direction. The protruding portions 22T and 22T are formed with guide grooves 22*g* and 22*g* extending in the right-and-left direction (perpendicular to the paper surface in FIG. 9), respectively.

Figure 12:
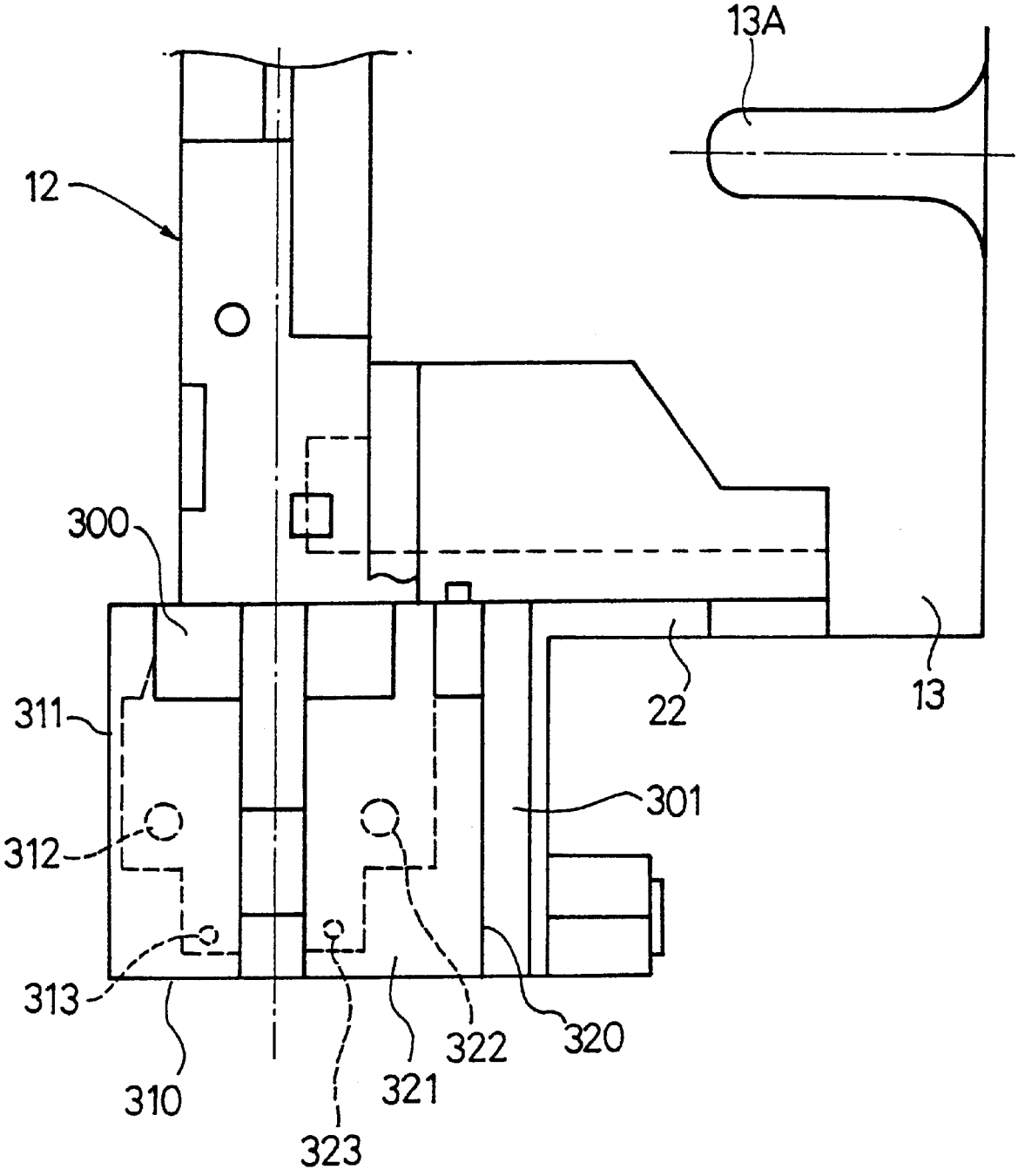
FIG. 12 is a plan view showing the attached state of a sheet table.
Figure 13:
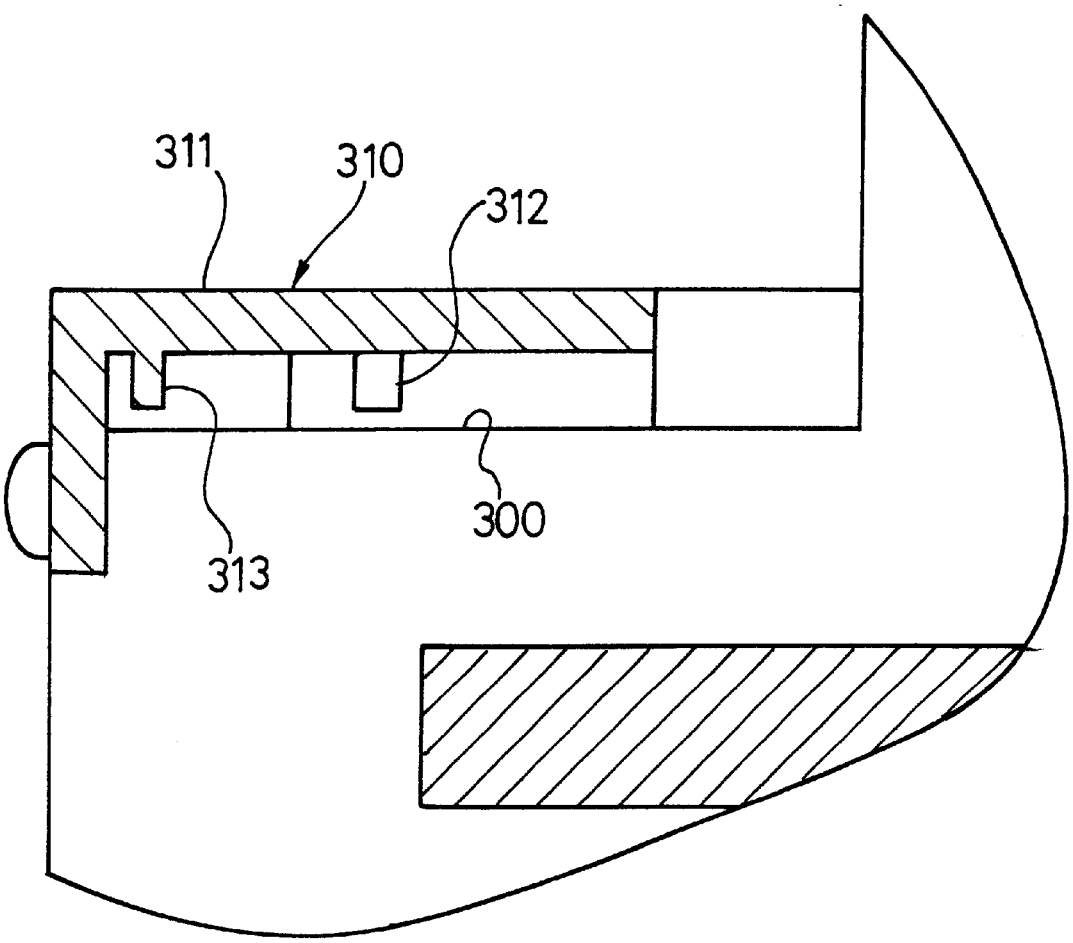
FIG. 13 is a sectional view showing the attached state of the sheet table.

At the front surface of the housing 12, support tables 300 and 301 are formed and spaced at a predetermined distance from each other. As shown in FIG. 12, sheet tables 310 and 320 on which a sheet bundle T is placed are spaced at a predetermined distance from each other and attached to the support tables 300 and 301. Between the table plates 311 and 321 of the sheet tables 310 and 320 and the support tables 300 and 301, as shown in FIG. 13, a predetermined space is formed, and on the lower surfaces of the table plates 311 and 821, shaft portions 312 and 322 and stopper protrusions 313 and 323 are formed. Also, the upper surfaces of the table plates 311 and 321 have the same height.

(Drive Mechanism)

The drive mechanism (drive means) 170 (FIG. 10) is constituted by a drive gear (not shown) mounted on the drive shaft (not shown) of the drive motor 171, a speed reduction gear train (not show), and a drive cam (drive member) 180. The drive cam 180, the drive gear, and the speed reduction gear train are arranged in a drive chamber 25 so that they are freely rotatable.

Figures 14A, 14B, 14C:
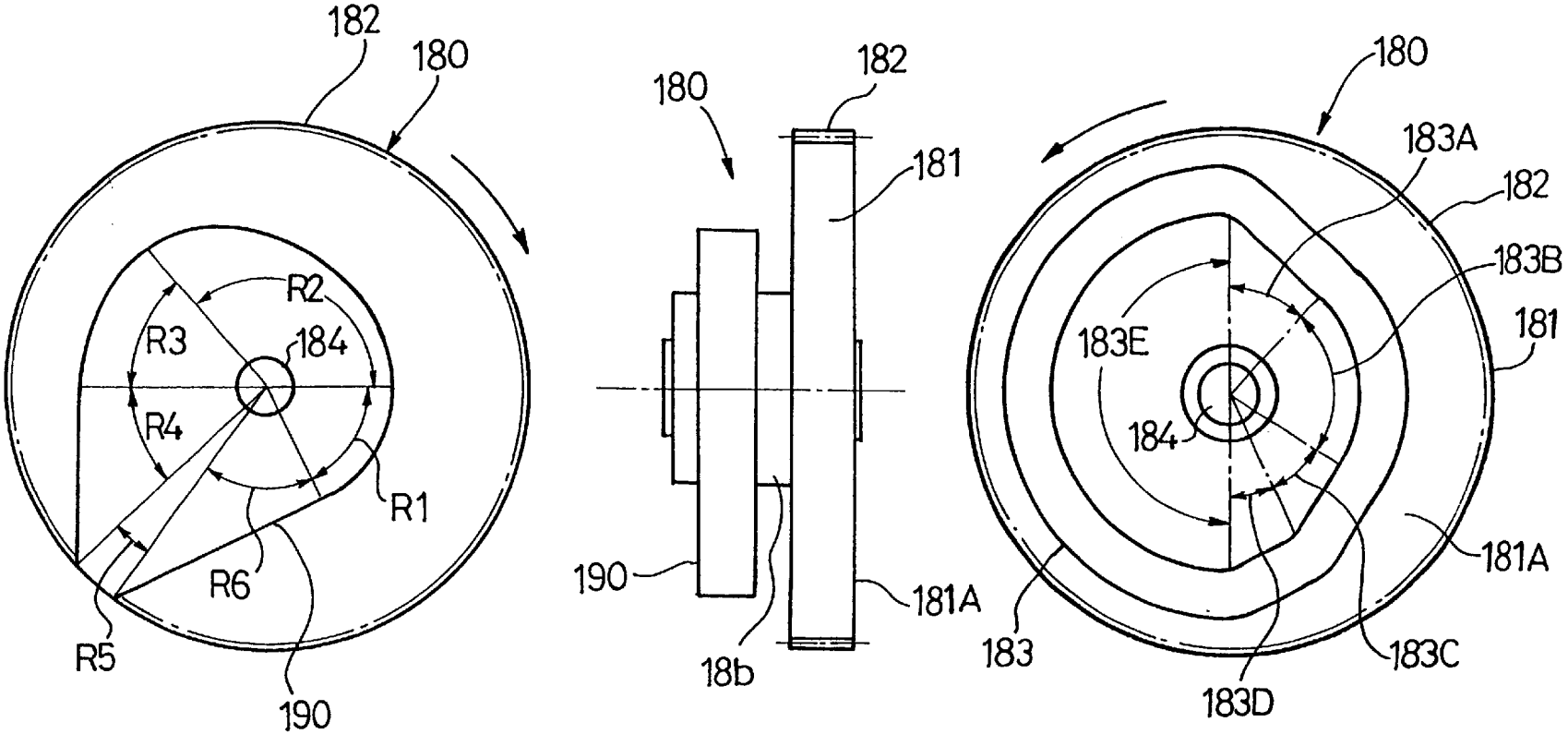
FIG. 14(A) is a left side view of the drive cam.
FIG. 14(B) is a front view of the drive cam.
FIG. 14(C) is a right side view of the drive cam.

The drive cam 180, as shown in FIG. 14, is constituted by a disc-shaped cam plate 181 and a cam body 190 formed integrally with one side of this cam plate 181 through a shaft portion 186.

The cam plate 181 is formed with an external gear 182, which in turn meshes with the above-mentioned speed reduction gear train. The drive cam 180 is rotated by the drive motor 171 through the drive gear and speed reduction gear train.

A loop cam groove 183 is formed in the other side 181A of the cam plate 181. This cam groove 183 has a small-radius portion 183A whose distance from the center of a rotating shaft 184 decreases gradually, a minimum-radius portion 183B whose distance from the shaft center is constant, a first large-radius portion 183C whose distance from the shaft center increases gradually, a second large-radius portion 183D whose distance from the shaft center increases gradually, and a maximum-radius portion 183E whose distance from the shaft center is maximum.

The cam body 190 has a minimum-radius portion R1 whose distance from the center of the rotating shaft 184 is minimum, a first increasing portion R2 whose distance from the shaft center increases gradually, a large-radius portion R3 whose distance from the shaft center increases slightly, a second increasing portion R4 whose distance from the shaft center increases sharply, and a maximum-radius portion R5 whose distance from the shaft center is maximum, and a reducing portion R6 whose distance from the shaft center decreases sharply.

(Cartridge)

Figure 15:
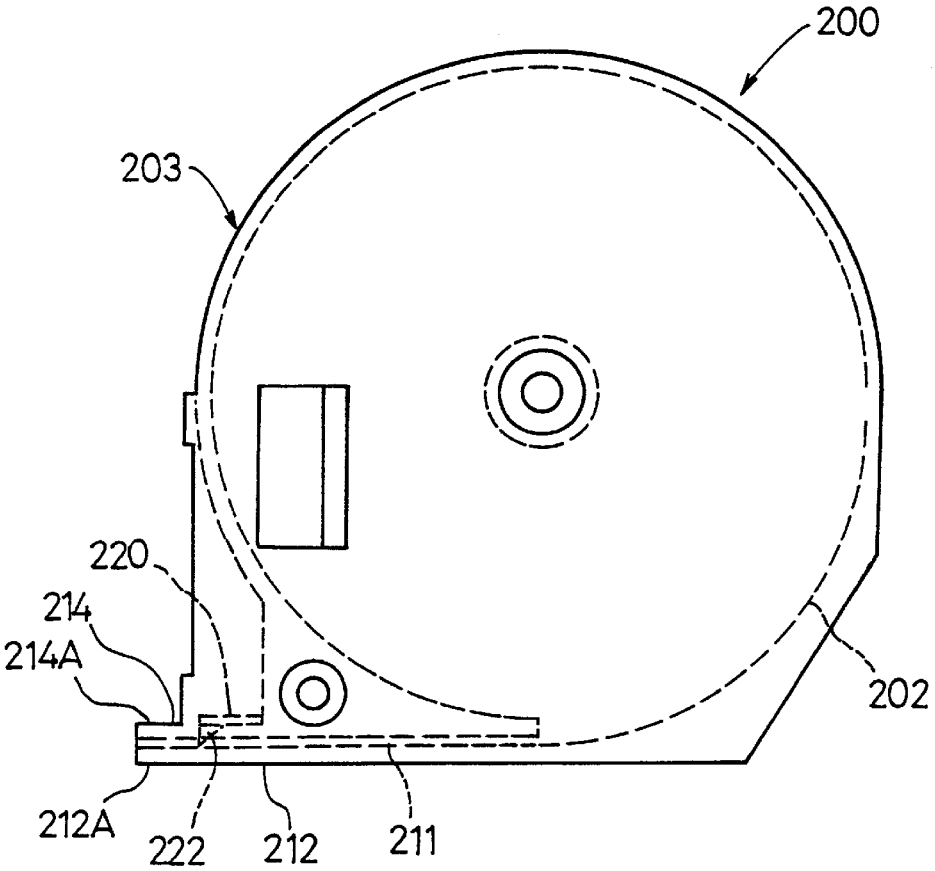
FIG. 15 is a plan view showing a cartridge.
Figure 16:
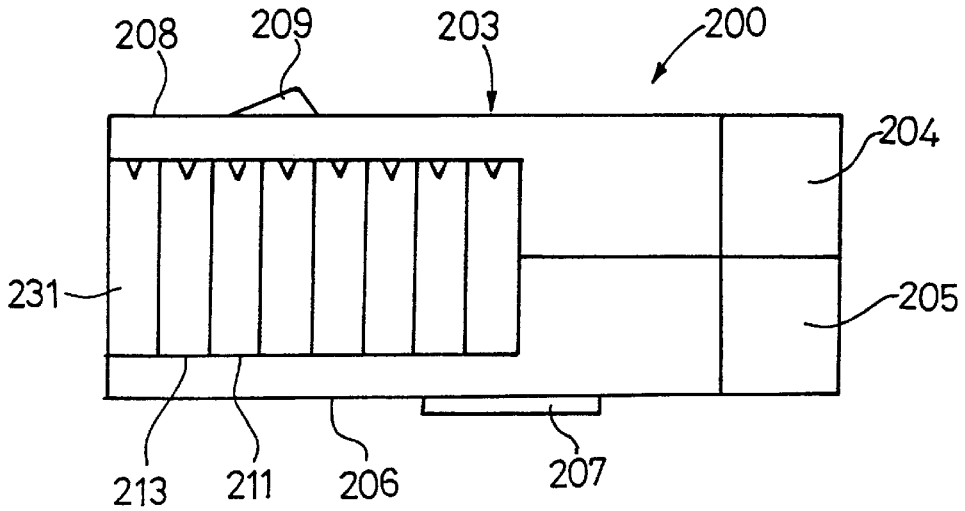
FIG. 16 is a front view showing the cartridge of FIG. 15.

The cartridge 200, as shown in FIGS. 15 and 16, is constituted by a main body casing 203 formed with a generally circular housing chamber 202. The main body casing 203 is constituted by an upper casing 204 and a lower casing 205.

On the bottom plate 206 of the lower casing 205 a protrusion 207 is formed. This protrusion 207 engages with the engagement groove 18A of the table 13 of the housing 12. On the ceiling plate 208 of the upper casing 204 a protrusion 209 is formed, and the protrusion 209 engages with the stopper protrusion 210 provided in the housing 12.

Figure 17:
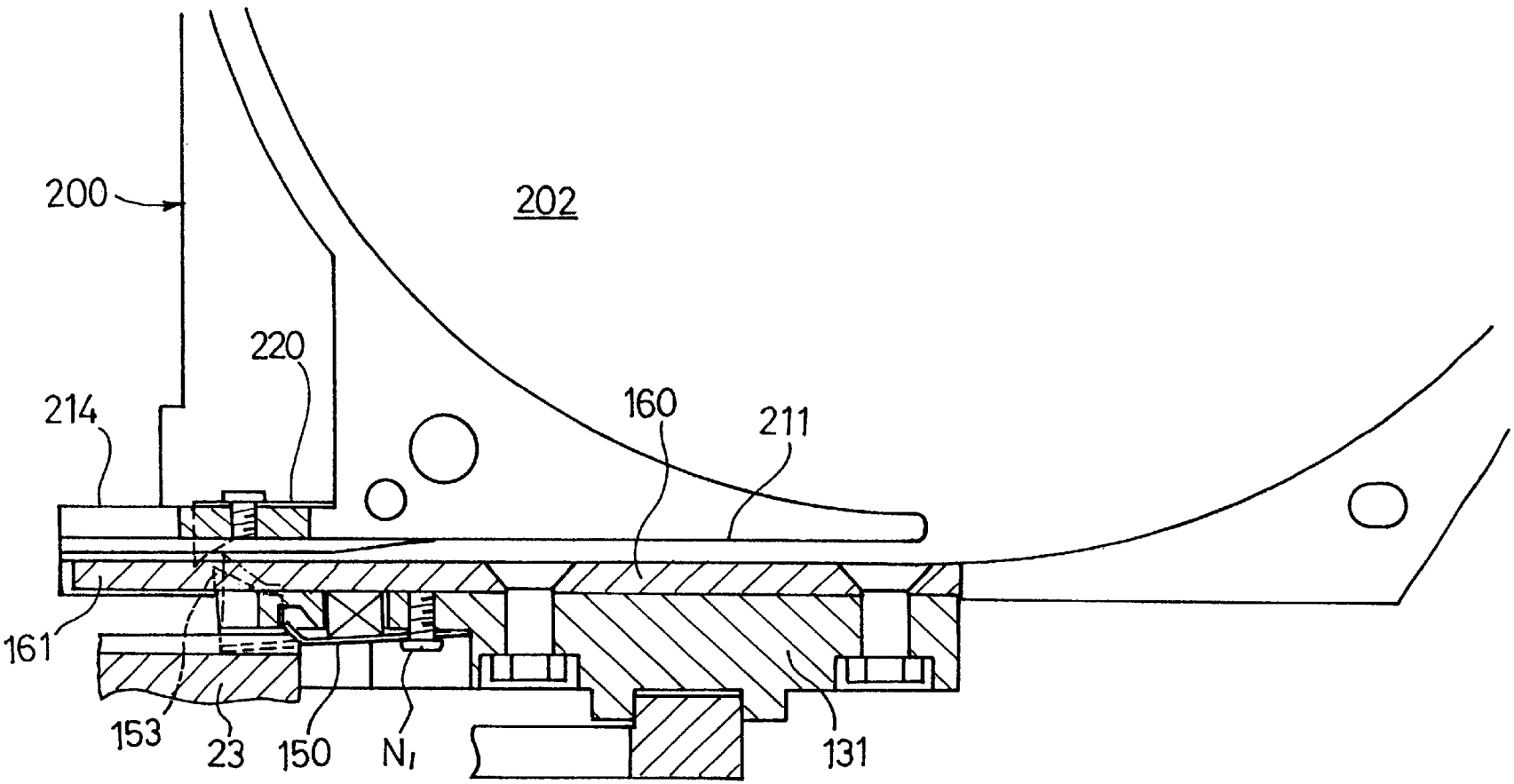
FIG. 17 is an explanatory diagram showing the relation between the slider and the cartridge.

The main body case 208 is formed with a straight conveyor path 211 which communicates the housing chamber 202 with the outside. The side wall 212 forming this conveyor path 211 is formed with a recess 213 to which the conveyor path 211 is exposed. Also, as shown in FIG. 17, a nonreturn pawl plate 220 is attached to the back surface of the side wall 214 forming the conveyor path 211

Figure 18B:
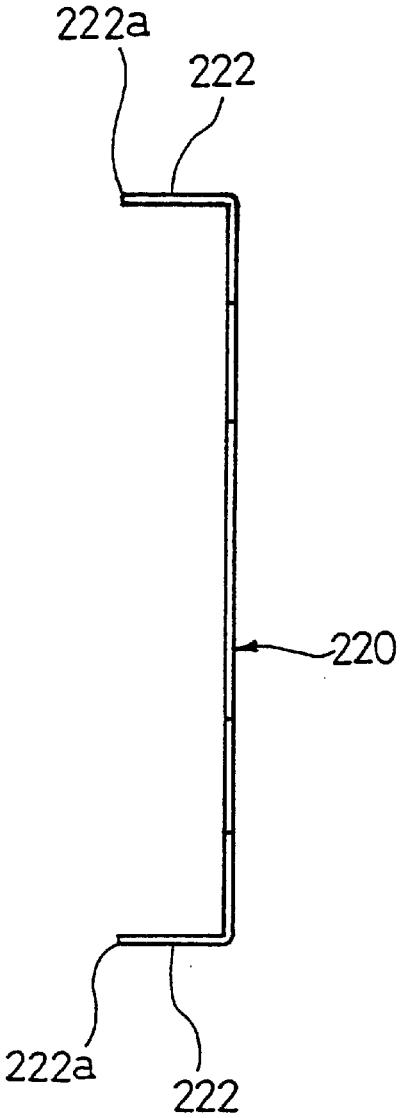
FIG. 18(B) is a left side view showing the nonreturn pawl plate.
Figure 18A:
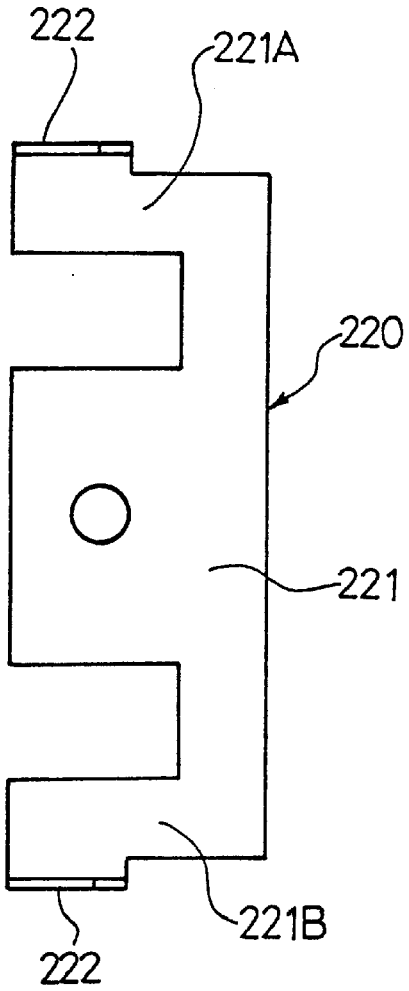
FIG. 18(A) is a front view showing a nonreturn pawl plate.
Figure 18C:
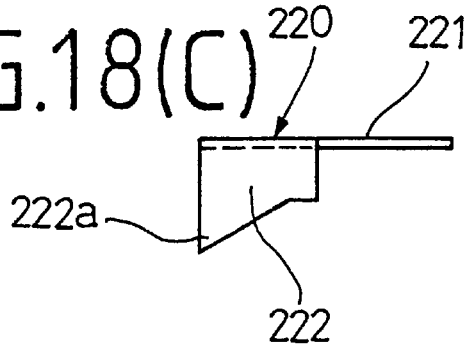
FIG. 18(C) is a right side view showing the nonreturn pawl plate.

The nonreturn pawl plate 220, as shown in FIG. 18, has upper and lower nonreturn pawls 222 at the upper and lower plate portions 221A and 221B of an E-shaped flat plate 221, respectively. The upper and lower nonreturn pawls 222 are inserted into slits (not shown) provided in the side wall 214, and the point ends 222*a* and 222*a* of the nonreturn pawl is 222 are projected into the conveyor path 211.

The point ends 222*a* and 222*a* of the upper and lower nonreturn pawls 222 can be retracted by the elastic force of the flat plate 221 so that they do not interfere with the feeding of the clip plate 231.

Figure 19:
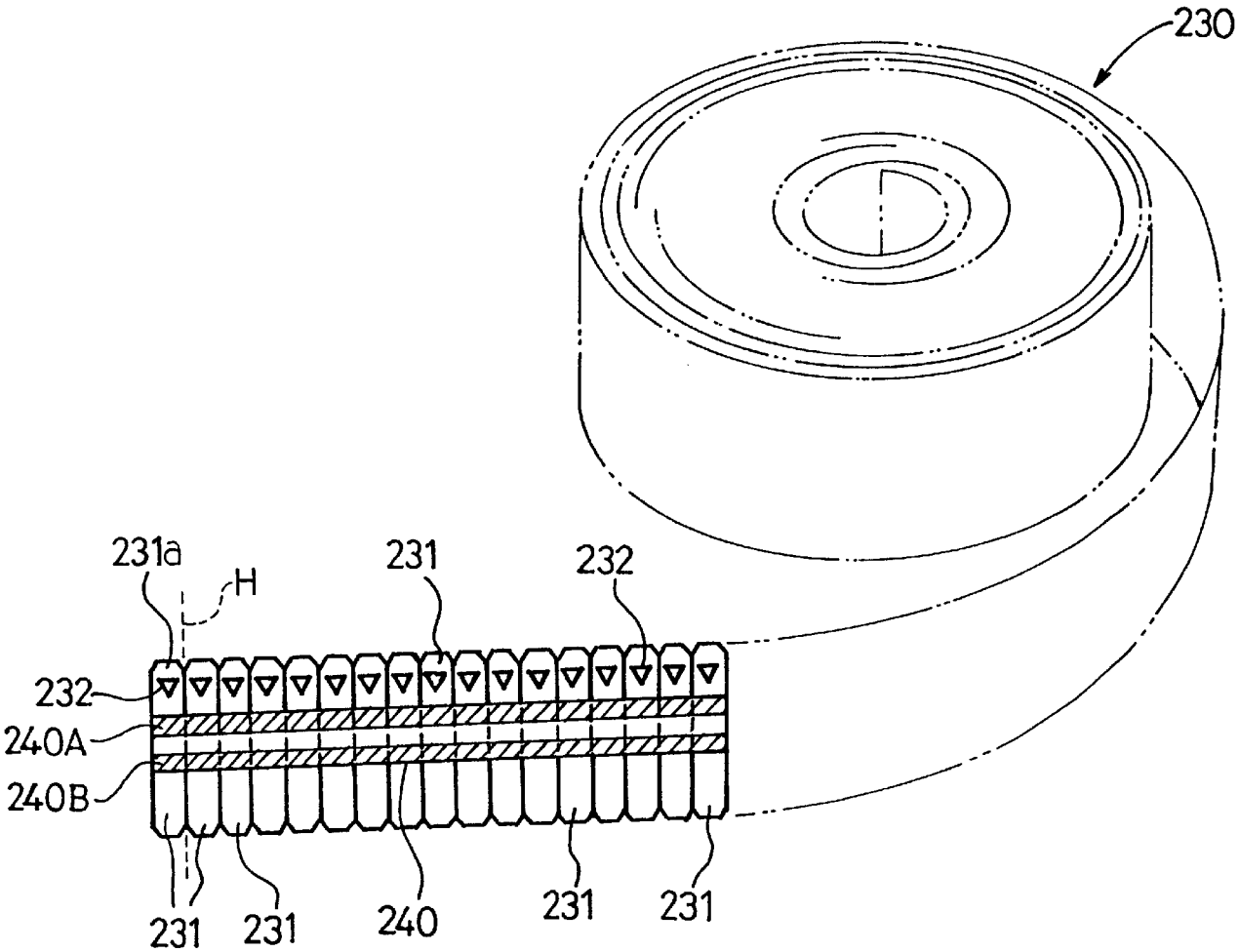
FIG. 19 is a perspective view showing a clip-connected plate.

The clip-connected plate 230 shown in FIG. 19 is housed in the housing chamber 202 of the cartridge 200. This clip-connected plate 230 consists of a plurality of clip plates 231 connected together with ribbon tapes 240A and 240B and is wound in roll form.

The clip plate 231 is formed with a triangular hole 232 at one end thereof (upper portion in FIG. 19). The upper portion 231*a* of the clip plate 231 from the hole 232 is easily bendable. Also, the tape 240 has orientation in an up-and-down direction (in FIG. 19) so that it can be cut at a broken line H.

(Feed Mechanism)

Figure 20:
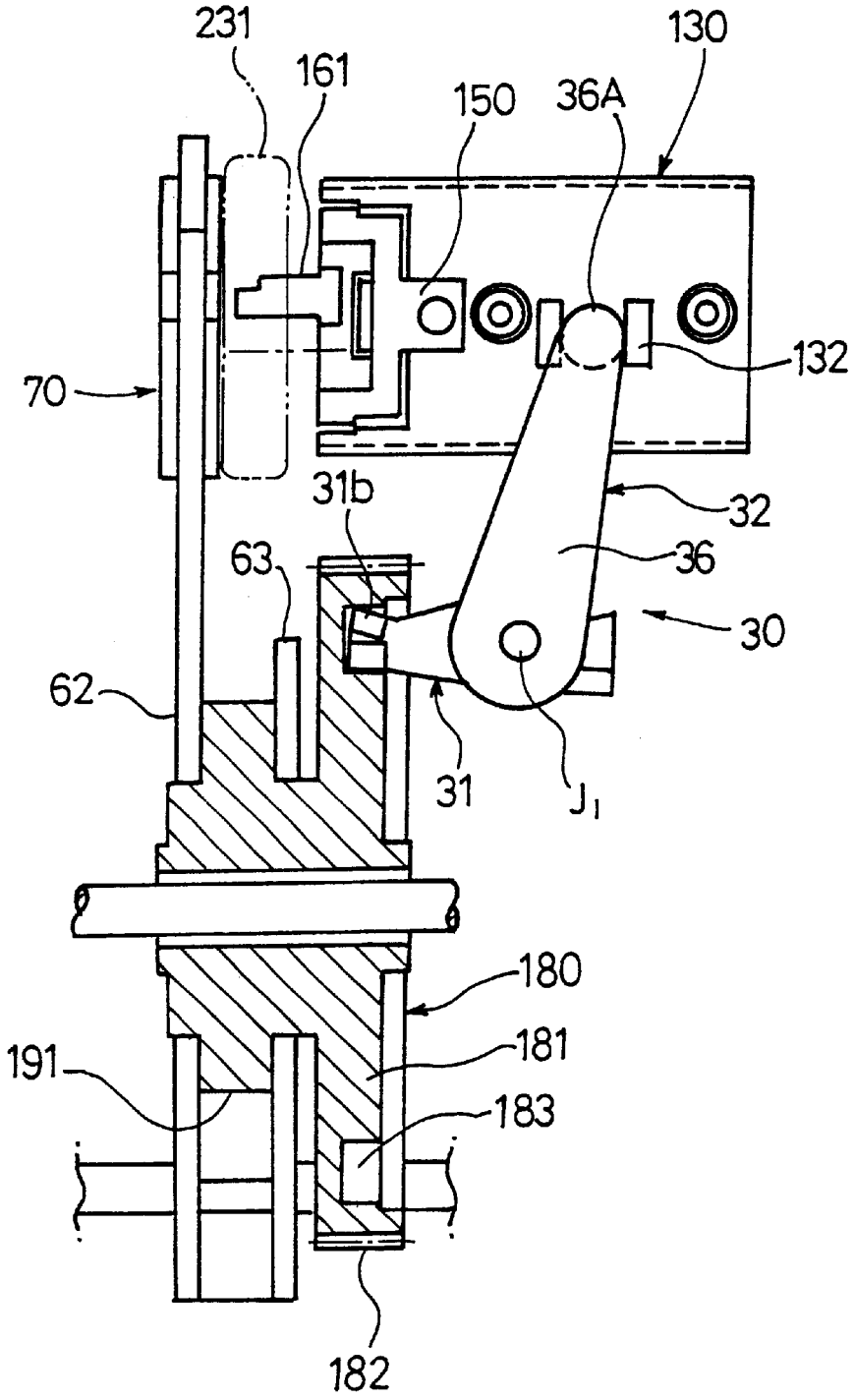
FIG. 20 is an explanatory diagram showing the construction of a feed mechanism.
Figure 21:
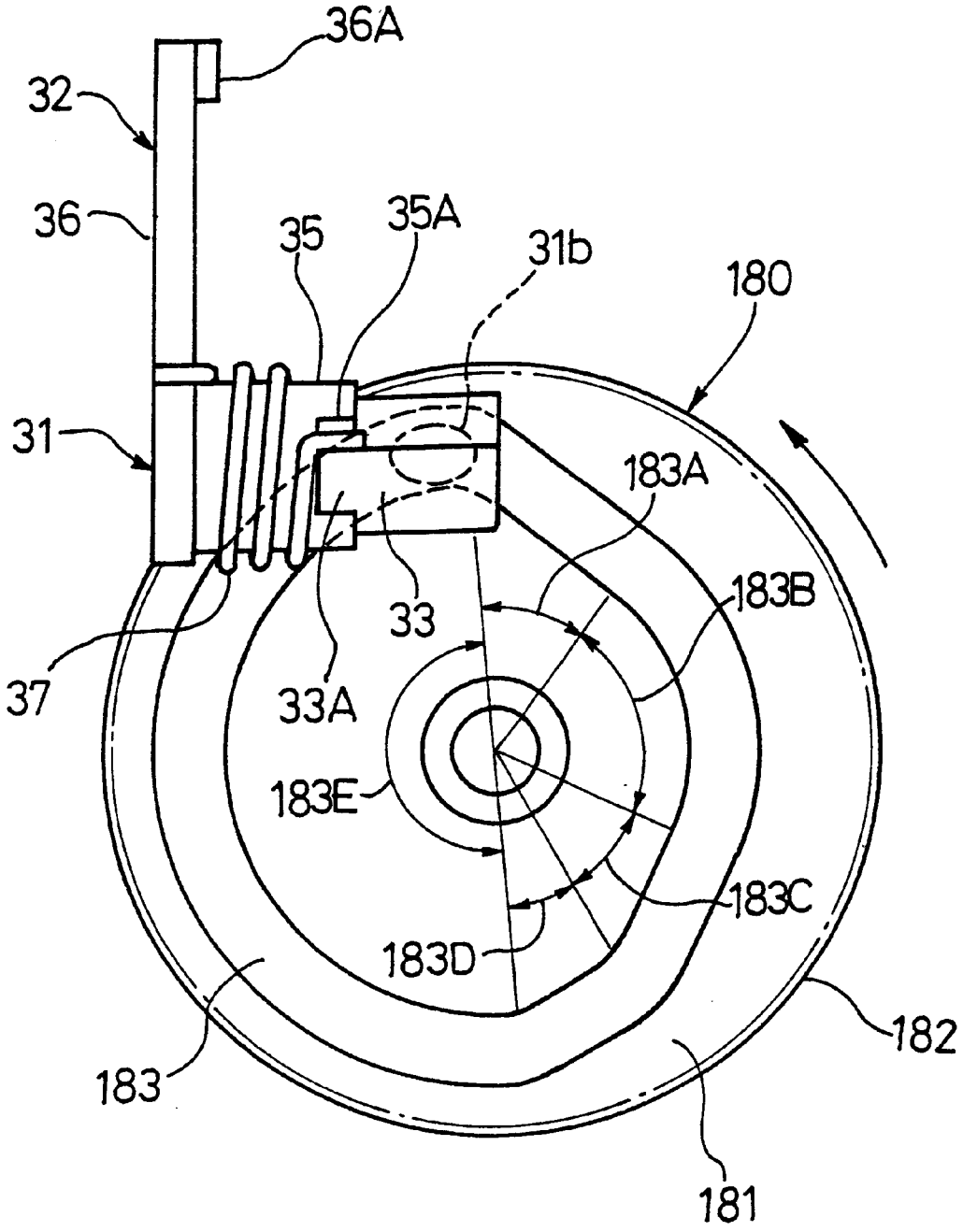
FIG. 21 is an explanatory diagram showing the relation between the drive cam and the link member.
Figure 22:
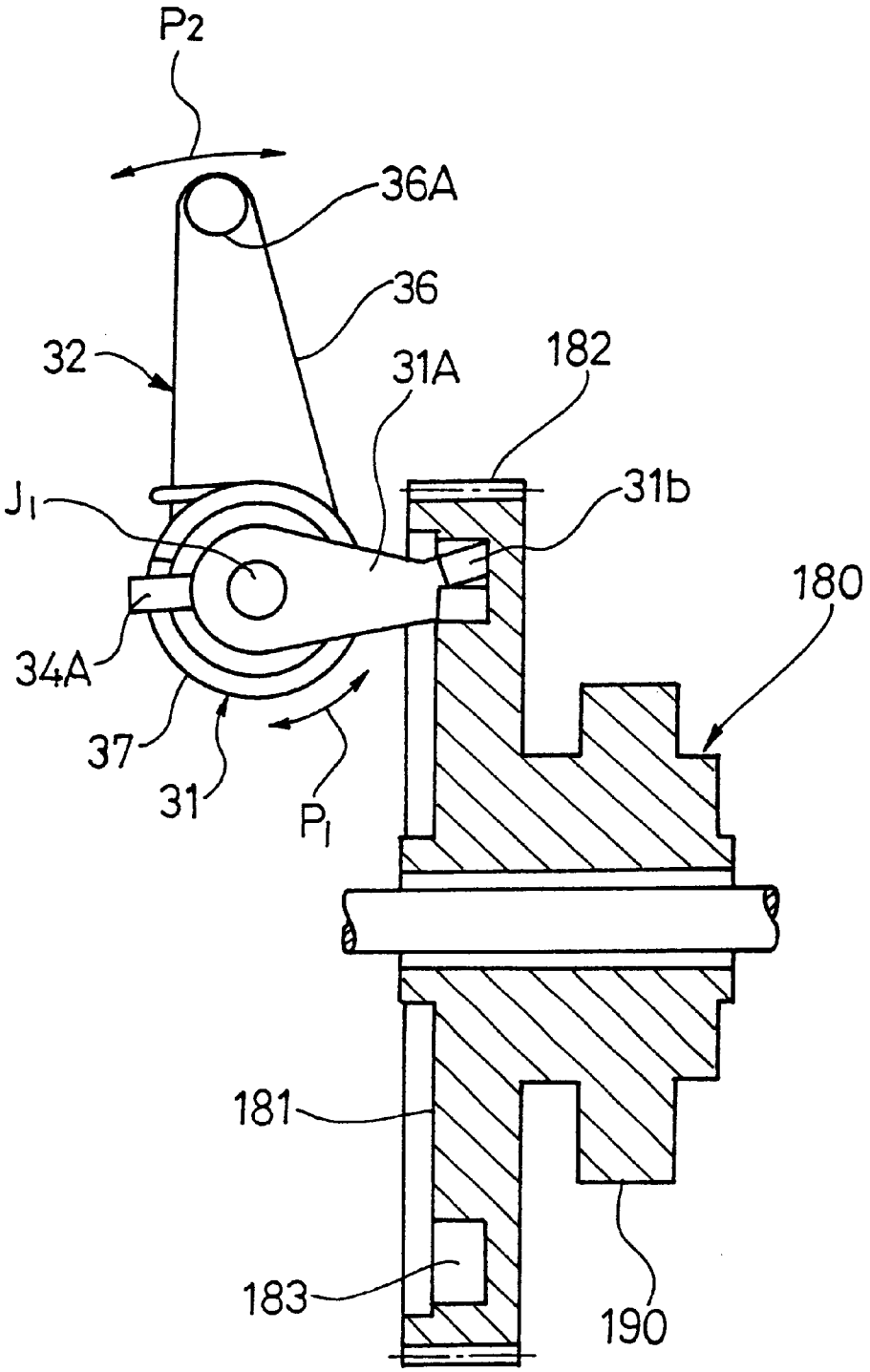
FIG. 22 is an explanatory diagram showing the direction of rotation of the link member.
Figure 23A:
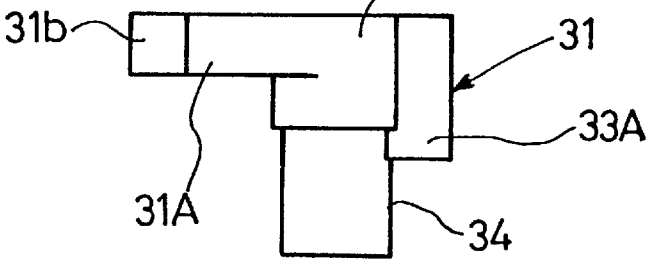
FIG. 23(A) is a plan view showing a first link member.
Figure 23B:
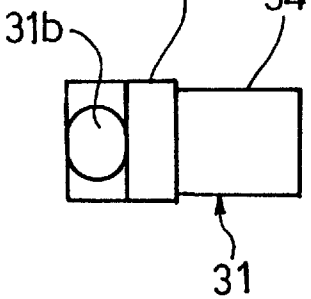
FIG. 23(B) left side view showing the first link member.
Figure 23C:
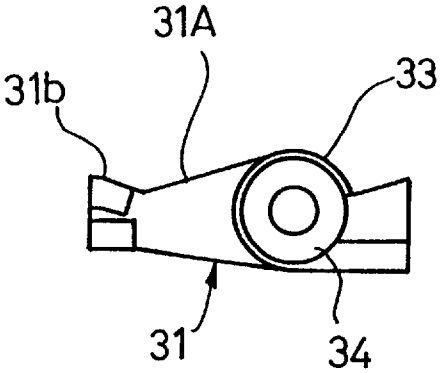
FIG. 23(C) is a front view showing the first link member.
Figure 23D:
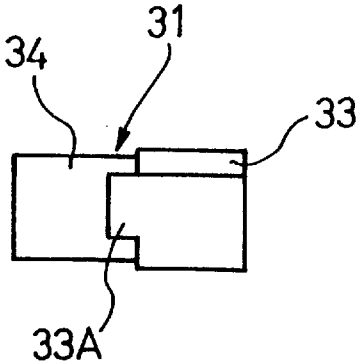
FIG. 23(D) is a right side view showing the first link member.

The feed mechanism 30, as shown in FIGS. 20 through 22, is constituted by first and second link members 31 and 32 mounted on a shaft J1 so as to be freely rotatable, a slider (feed means) 130 which is reciprocated in the right-and-left direction by the first and second link members 31 and 32, and so on. The shaft J1 is provided in a pair of hold wall portions 17 and 17 formed in the table 13.

The first link member 31, as shown in FIG. 23, consists of a first shaft portion 33, a stopper protrusion 33A formed on the first shaft portion 33, and a second shaft portion 34. The first shaft portion 33 has an arm portion 31A whose point end 31*b* is inserted into the cam groove 183, while the second shaft portion 34 is formed continuously on one end of the first shaft portion 33. If the drive cam 180 rotates and if the point end 31*b* of the arm portion 31A is moved up and down by the cam groove 183, the first link member 31 will be rotated in a direction indicated by arrow P1 with the shaft J1 as center.

Figure 24C:
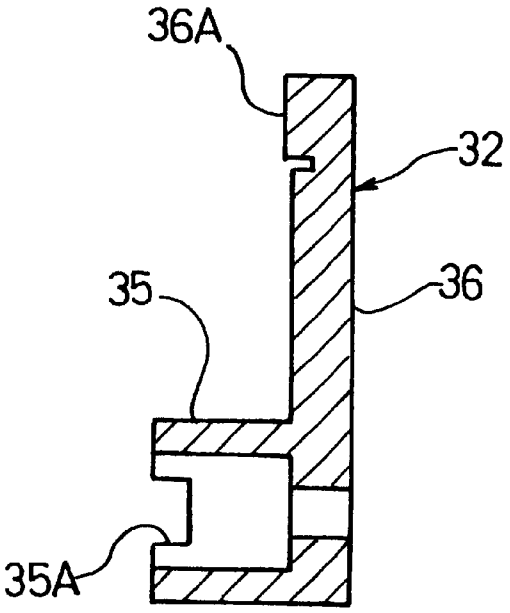
FIG. 24(C) is a sectional view showing the second link member.
Figure 24B:
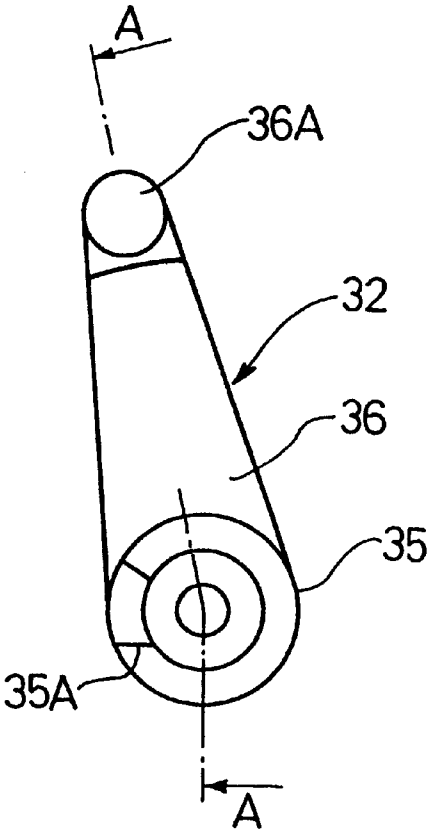
FIG. 24(B) is a front side view showing the second link member.
Figure 24A:
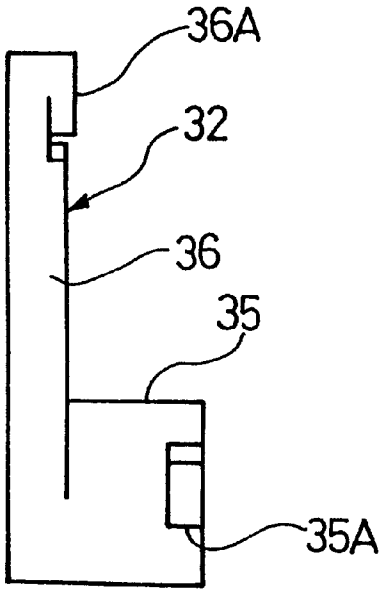
FIG. 24(A) is a left side view showing a second link member.

The second link member 32, as shown in FIG. 24, is constituted by a cylindrical portion 35 fitted on the second shaft portion 34 of the first link member 31 so as to be freely rotatable, and an arm portion 36 extending upward from this cylindrical portion 35. The cylindrical portion 36 is formed with a recess 35A into which the stopper protrusion 33A of the first link member 31 is inserted. The circumferential width of the recess 35A is longer than that of the stopper protrusion 33A so that the first link member 31 can rotate by a predetermined quantity relatively against the second link member 32.

The cylindrical portion 35 of the second link member 32, as shown in FIGS. 21 and 22, has a coil spring 37 inserted on its exterior surface. One end of the coil spring 37 is anchored to the stopper protrusion 33A of the first link member 31, while the other end is anchored to the arm portion 36 of the second link member 32. This coil spring 37 causes the second link member 32 to rotate with the first link member 31 in the same direction with a circumferential gap produced between the stopper protrusion 33A and the recess 35A. If rotation of the second link member 82 is stopped, only the first link member 31 will rotate by the quantity of the gap with respect to the second link member 32.

The arm portion 36 is rotated on the shaft J1 in a direction of P2 by rotation of the second link member 32, whereby the slider 130 is reciprocated in the right-and-left direction shown in FIG. 20.

Incidentally, the quantity of rotation of the first link member 31 is set so that the slider 130 to be described later can move a distance greater than the width of the clip plate 231. Therefore, even if there were fluctuation in the gap between adjacent dip plates 231, the relative rotation of the first link member 31 to the second link member 32 can absorb the fluctuation, and consequently, the clip plate 231 can be reliably fed out into a predetermined position.

(Slider)

Figure 25:
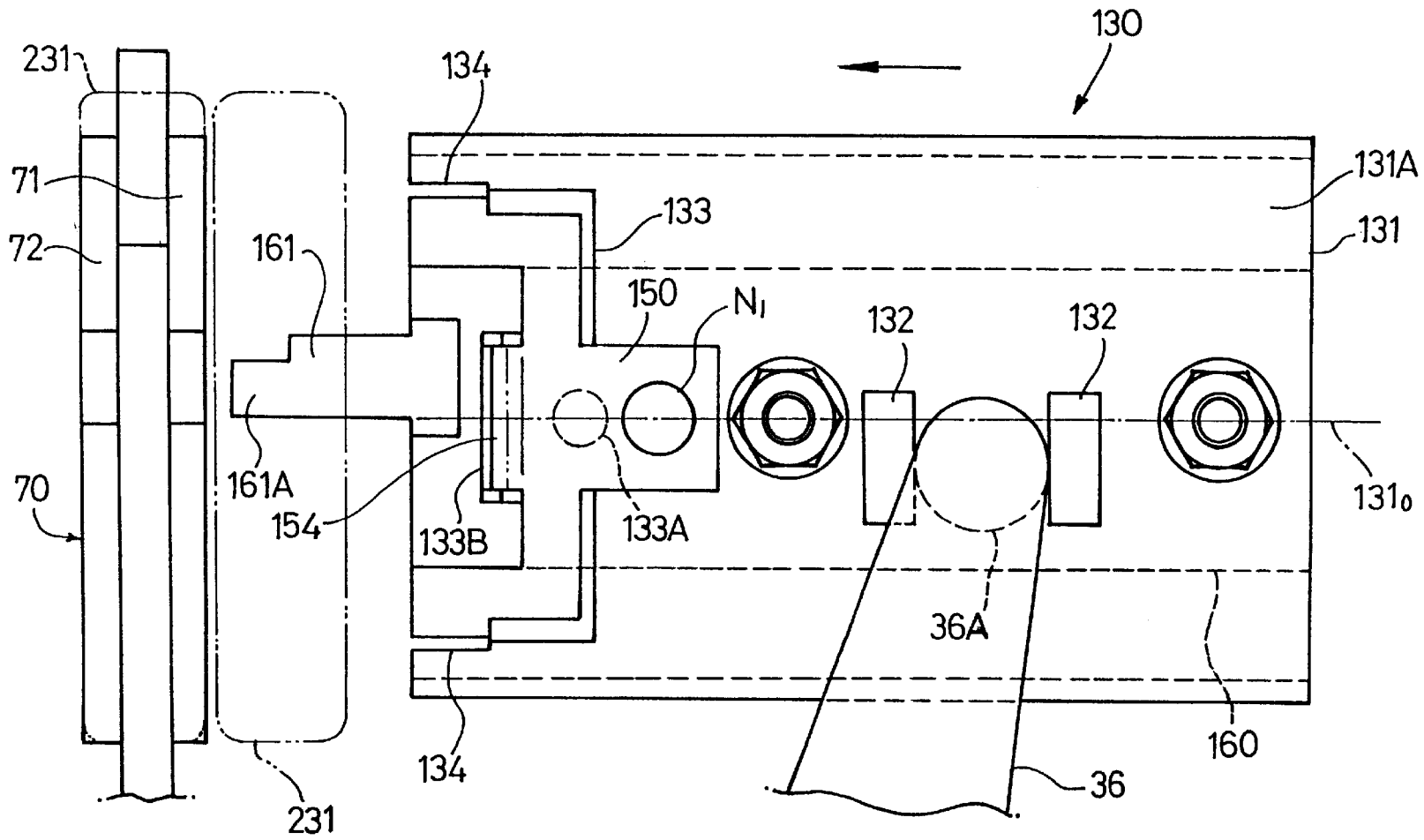
FIG. 25 is an explanatory diagram showing the construction of a slider.
Figure 26:
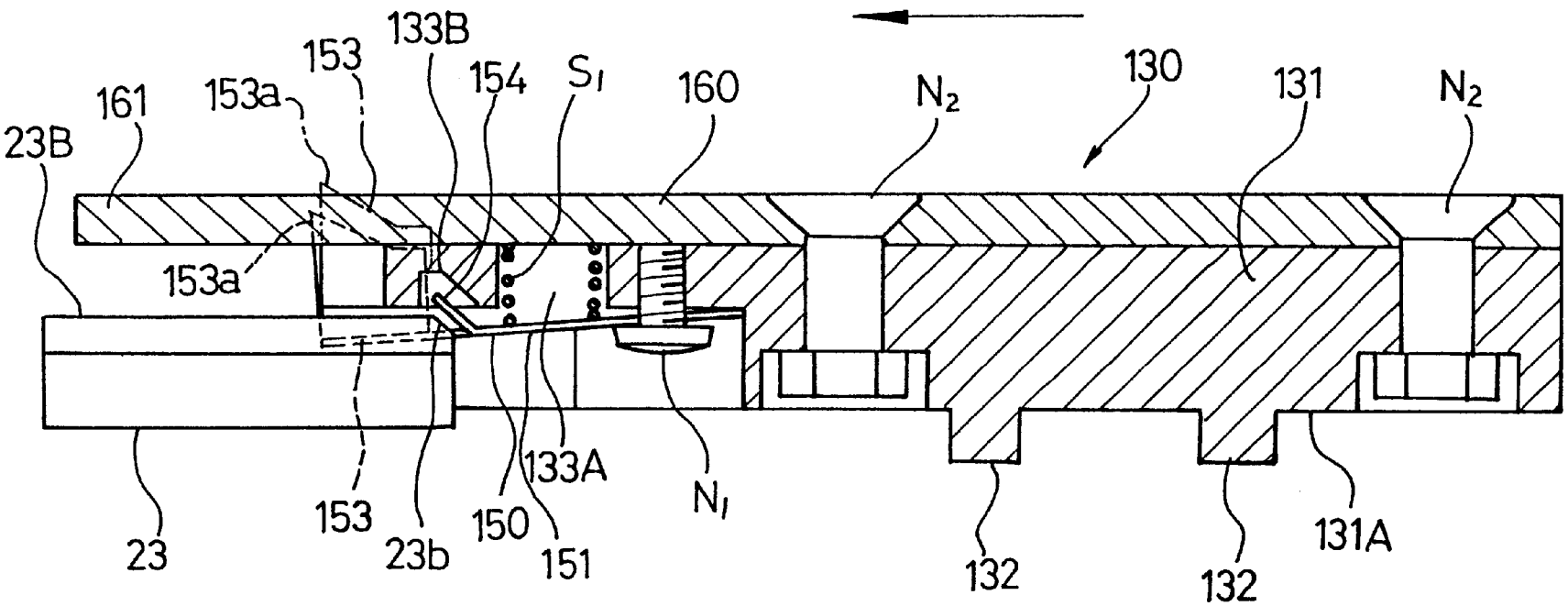
FIG. 26 is a sectional view showing the construction of the slider.

The slider 130, as shown in FIGS. 25 and 26, is constituted by a slider plate 131, a feed pawl plate 150 attached to the slider plate 131, and an anvil plate 160 attached to the slider plate 131.

Figures 27A, 27B, 27C:
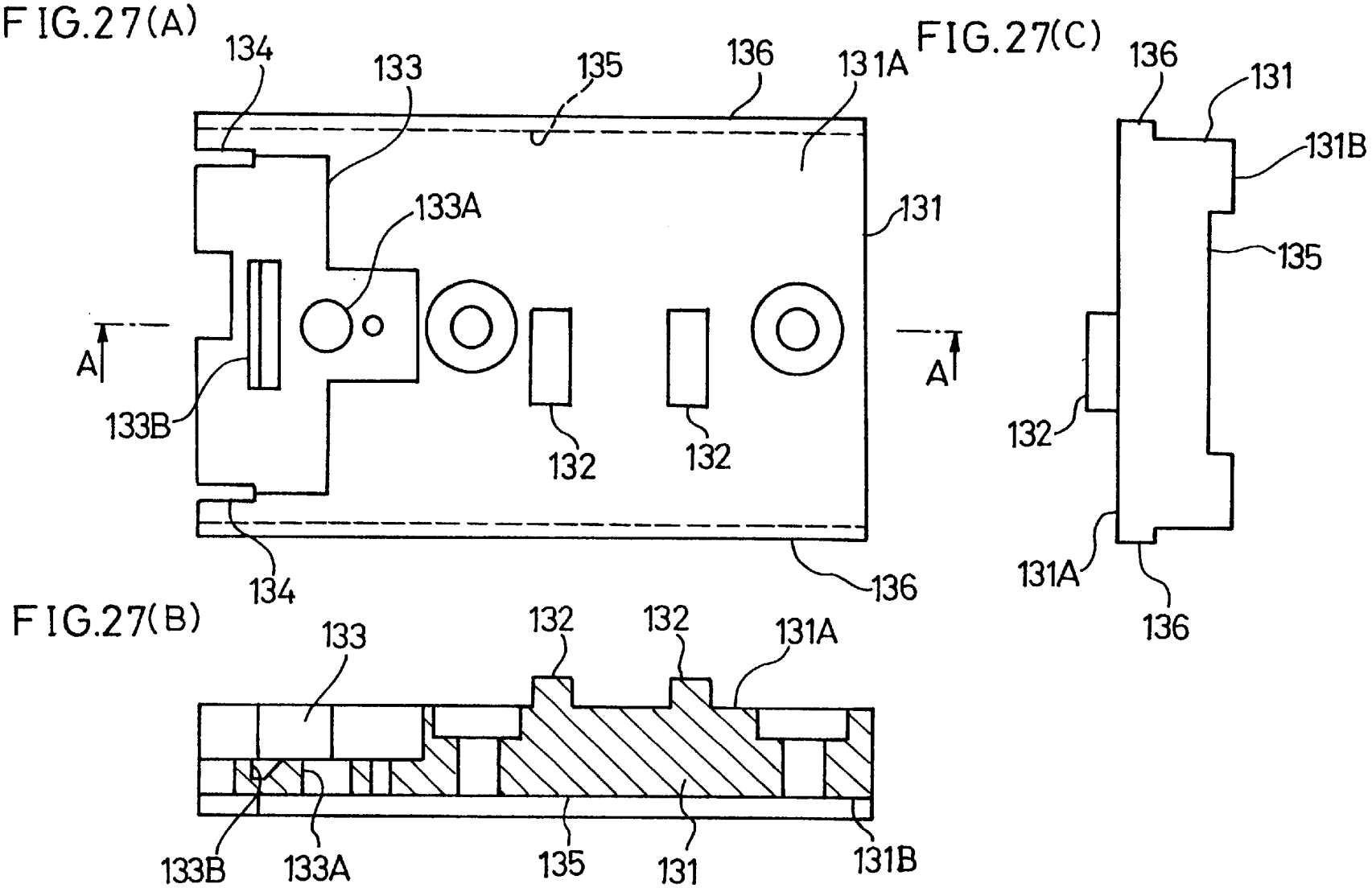
FIG. 27(A) is a front view showing the construction of the slider plate of the slider of FIG. 26.
FIG. 27(B) is a right side view showing the slider.
FIG. 27(C) is a sectional view of the slider.

The front surface 131A of the slider plate 131 has a pair of protrusions 132 and 132 spaced at a predetermined distance. The stopper protrusion 36A of the second link member 32 is inserted into between the protrusions 132 and 132. Also, the front surface 131A of the slider plate 131, as shown in FIG. 27, has a recess 133, which is in turn formed with a spring hole 133A The point end of the slider plate 131 is formed with a pair of slit-shaped cutouts 134 and 134. At the left position (in FIG. 27(A)) adjacent to the hole 133A of the slider plate 131, a groove 133B extending in the up-and-down direction is formed.

The rear surface (back surface) 131B of the slider plate 131 is inserted into the recess 213 of the cartridge 200 and has a wide recess 135 extending in the right-and-left direction. The slider plate 131 is formed with upper and lower protrusions 136 and 136 extending in the right-and-left direction. The upper and lower protrusions 136 and 136 engage with the guide grooves 22*g* and 22*g* of the front wall 22 of the housing 12 so that the slider plate 131 can move along the guide grooves 22*g* and 22*g*.

Figure 28B:
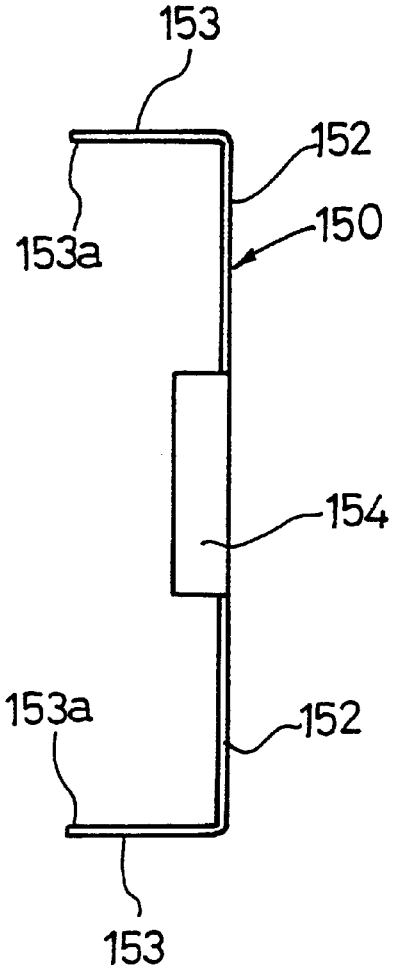
FIG. 28(B) is a left side view showing the feed pawl plate.
Figure 28A:
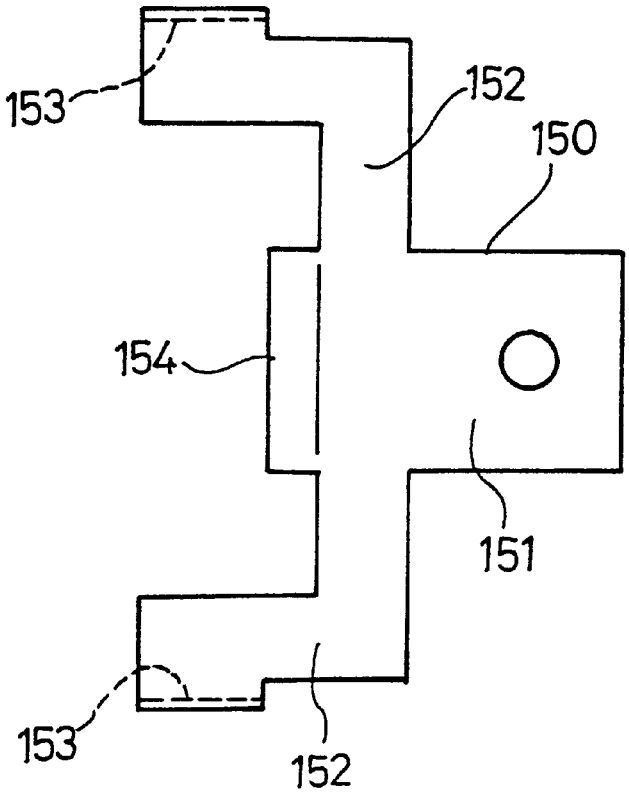
FIG. 28(A) is a plan view showing a feed pawl plate.
Figure 28C:
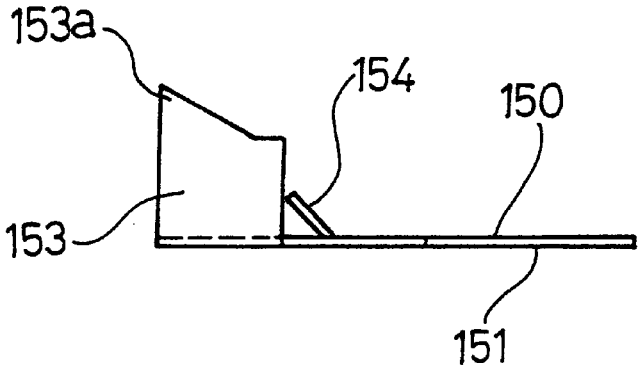
FIG. 28(C) is a front view showing the feed pawl plate.

The feed pawl plate 150, as shown in FIG. 25, is attached to the recess 133 of the slider plate 131. The feed pawl plate 150, as shown in FIG. 28, has two L-shaped arm plate portions 152 and 152 extending up and down from the left end of a base plate portion 151, feed pawls 153 and 153 protruding rearward from the upper and lower ends of the arm plate portions 152 and 152, and an inclined plate portion 154 extending obliquely from the left end of the base plate portion 151 in the protrusion direction of the feed pawl 153.

The feed pawls 153 and 153 are inserted into the cutouts 134 and 134 of the slider plate 131, and the right end portion of the base plate portion 151 is fixed by a screw N1. The point end portion of the inclined plate portion 154 is inserted into the groove 133B of the slider plate 131, and the inclined plate portion 154 is located at a position to the right (in FIG. 26) of the protruding portions 23B and 23B of the front wall 22 of the housing 12.

Figure 29:
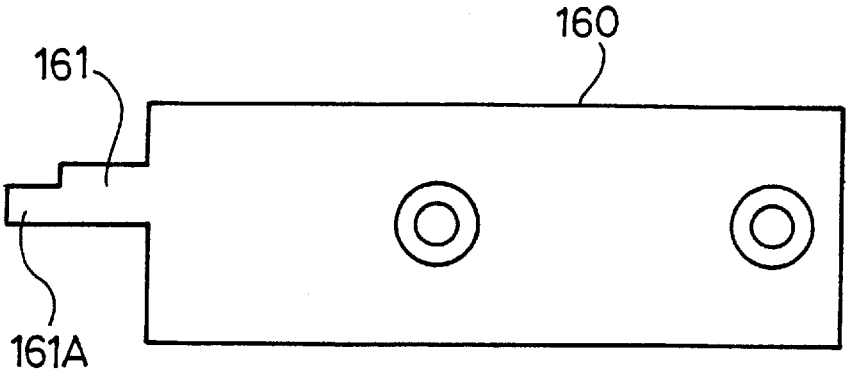
FIG. 29 is an explanatory diagram showing an anvil plate.

The anvil plate 160 shown in FIG. 29 is attached to the recess 135 of the slider plate 131 by screws N2 (see FIG. 26), and the long anvil portion 161 of the anvil plate 160 protrudes from the point end of the slider plate 131 in the left direction (see FIG. 25). The anvil portion 161 is located slightly above the center line 131Q of the slider plate 131. The width of the point end portion 161A of the anvil portion 161 in the up-and-down direction narrows, and the sectional shape of the anvil portion 161 is rectangular.

A spring S1, as shown in FIG. 26, is inserted into the hole 133A of the slider plate 131 so that the feed pawl plate 150 is urged toward the front surface side. As the feed pawl plate 150 goes in the right direction (in FIG. 26), it floats off the slider plate 131. For this reason, the point end portions 153*a* and 153*a* of the feed pawls 153 and 153 have retracted from the back surface of the anvil plate 160 to the front surface side.

When the slider 130 is located at a home position (sown in FIGS. 25 and 26), the point end portions 153*a* and 153*a* of the feed pawls 153 and 153 have retracted from the back surface of the anvil plate 160 to the front surface side so that they do not catch the clip plate 231 present in the conveyor path 211 of the cartridge 200. Thus, the spring S1 functions as retraction means which retracts the feed pawls 153 and 153 from the conveyor path 211.

If the slider 130 moves slightly from the home position in the left direction, the inclined plate portion 154 of the feed pawl plate 150 will be guided to the inclined surfaces 23*b* of the protruding portions 23B and 23B of the front wall 22 of the housing 12, and the base plate portion 151 of the feed pawl plate 154 will be brought into contact with the protruding portions 23B and 23B.

That is, since the base plate portion 151 of the feed pawl plate 150 rides on the protruding portions 23B and 23B, the left end of the feed pawl plate 150 is moved rearward (toward the back surface side) against the urging force of the spring S1. Therefore, the point end portions 153*a* and 153*a* of the feed pawls 153 and 153 are protruded from the back surface of the anvil plate 160 into the conveyor path 211, as shown by a broken line in FIG. 26.

With this protrusion, the point end portions 153*a* and 153*a* of the feed pawls 153 and 153 have caught the clip plate 231 present within the conveyor path 211 of the cartridge 200. Thus, the protruding portions 23B and 23B of the front wall 22 of the housing 12 and the inclined plate portion 154 of the feed pawl plate 150 function as protrusion means which protrudes the feed pawls 153 and 153 into the conveyor path 211.

(Forming Mechanism)

The forming mechanism 60, as shown in FIGS. 30 through 33, is constituted by a drive link 61, a forming body 70, a point-end bending guide member 85, and a rear guide plate 88.

Figure 11:
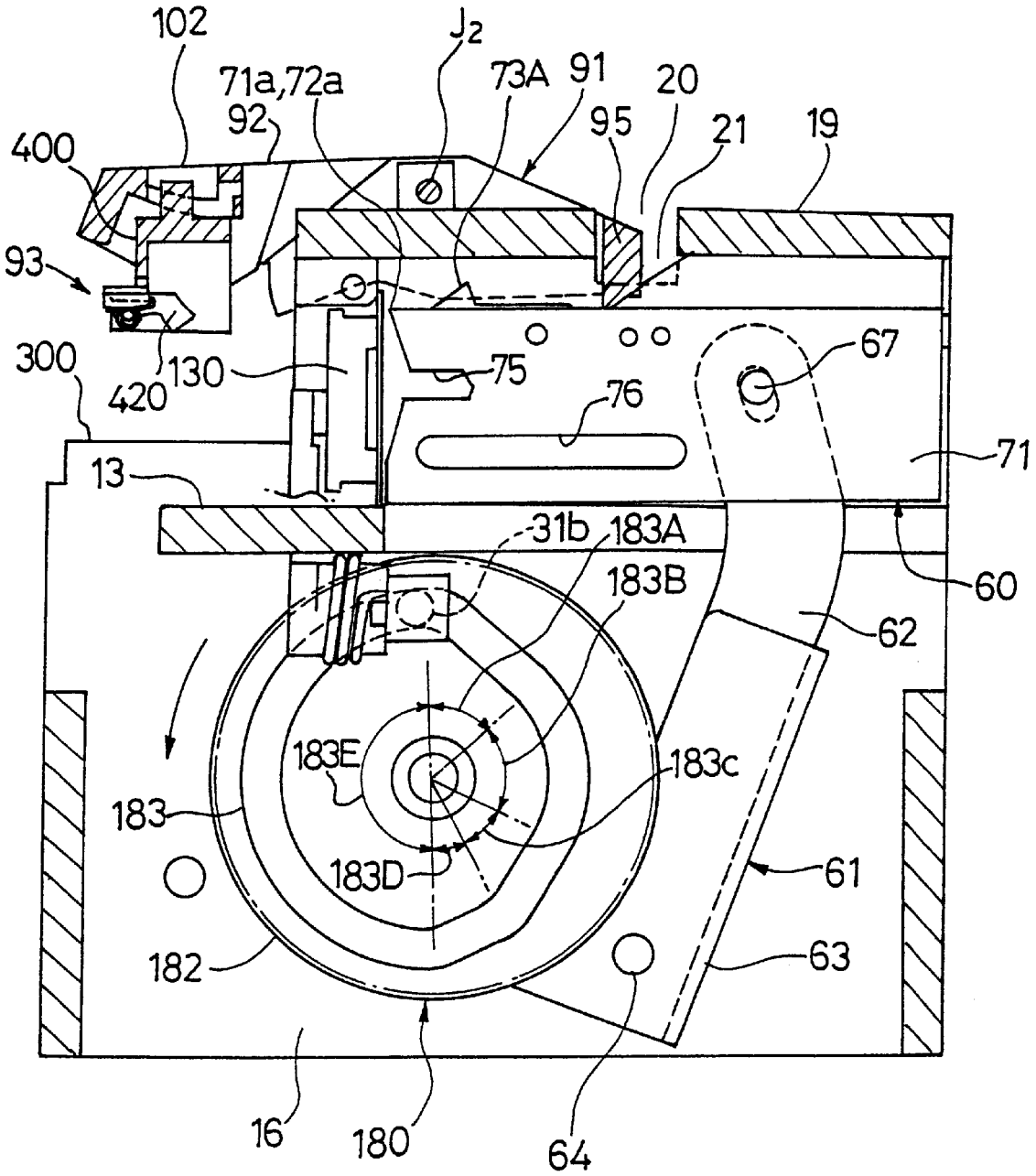
FIG. 11 is an explanatory diagram showing a drive mechanism and a forming mechanism.
Figure 34B:
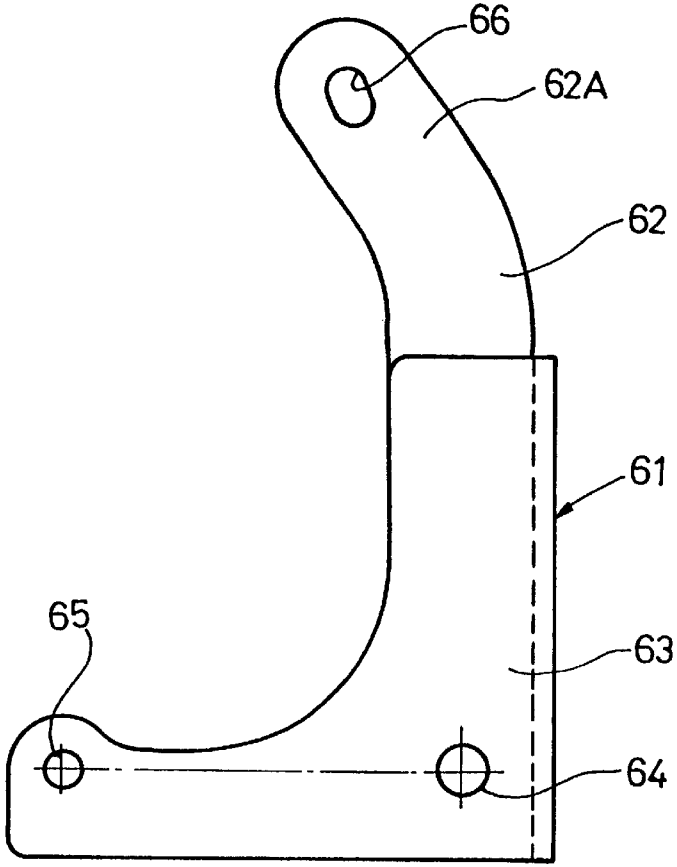
FIG. 34(B) is a front view showing the construction of the drive
Figure 34A:
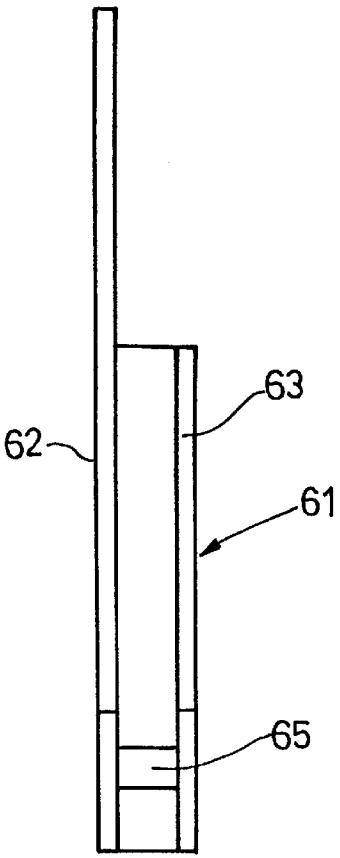
FIG. 34(A) is a side view showing the construction of a drive link; link.

The drive link 61 is provided in the drive chamber 25 (see FIG. 11). As shown in FIG. 34, the drive link 61 has a generally L-shaped arm 62 and an L-shaped auxiliary plate 63 shorter in length than this arm 62 and formed integrally with the arm 62. This auxiliary plate 63 is spaced from the arm 62 at a predetermined position. The intermediate portions of this arm 62 and auxiliary plate 63 are rotatably supported on the shaft 64 provided in the drive chamber 25, and the drive link 61 is freely rotatable on this shaft 64.

Also, a shaft 65 is provided in the end portions of the arm 62 and auxiliary plate 63 so as to be freely rotatable. The cam body 190 of the drive cam 180 is inserted into between the arm 62 and the auxiliary plate 63. The circumferential surface of this cam body 190 is contacted by the above-mentioned shaft 65. The drive link 61 is urged by a spring (not shown) so that the shaft 65 is always in contact with the circumferential surface of the cam body 190.

Figure 30:
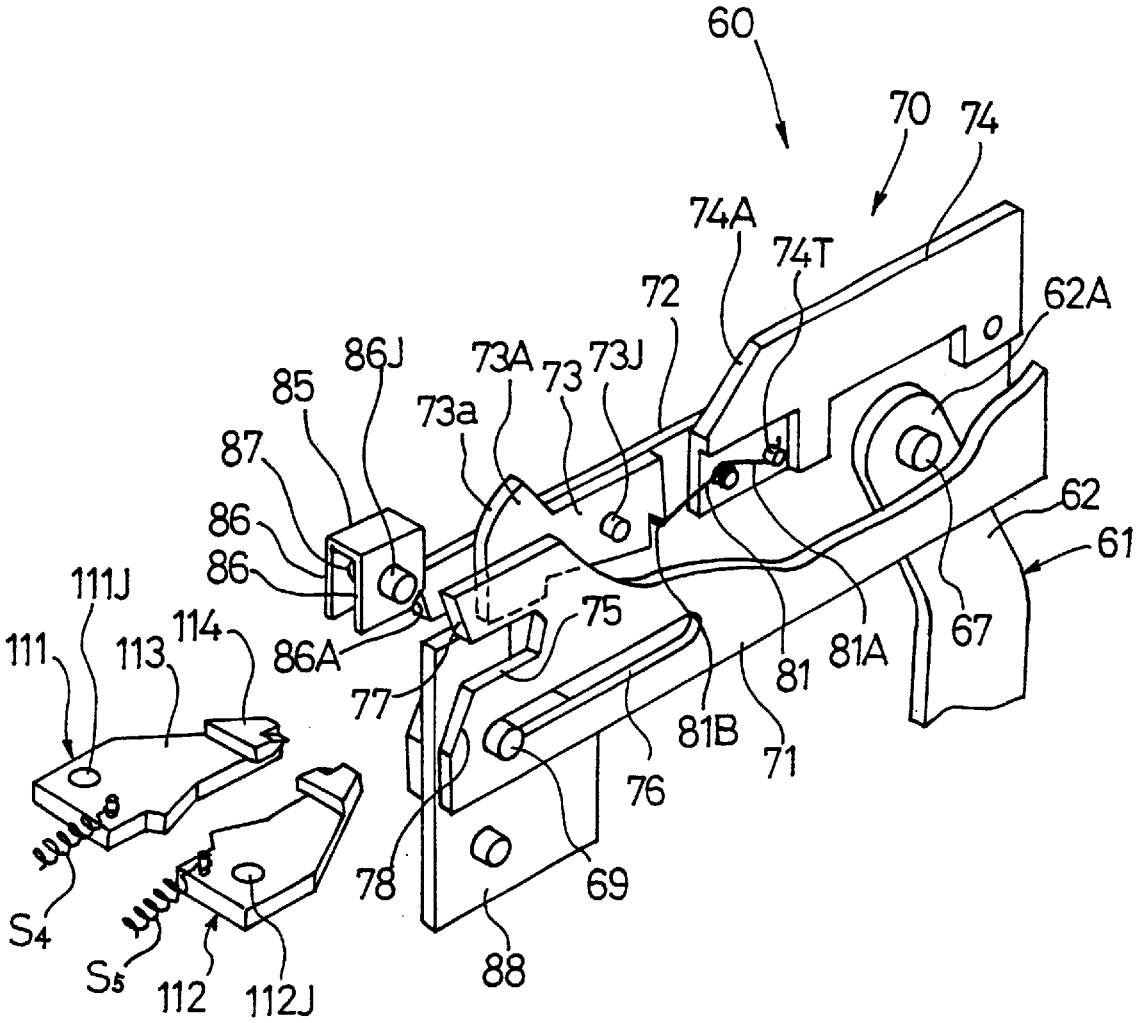
FIG. 30 is a perspective view showing the construction of a forming body.

The upper end portion 62A of the arm 62 goes into the forming chamber 26 and is also inserted into between the forming plates 71 and 72 of the forming body 70 to be described later (see FIG. 30). The upper end portion 62A is provided with an elongated hole 66.

(Forming Body)

The forming body 70 is constituted by a pair of opposed forming plates 71 and 72, and a pressure plate 73 and a link plate 74 provided between the forming plates 71 and 72. The height of the forming plates 71 and 72 in the up-and-down direction, as shown in FIG. 11, is set so that it is shorter than the length of the clip plate 231. The upper end portions 71*a* and 72*a* of the forming plates 71 and 72 are set so that they are located at a position adjacent to the upper portion of the hole 232 (see FIG. 19) provided in the clip plate 231.

Figure 35:
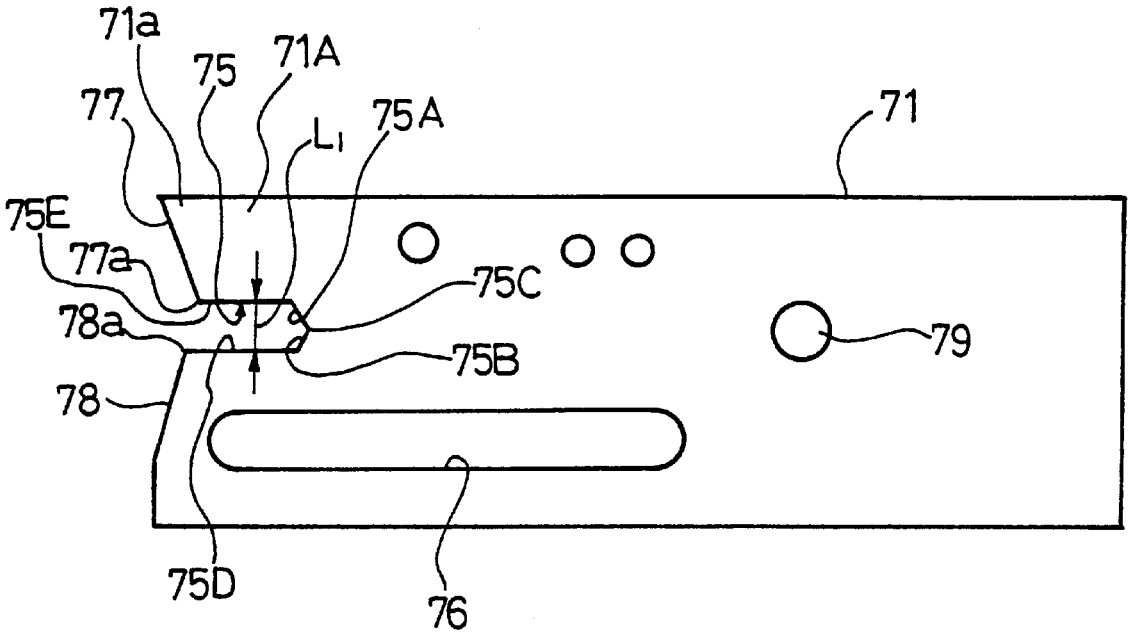
FIG. 35 is an explanatory diagram showing the forming plates.

The intermediate portion of the point end portion 71A of the forming plate 71 is formed with a cutout 75 as a recess for formation, as shown in FIG. 35. The cutout 75 extends rearward (right direction) and also has a predetermined width L1 (in the up-and-down direction). This cutout 75 has inclined surfaces 75A and 75B at its right end portion. The inclined surfaces 75A and 75B make a predetermined angle and form a corner 75C. Also, the bottom surface 75D and upper surface 75E of the cutout 75 are substantially horizontal. The width L1 of the cutout 75 is set so that it is nearly equal to a value obtained by adding a thickness twice the wall thickness of the clip plate 231 to the width (in the up-and-down direction) of the anvil portion 161.

The point end portion 71A of the forming plate 71 has upper and lower inclined surfaces 77 and 78 at positions across the cutout 75. The upper inclined surface 77 is inclined so that it protrudes forward as it goes upward from the cutout 75. The lower inclined surface 78 is inclined so that it protrudes forward as it goes downward from the cutout 75. The lower end portion 77*a* of the upper inclined surface 77 is located rearward (in the right direction in FIG. 35) beyond the upper end portion 78*a* of the upper inclined surface 78.

A guide hole 76 extending in a longitudinal direction (right-and-left direction in FIG. 35) is formed below the cutout 75 of the forming plate 71. Furthermore, a shaft hole 79 is formed rearwardly of the guide hole 76 and above the guide hole 76. Since the forming plate 72 is exactly the same as the forming plate 71, a description thereof is omitted.

A shaft 69 provided in the rear guide plate 88 is inserted into the guide holes 76 of the forming plates 71 and 72, and the shaft 67 is inserted into the shaft holes 79 of the forming plates 71 and 72. This shaft 67 is loosely fitted into the elongated hole 66 of the arm 62 of the drive link 61. The forming body 70 is moved in the longitudinal direction by rotation of the drive link 61. The forming plates 71 and 72 and the above-mentioned anvil portion 161 as a whole make up a bending means which creases and bends the clip plate 321.

Figure 36:
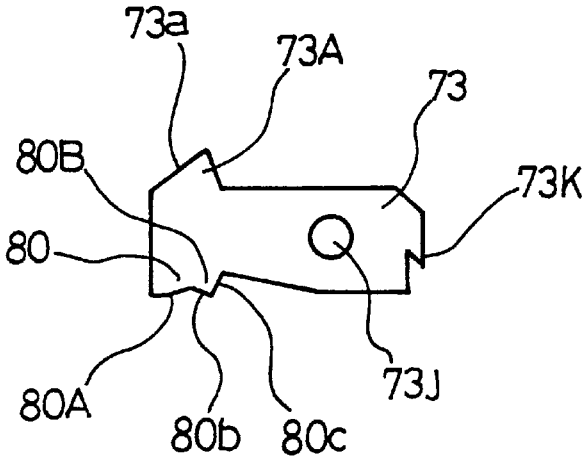
FIG. 36 is an explanatory diagram showing the pressure plate.
Figure 37:
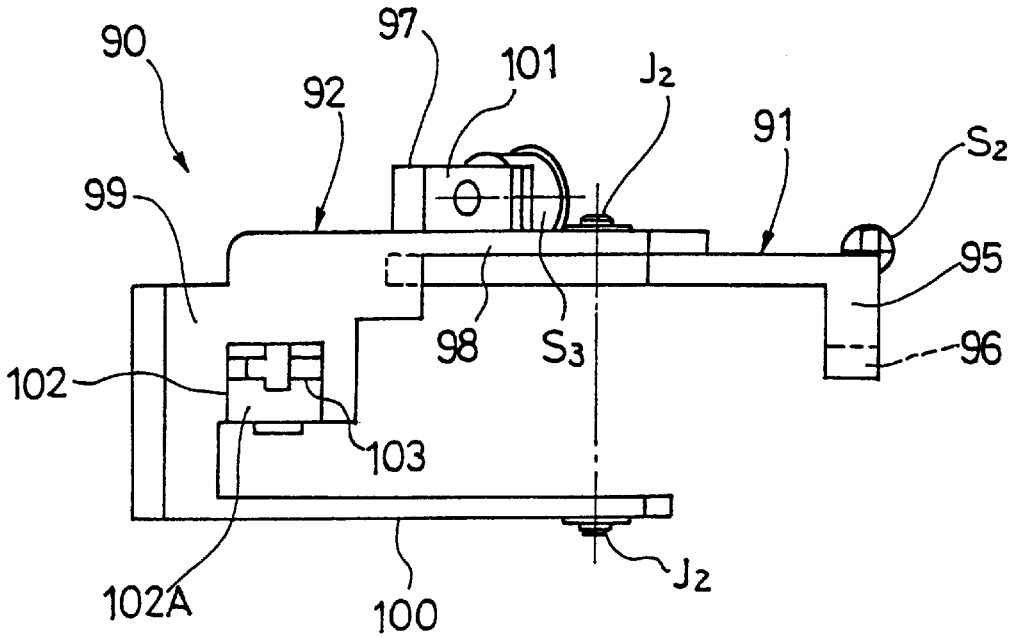
FIG. 37 is a plan view showing the construction of a press mechanism.
Figure 38:
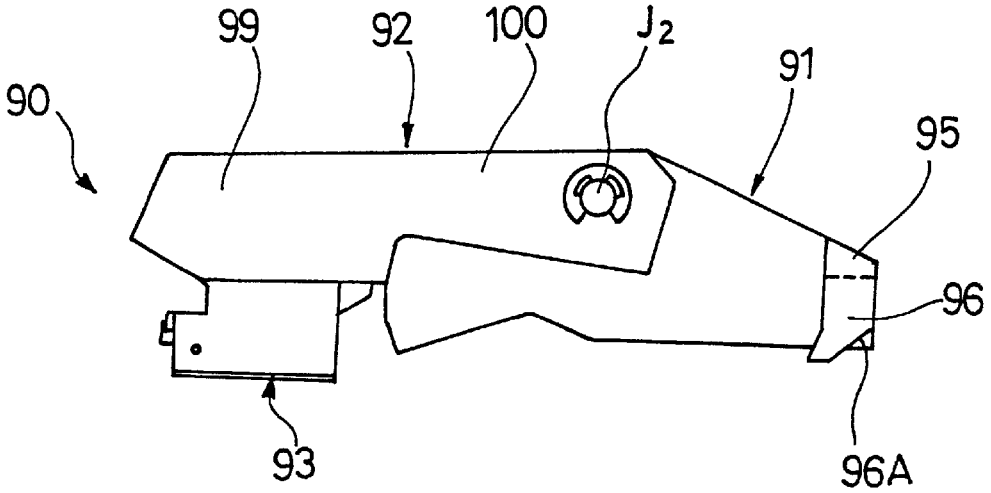
FIG. 38 is a side view showing the construction of a press mechanism.
Figure 39:
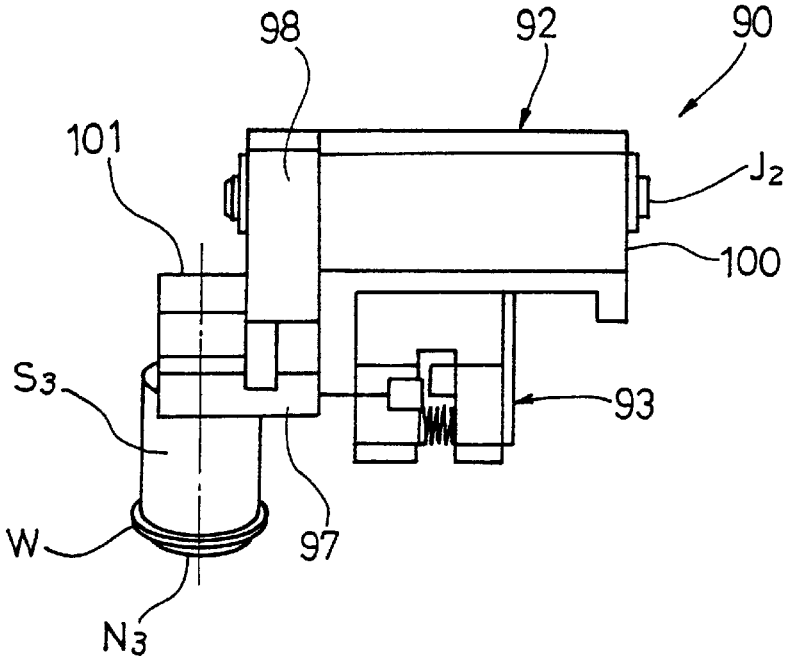
FIG. 39 is a front view showing the construction of the press mechanism.

The pressure plate 73 is provided between the forming plates 71 and 72 so that it is freely rotatable on a shaft 73J. As shown in FIG. 36, the pressure plate 73 has an upper protrusion 73A and a lower pressure portion 80 at its point end portion. The upper protrusion 73A has an inclined surface 73*a* at the upper portion of the point end portion. The protrusion 73A protrudes upward from the forming plates 71 and 72. The pressure portion 80 has an inclined surface 80A and a protrusion 80B. The inclined surface 80A extends upward from its front end to its rear end. The protrusion 80B protrudes downward from the rear end of the inclined surface 80A and has inclined surfaces 80*b* and 80*c*. Also, the rear portion of the pressure plate 73 is formed with a stopper portion 73K.

This pressure portion 80 has ridden on the upper surface of the rear guide plate 88 when the forming body 70 is at the home position.

The link plate 74 is fixed between the forming plates 71 and 72 and has an inclined surface 74A at its front upper portion. This inclined surface 74A protrudes upward from the forming plates 71 and 72.

A torsion coil sprig 81 is attached to the plate 74. One end 81A of the spring 81 is anchored to the protrusion 74T of the link plate 74, while the other end 81B is anchored to the stopper portion 73K of the pressure plate 73. With this, the pressure plate 74 is urged in a counterclockwise direction in FIG. 36.

The point-end bending guide member 85 is attached to the front upper portion of the forming chamber 26 and has a pair of side plate portions 86 and 86, a shaft 86J provided between the side plate portions 86 and 86, and a roller attached to this shaft 86J so as to be freely rotatable. The side plate portions 86 and 86 are formed with inclined surfaces 86A at the rear lower ends thereof. The inclined surfaces 86A make contact with the upper portion 231*a* of the clip plate 231 (see FIG. 19). The distance between the side plate portions 86 and 86 is shorter than the width of the clip plate 231. The roller 87 is attached at a position which contacts with the inclined surface 73*a* of the pressure plate 73.

Figure 58:
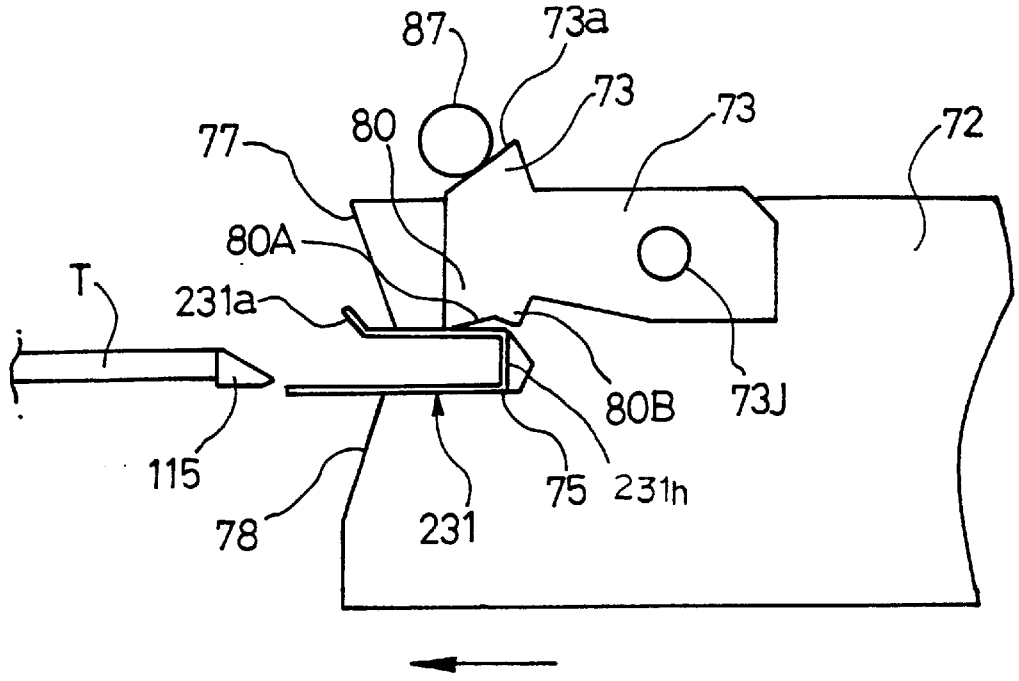
FIG. 58 is an explanatory diagram showing a state in which the inclined surface of a pressure plate is in contact with a roller.

The side plate portions 86 function as an end-portion bending means which bends the upper portion 231*a* of the clip plate 231 in a direction opposite to the clipping direction, while the roller 87 functions as a pressure means which pushes the pressure portion 80 of the pressure plate 73 downward. The roller 87 and pressure plate 73 function as a crushing means which crushes the clip plate bent in the form of a U letter, pushing the rear portion 231*h* (see FIG. 58) of the clip plate 231 forward.

The rear guide plate 88 is attached between the intermediate wall 14 and the side wall 16, and the upper portion of the rear guide plate 88 is inserted into between the forming plates 71 and 72. Between the rear guide plate 88 and the anvil portion 161, a gap (see FIG. 50) is provided so that the clip plate 231 can advance. The rear guide plate 88 and the anvil portion 161 can hold the clip plate 231 fed out. If the forming body 70 advances to the side of the anvil portion 161, the clip plate 231 supported by the rear guide plate 88 and the anvil portion 161 will be separated from the clip-connected plate 230 and bent by the cutout 75 of the forming body 70 and the anvil portion 161.

(Press Mechanism)

The press mechanism (press means) 90, as shown in FIGS. 37 through 41, is equipped with a first press link 91, a second press link 92, and a press member 93.

The first press link 91 extends along the exterior side of the housing 12 and is rotatably attached to a shaft J2 provided in the housing 12. The rear end portion of the first press link 91 is formed with a protrusion 95 which protrudes inward (downward in FIG. 37). This protrusion 95 is inserted into the recess 20 of the side wall 16 of the housing 12 (see FIG. 11). The point end of the protrusion 95 is formed with a stopper piece 96 protruding downward. This stopper piece 96 goes into the forming chamber 26 through the hole 21 of the recess 20. The lower portion of the stopper piece 96 has an inclined surface 96A which extends upward as it goes to its rear end. This inclined surface 96A is opposed to the inclined surface 74A of the link plate 74 (see FIG. 33).

Figure 40:
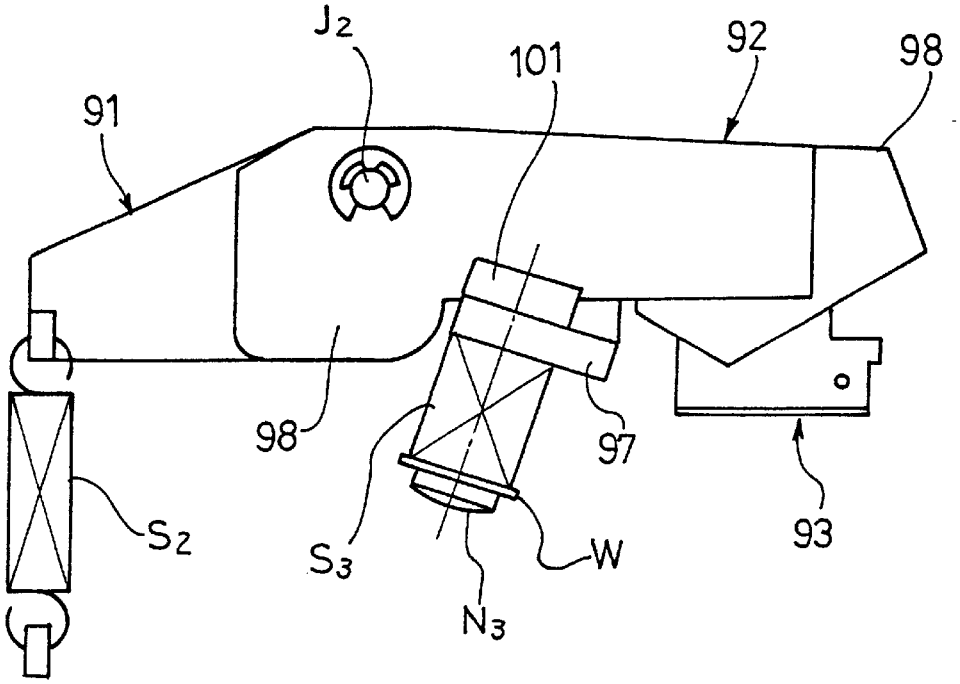
FIG. 40 is a side view showing the construction of the press mechanism.

The first press link 91 is urged in a counterclockwise direction in FIG. 40 by a spring S2 so that the stopper piece 96 is always in contact with the inclined surface 74A or upper surface 74B of the link plate 74. Also, on the side of the first link 91 a stopper portion 97 is formed.

The second press link 92 has an abutting plate portion 98 which abuts on the exterior surface of the first press link 91, a hold portion 99 formed on the point end of the abutting plate portion 98 for holding the press member 93, and an arm plate portion 100 extending rearward from this hold portion 99 and opposed to the abutting plate portion 98. The abutting plate 98 and arm plate portion 100 are supported on the shaft J2, and the second press link 92 is rotatable on the shaft J2.

The abutting plate portion 98 of the second press link 92 is provided with an abutting piece 101 which abuts on the stopper portion 97 of the first press link 91. A screw N3 is fixed to the abutting piece 101 through the stopper portion 97. And a spring S3 is interposed between a washer W on the screw N3 and the stopper portion 97. With the urging force of this spring S3, the stopper portion 97 of the first press link 91 and the abutting piece 101 of the second press link 92 are pressed with each other. As a result, the first press link 91, along with the second press link 92, is rotatable on the shaft J2.

The first press link 91 can also rotate relatively with respect to the second press link 92 against the urging force of the spring S3 even when rotation of the second press link 92 is stopped.

Figure 42B:
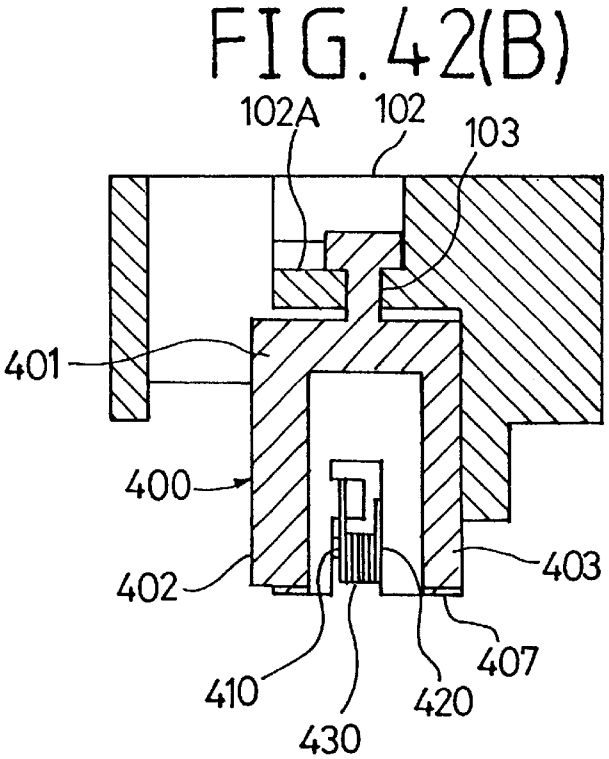
FIG. 42(B) is a cross sectional view showing the press member.
Figure 42A:
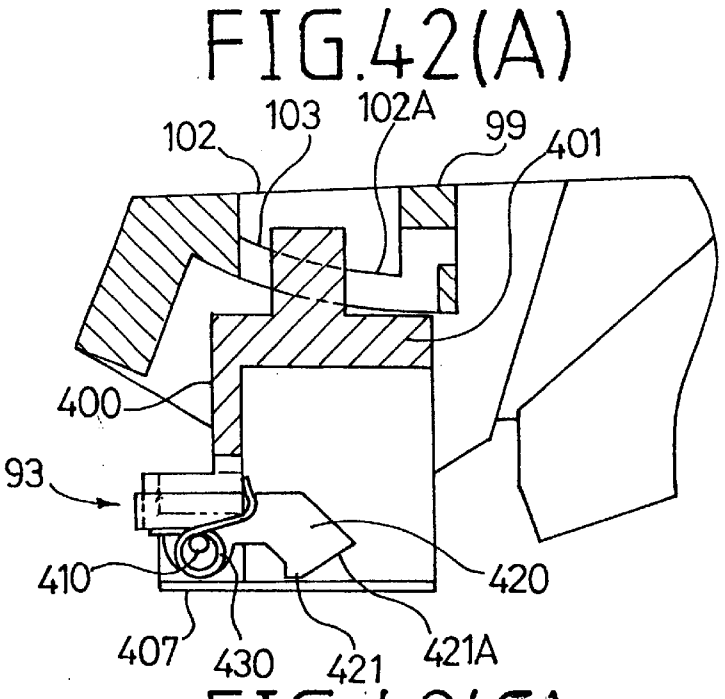
FIG. 42(A) is a longitudinal sectional view showing the press member.
Figure 42C:
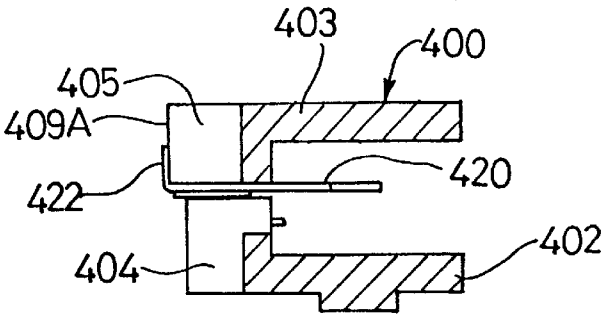
FIG. 42(C) is a sectional plan view showing the press member.
Figure 43B:
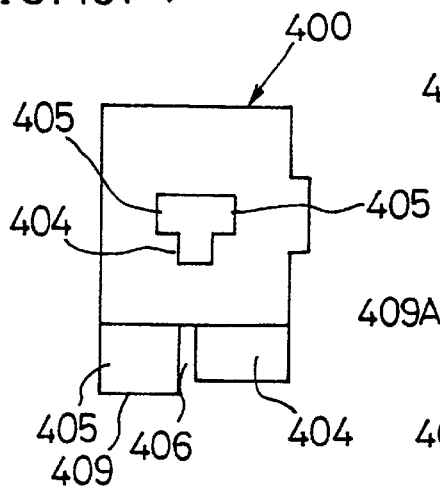
FIG. 43(B) is a plan view showing the press member.
Figure 43A:
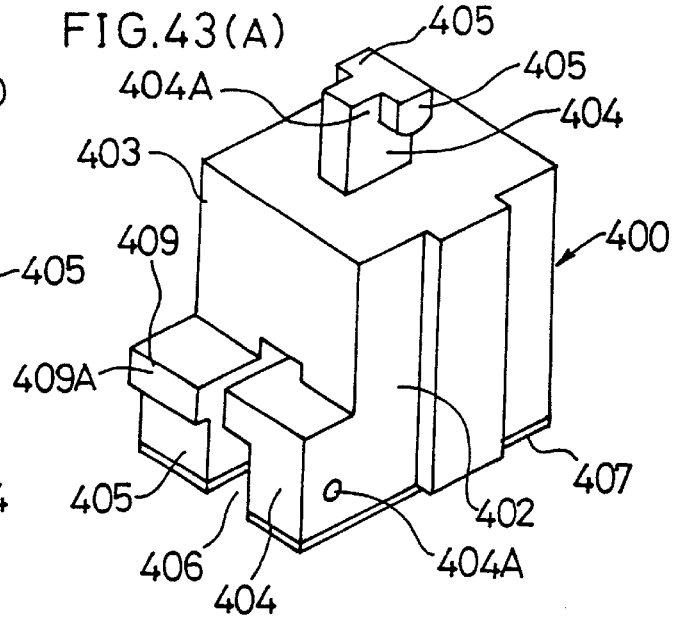
FIG. 43(A) is a perspective view showing the press member.
Figure 43C:
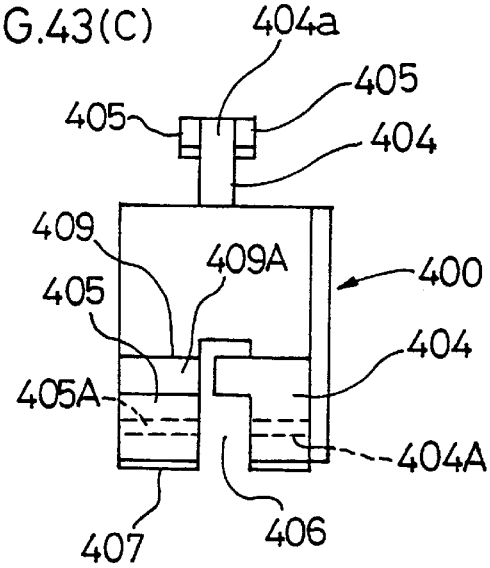
FIG. 43(C) is a front view showing the press member.
Figure 43D:
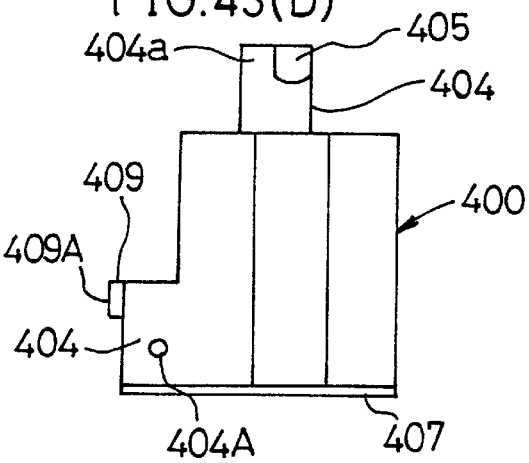
FIG. 43(D) is a side view showing the press member.

The hold portion 99, as shown in FIG. 42, is formed with a recess 102. The cross section of the bottom portion 102A of this recess 102 is formed into a circular arc shape which protrudes downward. This bottom portion 102A is formed with a slit 103 extending in the longitudinal direction.

The press member 93, as shown in FIG. 42, is constituted by a cage body 400 whose rear surface and bottom surface are open and a hook member (anti-separation member) 420.

Figure 41:
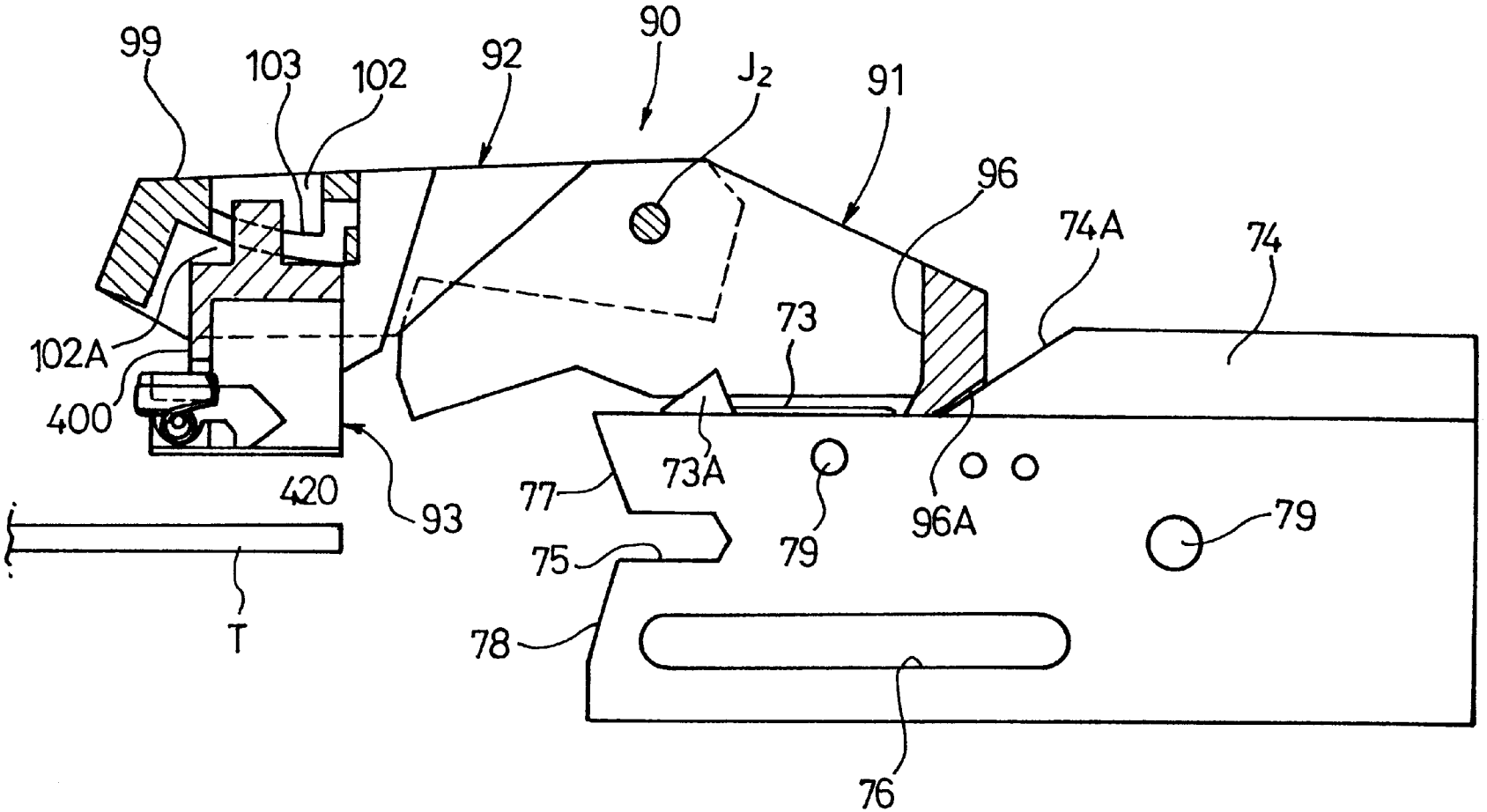
FIG. 41 is a sectional view showing the construction of the press mechanism.

The cage body 400 is equipped with a ceiling plate portion 401, side wall portions 402 and 403 extending downward from both sides of this ceiling portion 401, and a column portion 404 extending upward from the central portion of the ceiling plate portion 401 as shown in FIG. 43 and inserted in the above-mentioned slit 103. The upper portion 404*a* of the column portion 404 protrudes upward from the slit 103 and is provided with a protrusion 405 protruded in a right-and-left direction. With this protrusion 405, the press member 93 is hung on the bottom portion 102A of the hold portion 99, and as shown in FIG. 41, the bottom portion of the cage body 400 is always held in a horizontal state independent of the quantity of rotation of the second press link 92.

At the front ends of the side wall portions 402 and 403 of the cage body 400, inwardly protruding wall portions 404 and 405 are formed. Between the protruding wall portions 404 and 405 a gap 406 is formed. The position of this gap 406 is set so that it is opposed to the space between the forming plates 71 and 72 of the forming body 70. A rubber sheet 407 is attached to the lower surfaces of the side wall portions 402 and 403 and protruding wall portions 404 and 405. The protruding wall portions 404 and 405 are provided with through-shaft-holes 404A and 405A in a direction perpendicular to the gap 406, respectively. The front surface of the protruding wall portion 405 has a protruding portion 409, which in turn has a flat surface 409A.

Figure 44A:
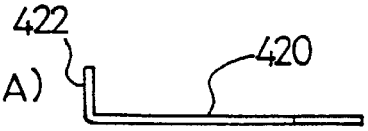
FIG. 44(A) is a plan view showing a hook member.
Figure 44B:
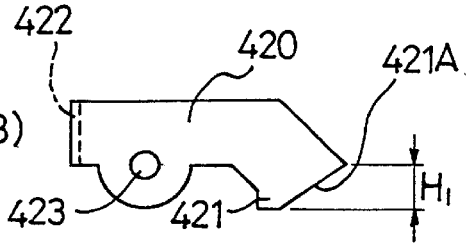
FIG. 44(B) is a side view showing the hook member.

The hook member 420, as shown in FIG. 44, has a hook portion 421 protruding downward at one end thereof (right end in FIG. 44), a bent stopper portion 422 at the other end, and a shaft hole 423 provided close to the other end. The rear portion of the hook portion 421 is formed with an inclined surface 421A. The height H1 of the inclined surface 421A is set so that it is higher than the height H2 (see FIG. 55(B)) of the upper end portion 231*a* of a bent clip plate 231 to be described later.

A shaft 410 (see FIG. 42), inserted in the shaft holes 404A and 405A of the protruding wall portions 404 and 405 of the cage body 400, is inserted through the shaft hole 423 of the hook member 420. The hook member 420 is attached to the cage body 400 so that it is rotatable on the shaft 410. The hook member 420 is urged in a clockwise direction in FIG. 42 by a torsion coil spring 430. The stopper portion 422 of the hook member 420 abuts on the flat surface 409A of the protruding wall portion 405 of the cage body 400, thereby preventing the hook member 420 from rotating in the clockwise direction at a position shown in FIG. 42. The hook member 420, torsion coil spring 430, etc., function as an anti-separation means which prevents the clip plate 231 from being separated from a sheet bundle T when the forming body 70 is retracted (see FIG. 75).

(Widening Mechanism)

Figure 45:
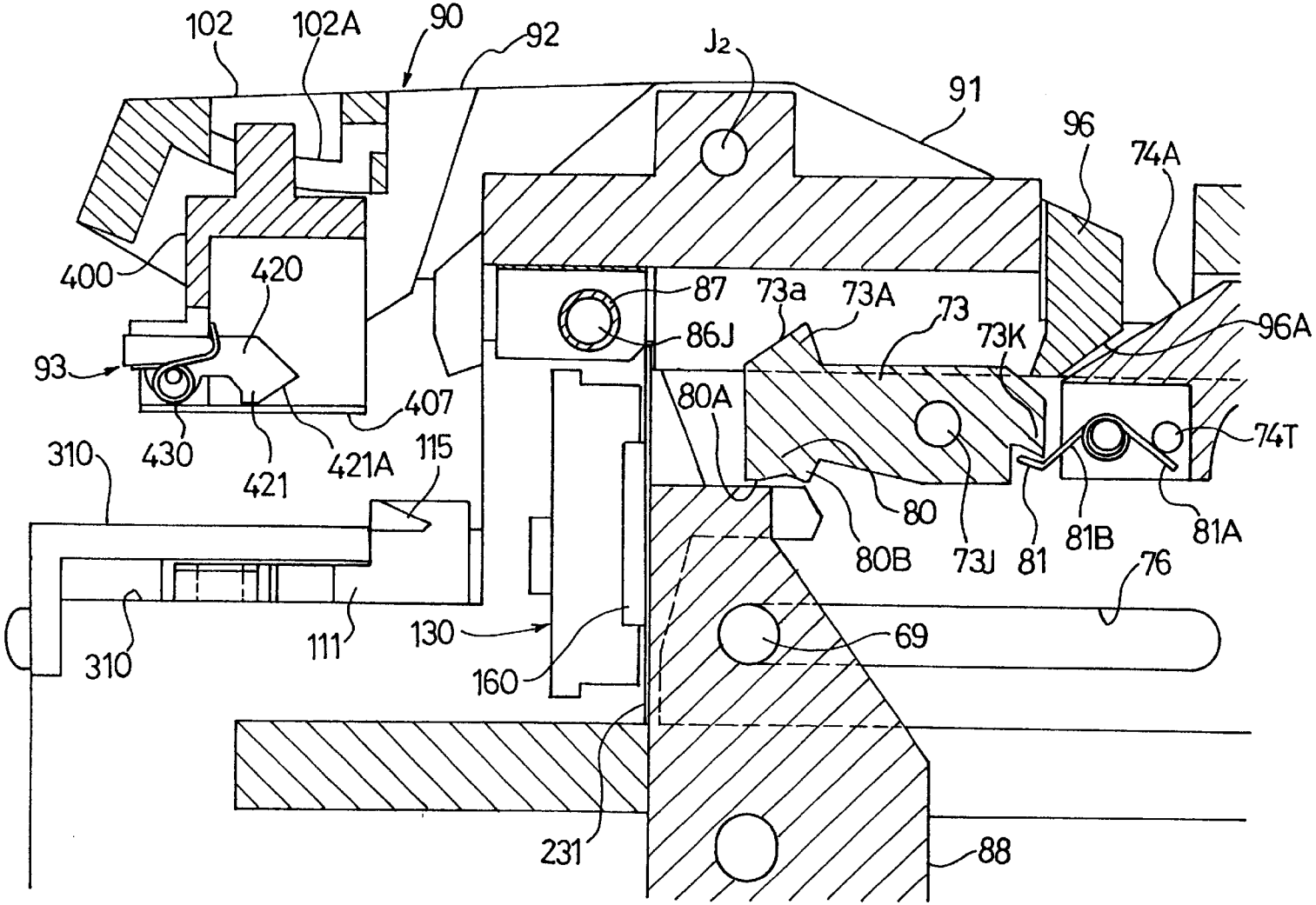
FIG. 45 is an explanatory diagram showing the relation between the forming body, the press mechanism, and the clip plate.
Figure 46B:
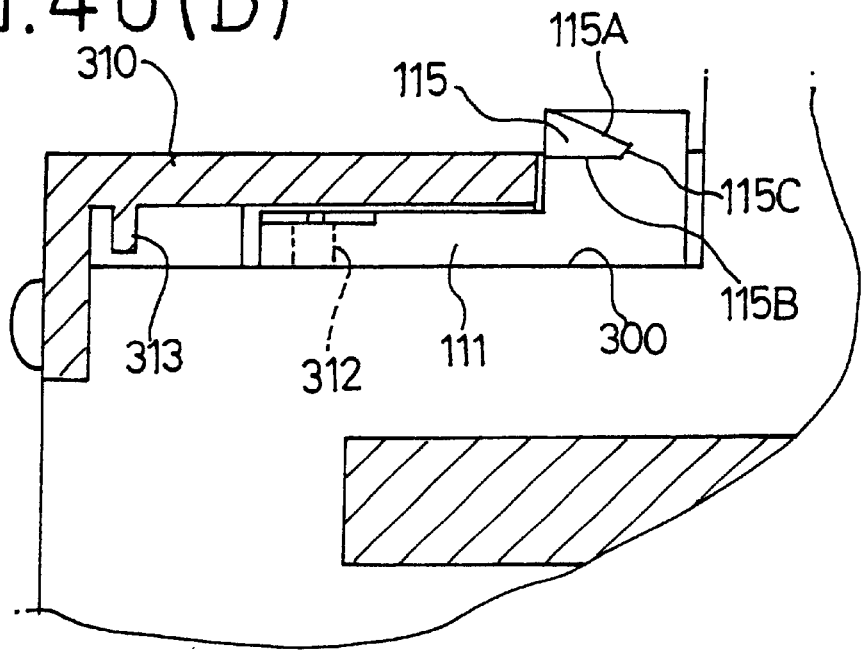
FIG. 46(B) is a longitudinal sectional view showing the clip mechanism.

The widening mechanism 110 is constituted by a first widening member 111 arranged in the space between the support table 300 of the housing 12 and the sheet table 310 and a second widening member 112 arranged in the space between the support table 301 of the housing 12 and the sheet table 320, as shown in FIGS. 45 and 46. The widening members 111 and 112 are supported on the shaft portions 312 and 322 of the sheet tables 310 and 320 so that they are freely rotatable on the shaft portions 312 and 322.

The first widening member 111, as shown in FIG. 47, has a flat base plate portion 113, a guide base portion 114, and a guide protrusion (widening means) 115. The flat base plate portion 113 has a shaft hole 113H into which the shaft portion 312 of the sheet table 310 (see FIG. 46) is inserted. The guide base portion 114 is thicker in wall thickness than the base plate portion 113 and protrudes upward from the upper surface of the base plate portion 113. The guide protrusion 115 is formed on the right surface (in FIG. 47(A)) of the guide base portion 114 at a position above the upper surface of the base plate portion 113.

The guide protrusion 115 is formed with an inclined surface 115A which extends slowly downward as it goes toward the forming body 70 and an inclined surface 115C which extends upward from the bottom surface 115B of the guide protrusion 115 toward the forming body 70. The inclined surface 115C is shorter than the inclined surface 115A and sharper in slope.

Figure 47A:
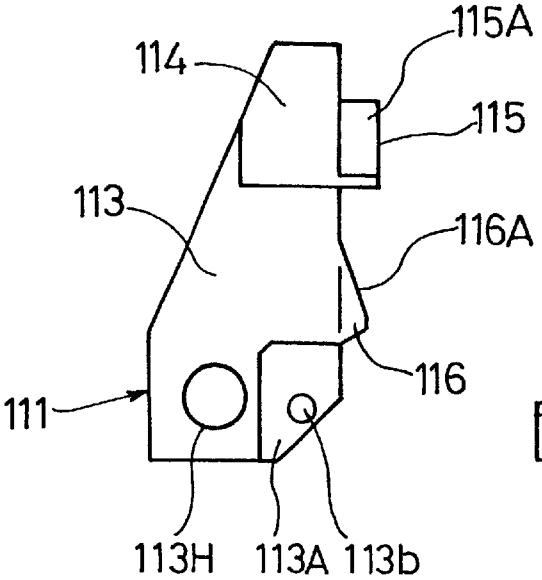
FIG. 47(A) is a plan view showing a guide member.
Figure 47B:
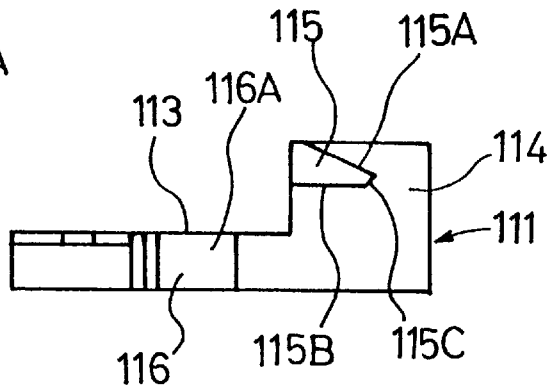
FIG. 47(B) is a right side view showing the guide member.
Figure 47C:
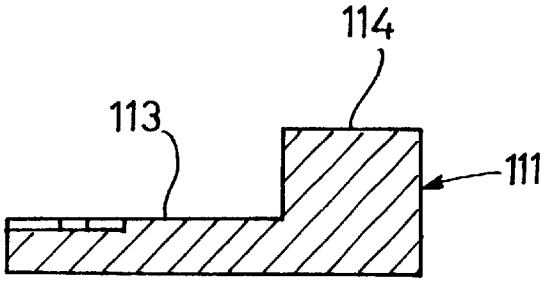
FIG. 47(C) is a sectional view showing the guide member.
Figure 47D:
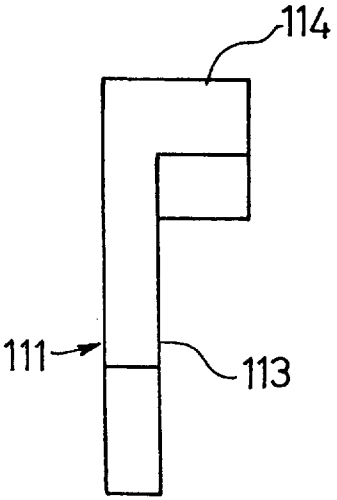
FIG. 47(D) is a left side view showing the guide member.

Also, a protruding portion 116 is formed on the right surface (in FIG. 47(A)) of the base plate portion 113 and protrudes in the right direction beyond the guide protrusion 115. This protruding portion 116 has an inclined surface 116A whose protrusion quantity increases as it goes forward The base plate portion 113 is also formed with a recess 113A, which is in turn formed with a protrusion 113*b*.

One end of a spring S4 is anchored to the protrusion 113*b*, while the other end is anchored to the stopper protrusion 313 of the sheet table 310. With this, the first widening member 111 is urged in a clockwise direction with the shaft portion 312 as center (see FIG. 46(A)). The first widening member 111 is also urged by a stopper portion (not shown) so that it does not rotate from the position shown in FIG. 46 in the clockwise direction.

The second widening member 112 is arranged at a position spaced from the first widening member 111 at a predetermined distance. The second widening member 112, as shown in FIG. 47, has a flat base plate portion 117, a guide base portion 118, and a guide protrusion (widening means) 119. The flat base plate portion 117 has a shaft hole 117H into which the shaft portion 322 of the sheet table 320 (see FIG. 46) is inserted. The guide base portion 118 is thicker in wall thickness than the base plate portion 117 and protrudes upward from the upper surface of the base plate portion 117. The guide protrusion 119 is formed on the left surface (opposed to the fist widening member 111) of the guide base portion 118 at a position above the upper surface of the base plate portion 117 (in FIG. 58(B)).

The guide protrusion 119 is formed with an inclined surface 119A which extends slowly downward as it goes toward the forming body 70 and an inclined surface 119C which extends upward from the bottom surface 119B of the guide protrusion 119 toward the forming body 70. The inclined surface 119C is shorter than the inclined surface 119A and sharper in slope. The bottom surface 119B of the guide protrusion 119 is at approximately the same height position as the bottom surface 75D of the cutout 75 of the forming plate 71.

Figure 48A:
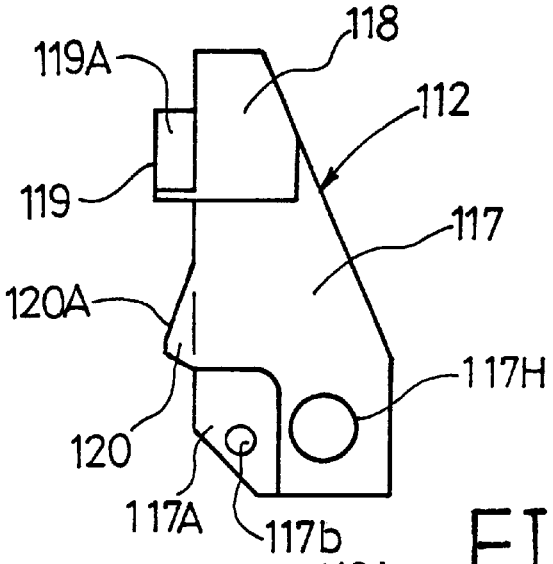
FIG. 48(A) is a plan view showing a guide member.
Figure 48D:
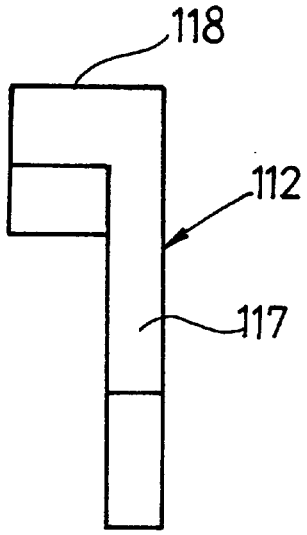
FIG. 48(D) is a right side view showing the guide member.
Figure 48B:
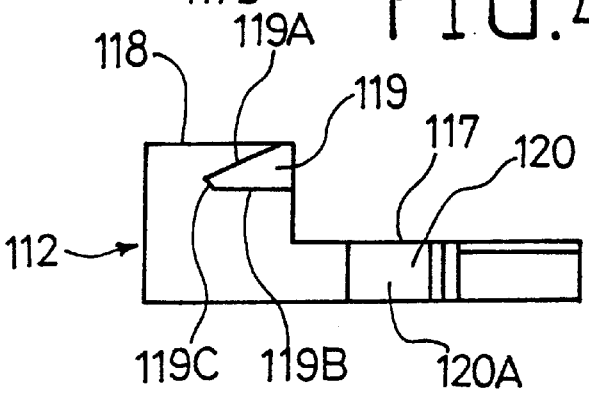
FIG. 48(B) is a left side view showing the guide member.
Figure 48C:
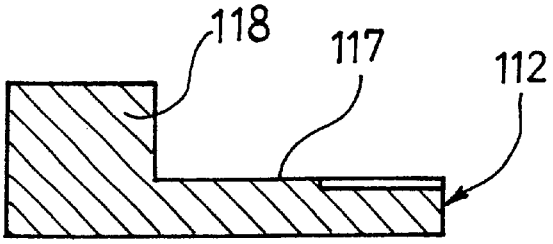
FIG. 48(C) is a sectional view showing the guide member.
Figure 49:
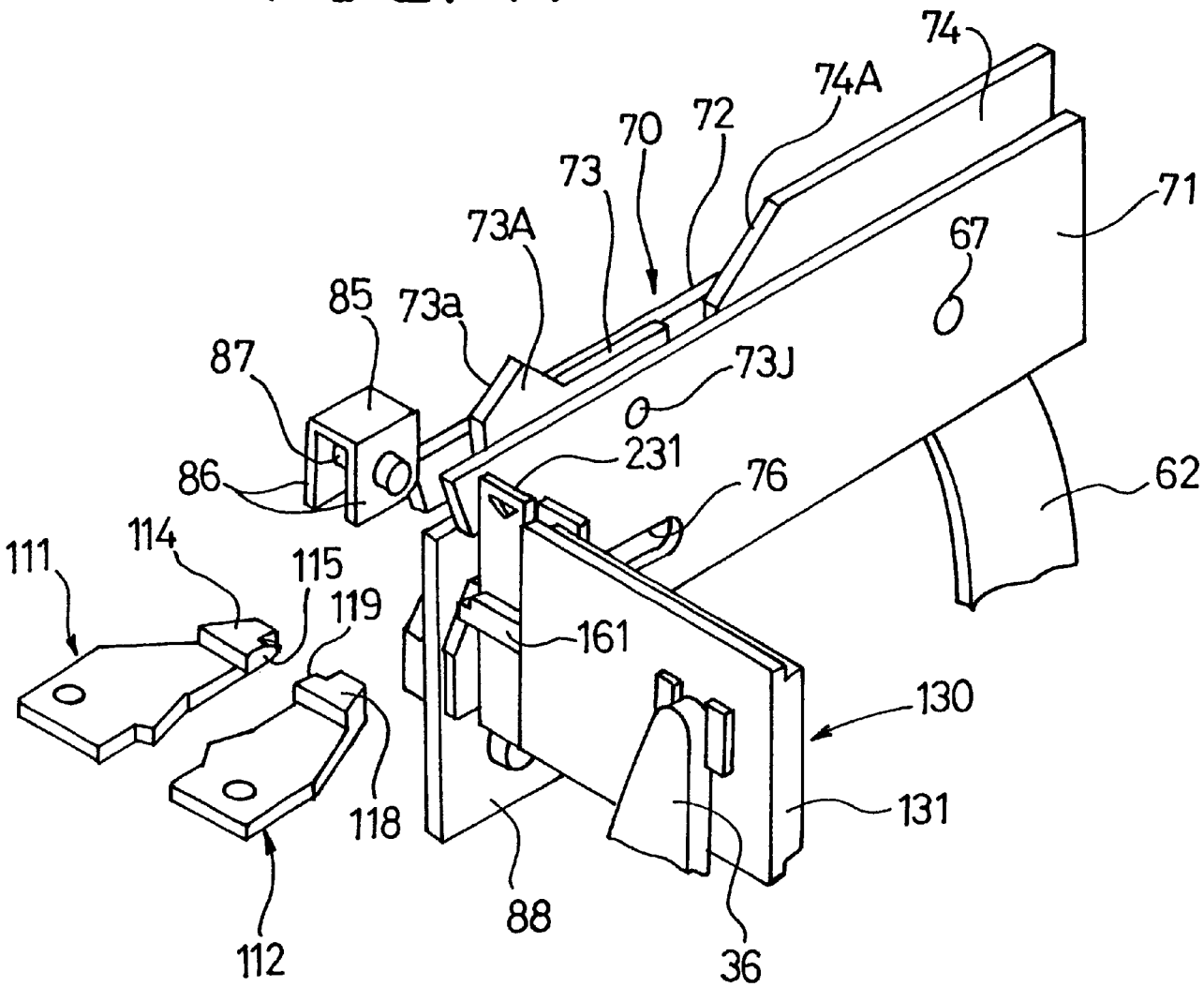
FIG. 49 is a perspective view showing the positional relation between the forming body, the slider, and the clip plate in a home position.

Also, a protruding portion 120 is formed on the left surface (in FIG. 48(A)) of the base plate portion 118 and protrudes in the left direction beyond the guide protrusion 119. This protruding portion 120 has an inclined surface 120A whose protrusion quantity increases as it goes forward. The base plate portion 117 is also formed with a recess 117A, which is in turn formed with a protrusion 117*b*.

One end of a spring S5 is anchored to the protrusion 117*b*, while the other end is anchored to the stopper protrusion 323 of the sheet table 320. With this, the second widening member 112 is urged in the counterclockwise direction with the shaft portion 322 as center (see FIG. 46(A)). The second widening member 112 is also urged by a stopper portion (not shown) so that it does not rotate from the position shown in FIG. 46 in the counterclockwise direction.

The widening mechanism 110 and the forming body 70 constitute a clip means which clips a sheet bundle T.

(Operation)

Now, a description will be made of the operation of the clip device constructed as described above.

Figure 6:
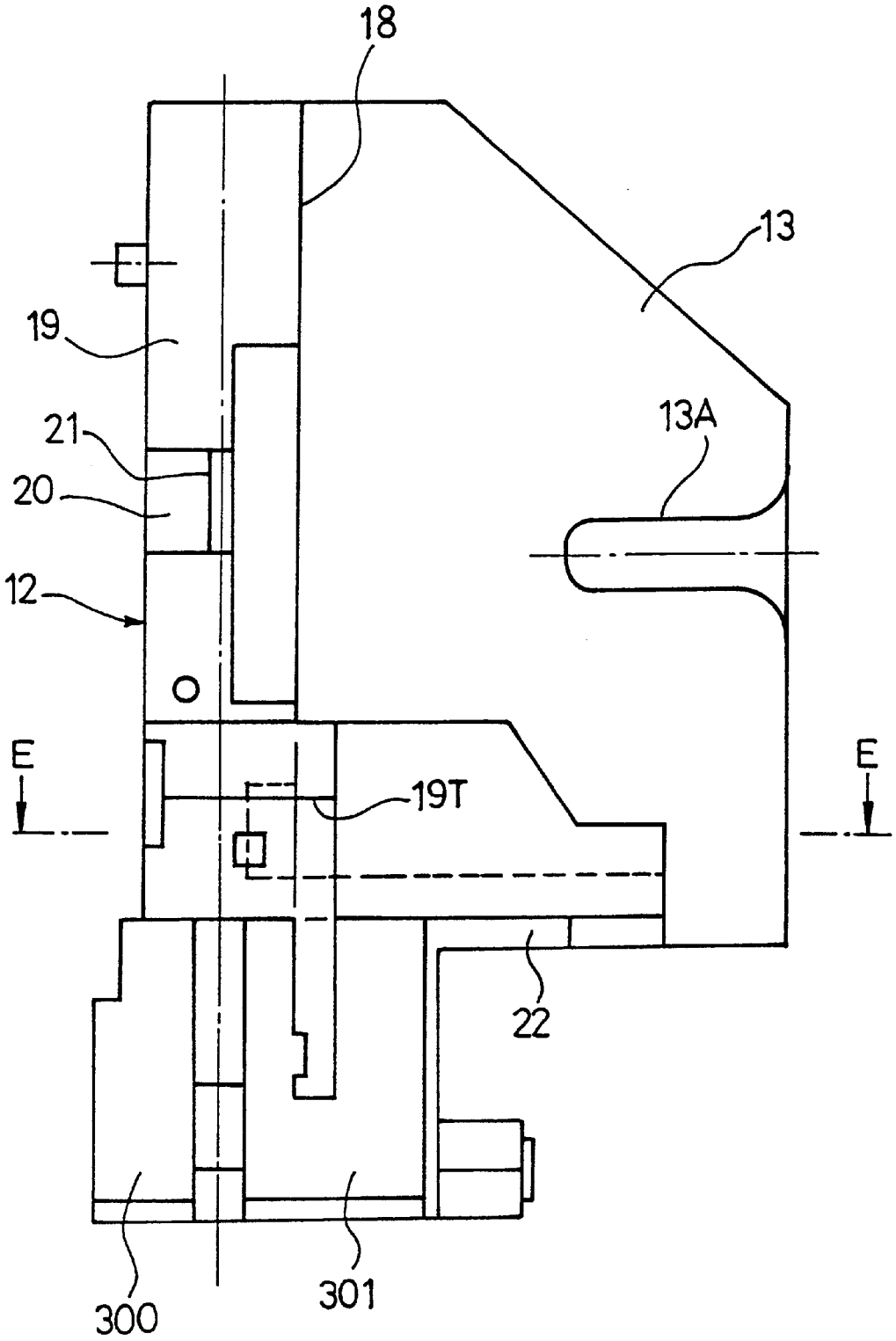
FIG. 6 is a plan view of the housing shown in FIG. 5.
Figure 7:
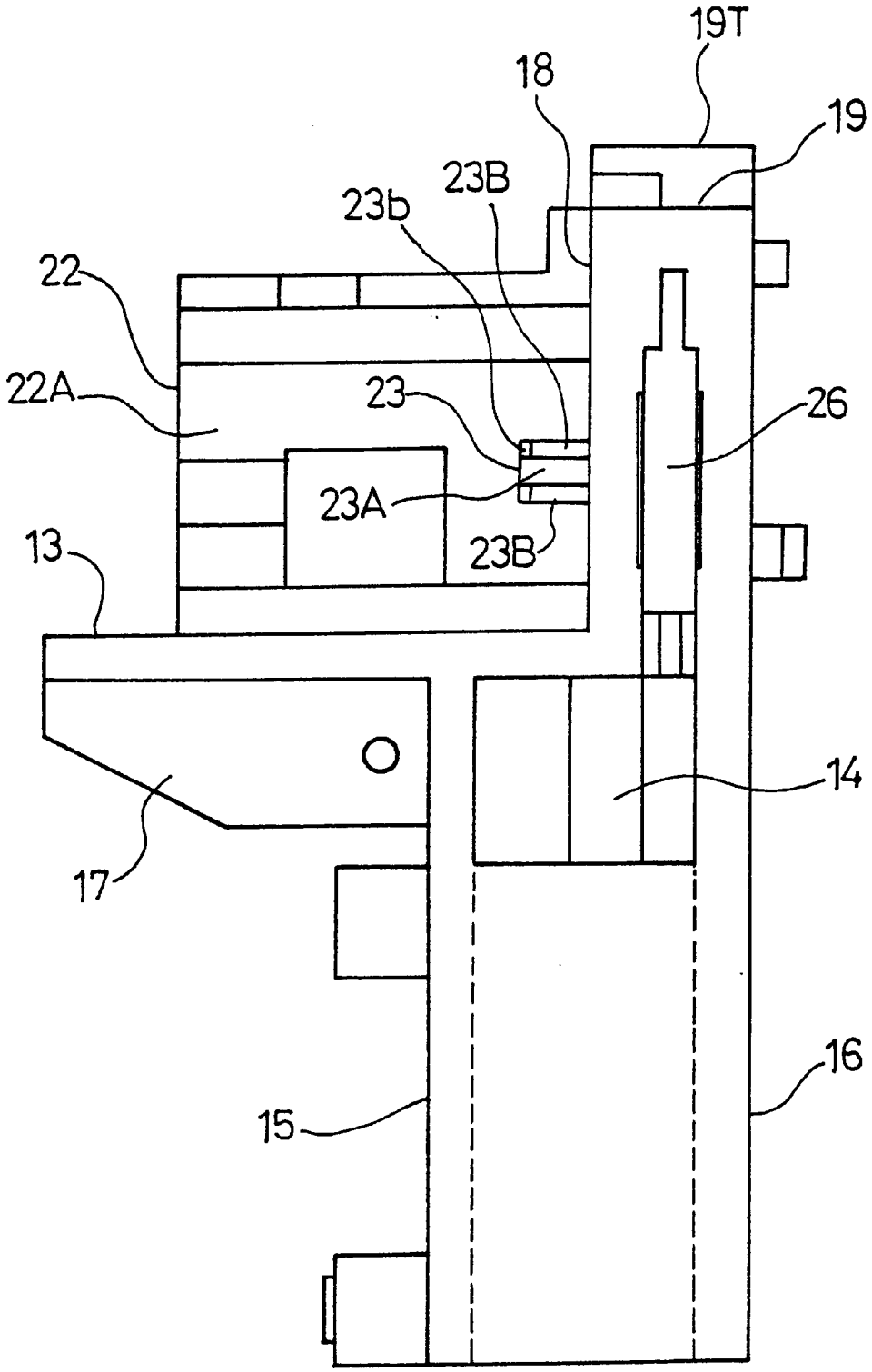
FIG. 7 is a rear side view of the housing shown in FIG. 5.
Figure 8:
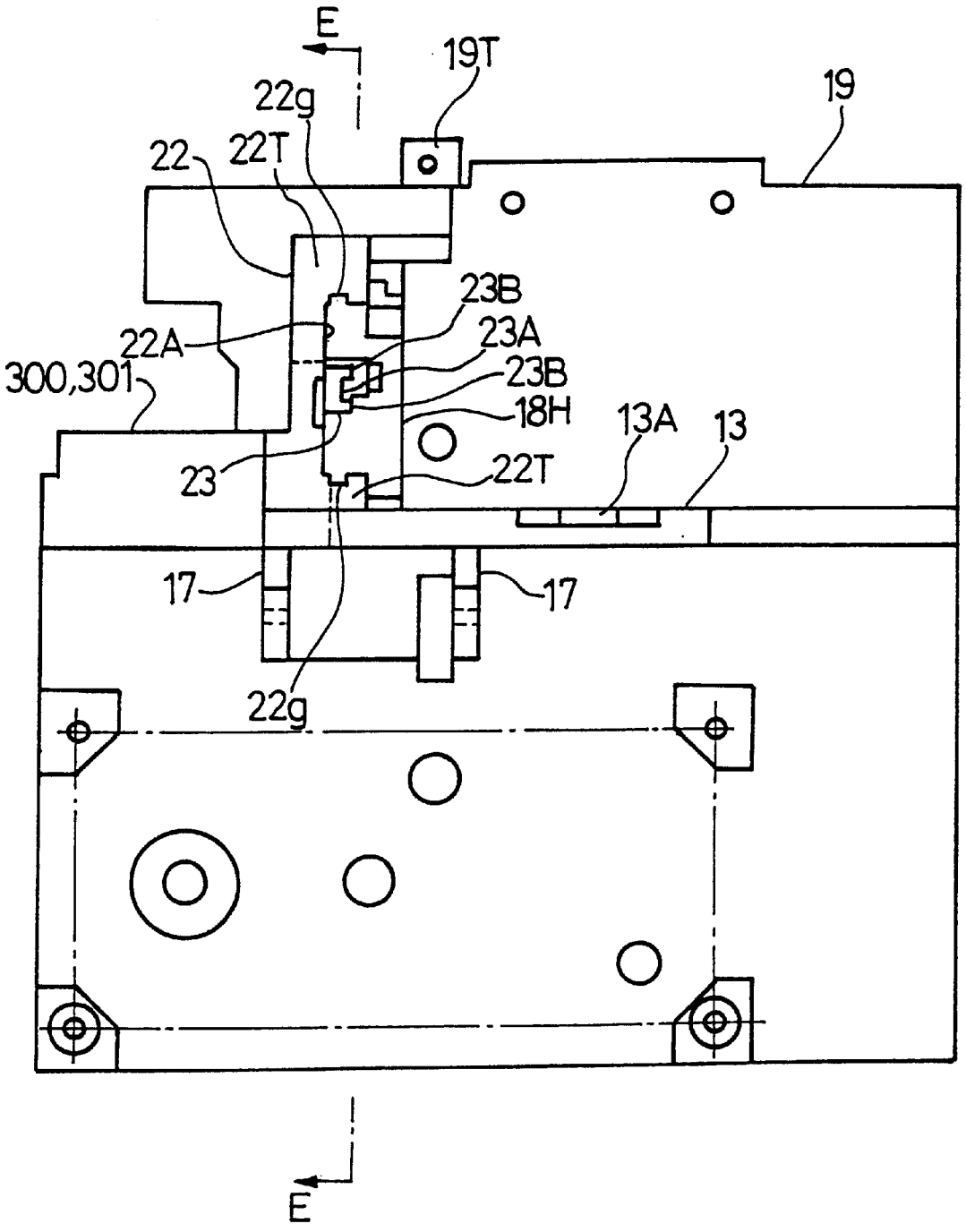
FIG. 8 is a right side view of the housing shown in FIG. 5.
Figure 9:
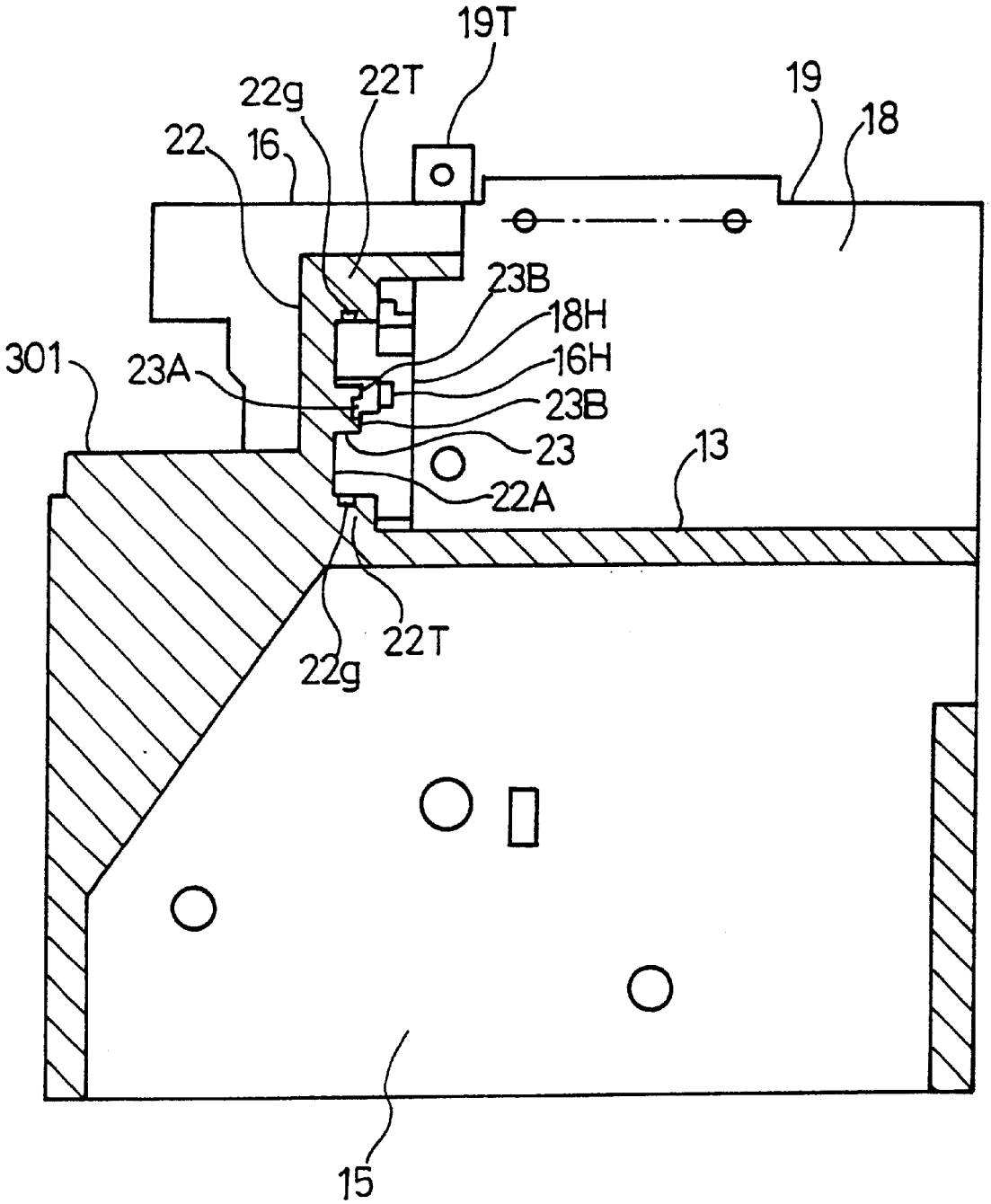
FIG. 9 is a sectional view of the housing taken substantially along line B—B of FIG. 5.

First, as shown in FIGS. 6, 15, and 16, the protrusion 207 of the bottom plate 206 of the cartridge 200 is inserted into the engagement groove 13A of the table 13 of the device main body 11, whereby the cartridge 200 is attached to the device main body 11. With the attachment of the cartridge 200, the rear surface (back surface) 131B of the slider plate 131 of the slider 130 is inserted into the recess 213 of the side wall 212 of the cartridge 200. The leading clip plate 213 within the conveyor path 211 of the cartridge 200 is located at a position indicated by a two-dot chain line in FIG. 25.

Before the drive motor 171 is driven, the drive cam 180 is at the initial position shown in FIG. 11, and the forming body 70 and slider 150 are at the home position shown in FIGS. 11, 20, 25, 26, 31, 32, 33, and 49.

And a sheet bundle T is placed on the sheet tables 310 and 320 of the housing 12.

In this state, if the drive motor 171 is driven, the drive cam 180 will be rotated in the counterclockwise direction in FIG. 11 through the speed reduction gear train (not shown), etc. With this rotation of the drive cam 180, the point end portion 31*b* of the arm portion 31A of the first link member 31 goes from the maximum-radius portion 183E of the cam groove 183 into the small-radius portion 183A, and consequently, the arm portion 31A of the first link member 31 is rotated in the counterclockwise direction in FIG. 20 (clockwise direction in FIG. 22). Along with the rotation of the arm portion 31A, the arm portion 36 of the second link member 32 is rotated in the same direction. The rotation of the arm portion 36 causes the slider 130 to move in the left direction (in FIGS. 2, 20, 25, and 26)

If the slider 130 is moved in the left direction, the inclined plate portion 154 of the feed pawl plate 150 will be guided to the inclined surfaces 23*b* of the protruding portions 23B and 23B of the front wall 22 of the housing 12, and the base plate portion 151 of the feed pawl plate 150 will abut on the protruding portions 23B and 23B (see FIG. 26). The left end of the feed pawl plate 150 is moved rearward (to the back surface side) against the urging force of the spring S1. With this, the point end portions 153*a* and 153*a* of the feed pawls 153 and 153 protrude from the back surface of the anvil plate 160, as shown by a broken line in FIG. 26.

And if the slider 130 is moved further in the left direction, the point end portions 153*a* and 153*a* of the feed pawls 153 and 153 will catch the leading clip plate 231 present within the conveyor path 211, and along with the movement of the slider 130, the clip plate 231 is fed out in the left direction (in FIGS. 16 and 25).

Figure 50:
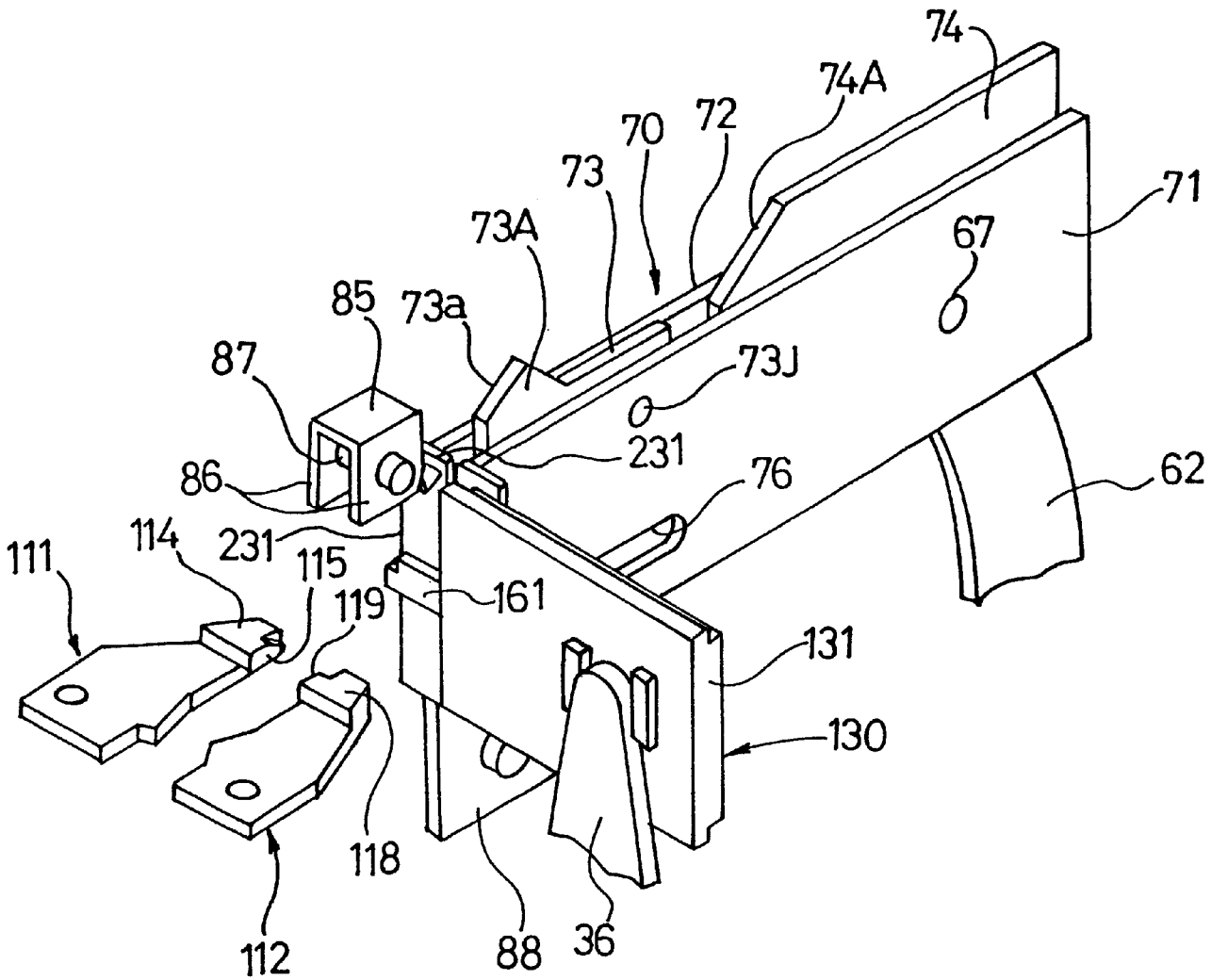
FIG. 50 is an explanatory diagram showing a state in which the clip plate has been fed into a position opposite to the forming body.

If the clip plate 231 is fed into a position directly opposite to the forming body 70 shown in FIG. 50 (one-dot chain line position in FIG. 25), the point and portion 161A of the anvil portion 161 will be inserted into the square hole 16H of the side wall 16 and also the point end portion 31*b* of the arm portion 31A of the first link member 31 will go from the small-radius portion 183A of the cam groove 183 into the minimum-radius portion 138B. While the point end portion 31*b* is moving along the minimum-radius portion 183B of the cam groove 183, the slider 130 remains stopped at the position directly opposite to the forming body 70 where the clip plate 231 has been fed, as shown in FIG. 50. Note that if the clip plate 231 is fed into the one-dot chain line position shown in FIG. 25, the back surface of the clip plate 231 will abut on the rear guide plate 88 and be held by the anvil portion 161 and the rear guide plate 88.

Figure 31:
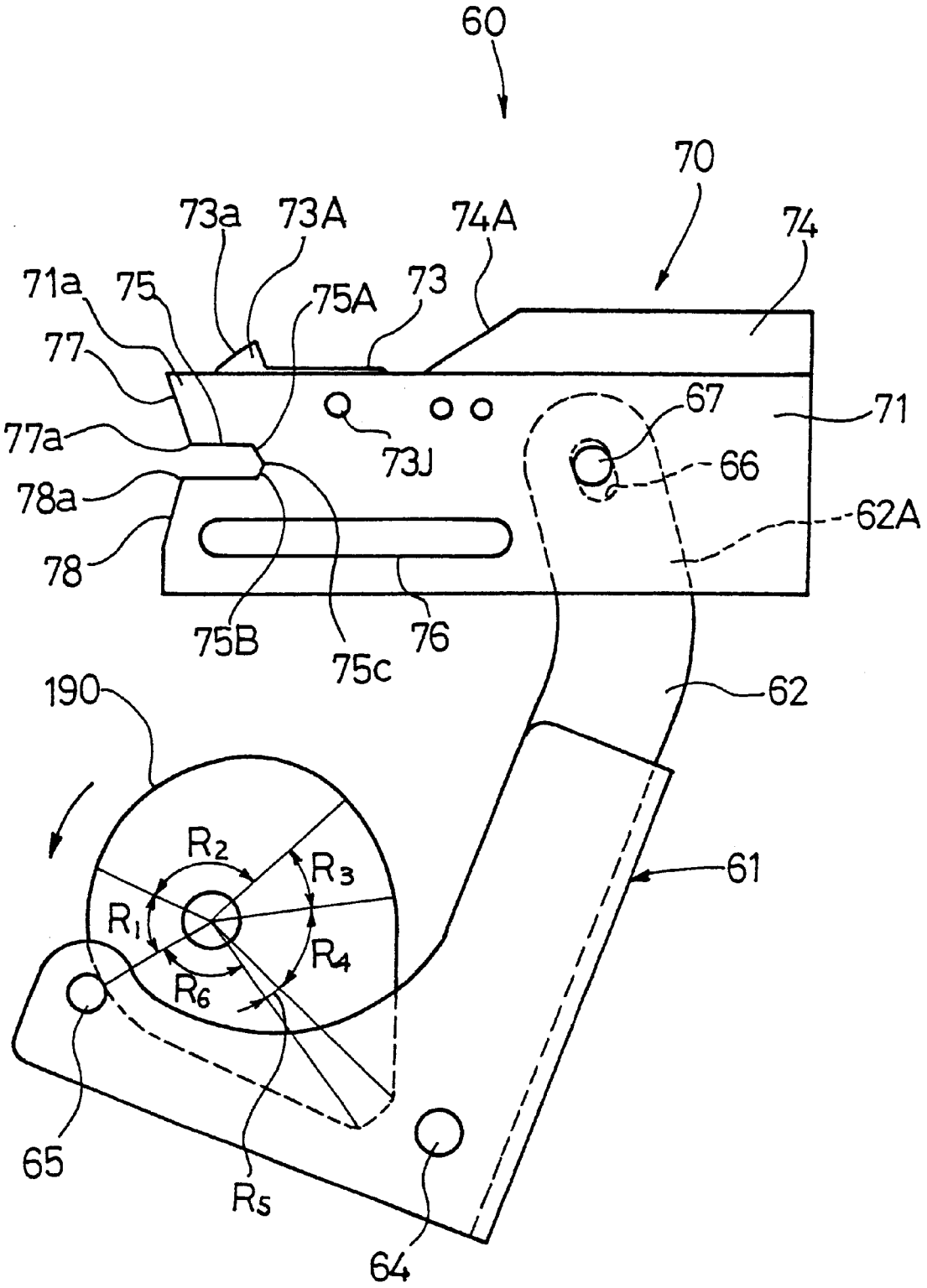
FIG. 31 is an explanatory diagram showing the relation between the drive cam, the cam body, and the forming body.
Figure 32:
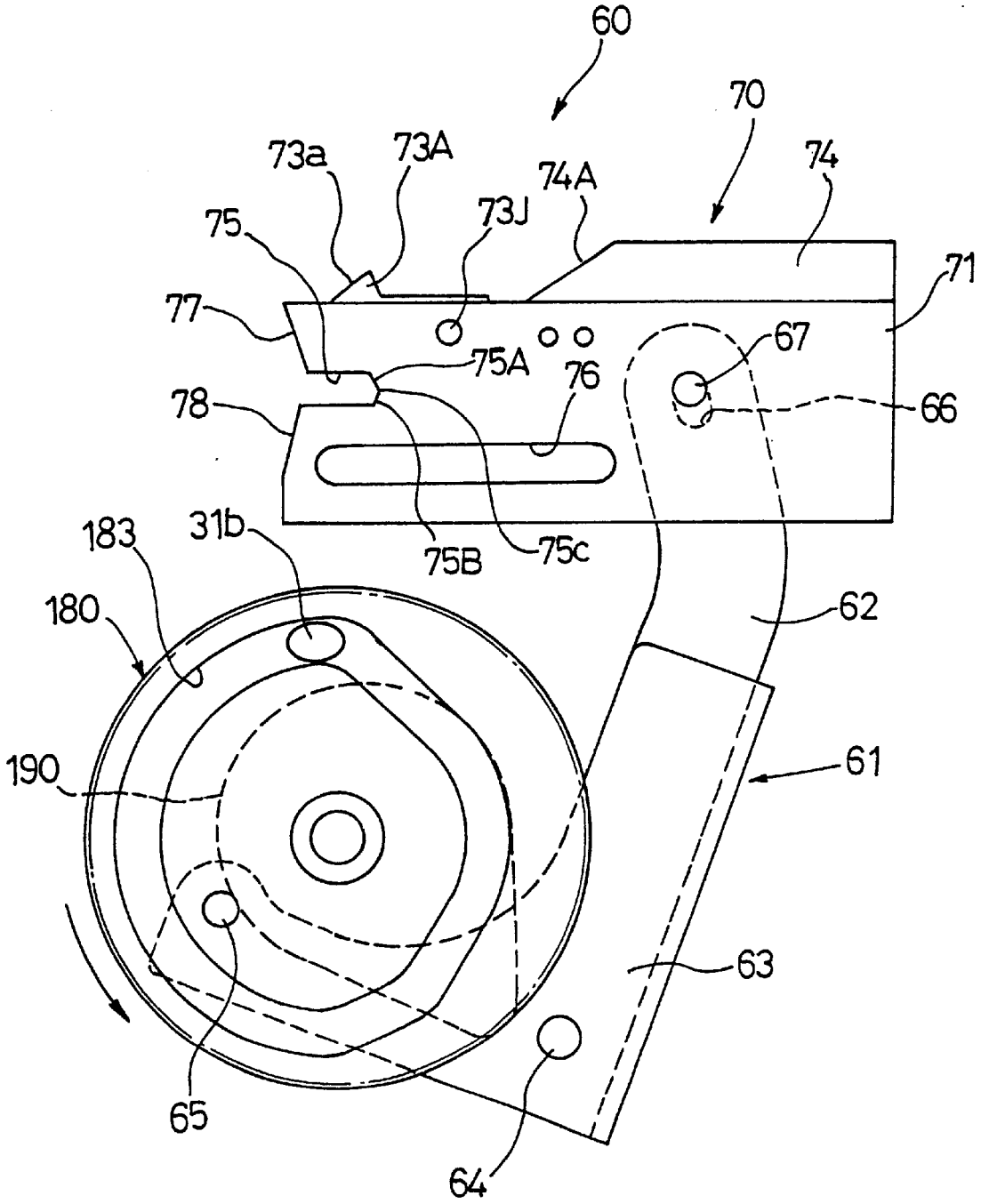
FIG. 32 is an explanatory diagram showing the relation between the drive cam, the cam groove, and the forming body.
Figure 33:
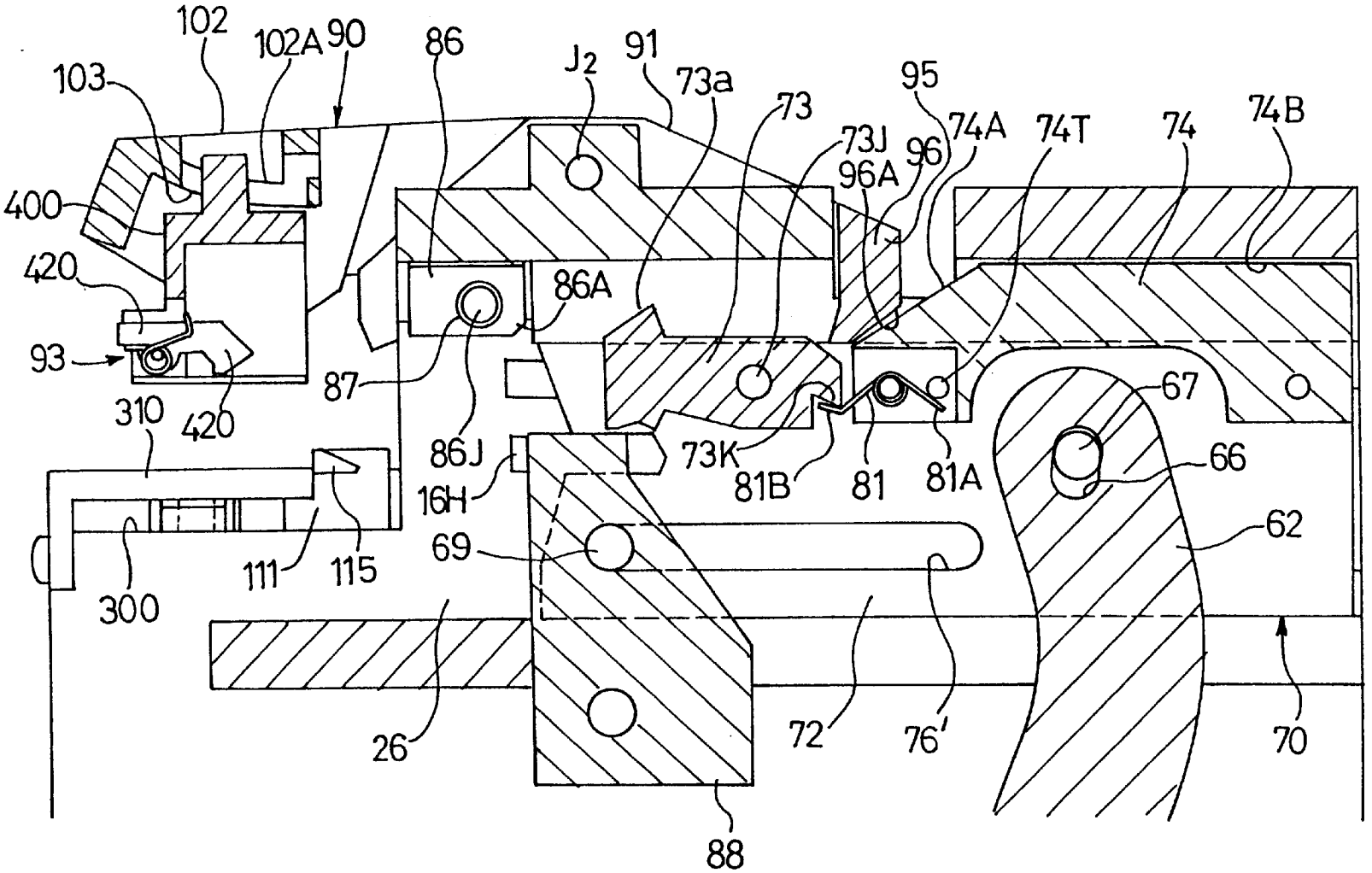
FIG. 33 is an explanatory diagram showing the home position of the forming body.
Figure 51:
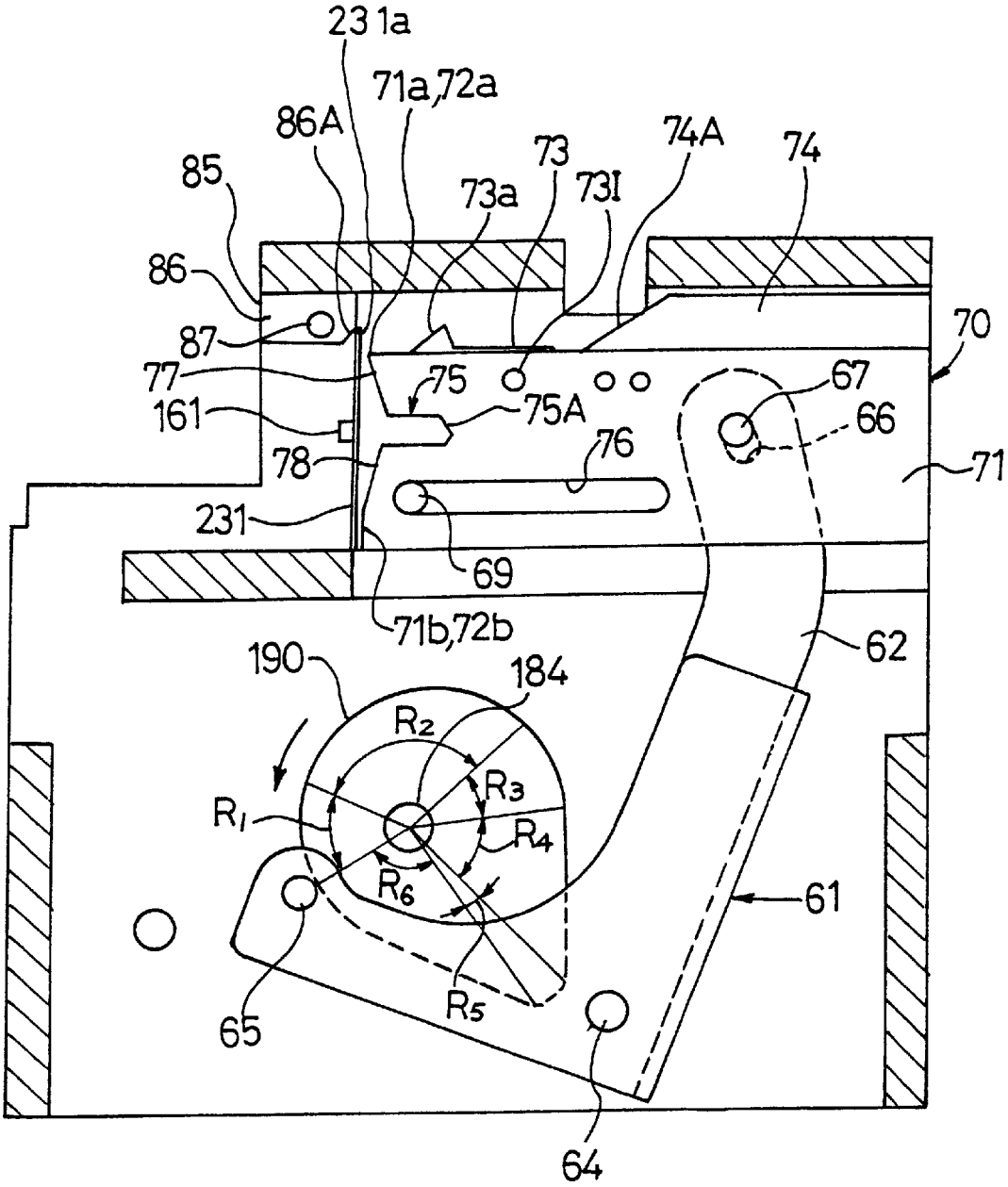
FIG. 51 is an explanatory diagram showing the positional relation between the forming body in a home position and the clip plate fed by the slider.

On the other hand, the cam body 190 of the drive cam 180 is rotated in the counterclockwise direction from the position shown in FIGS. 31 and 51, and the shaft 65 of the drive link 65 slides along the circumferential surface of the minimum-radius portion R1 of the cam body 190. When the shaft 65 is sliding along the circumferential surface of the minimum-radius portion R1, the drive link 61 remains stopped at the position shown in FIGS. 31 and 51. That is, while the clip plate 231 is being fed, the drive link 61 remains stopped.

Figure 52:
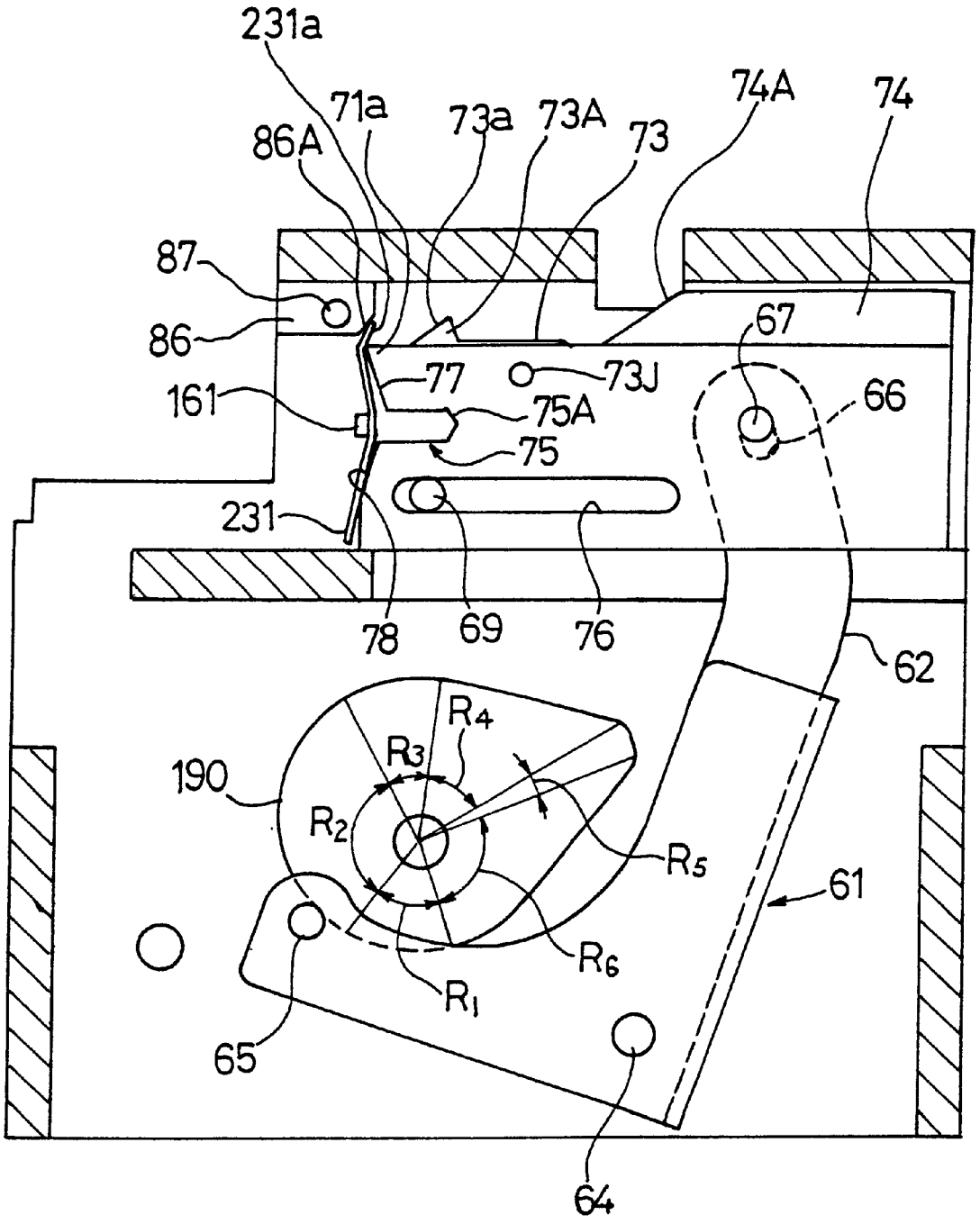
FIG. 52 is an explanatory diagram showing a state in which the clip plate has been slightly bent.

And if the point end portion 31*b* of the first link member 31 moves into the minimum-radius portion 183B of the cam groove 183 and if the clip plate 231 is fed into the position directly opposite to the forming body 70, as shown in FIG. 52, the shaft 65 of the drive link 61 will slide along the circumferential surface of the first increasing portion R2 of the cam body 190, and along with rotation of the drive cam 180, the drive link 61 will rotate in the counterclockwise direction with the shaft 64 as center.

If the drive link 61 rotates in the counterclockwise direction, the forming body 70 will move forward (left direction in FIG. 51) and the upper and lower end portions 71*a* and 72*a* of the forming plates 71 and 72 will push out the upper and lower portions of the clip plate 231 forward. Since the intermediate portion of the front surface of the clip plate 231 is pressed by the anvil portion 161 and since the upper portion 231*a* of the clip plate 231 abuts on the inclined surfaces 86A and 86A of the side plate portions 86 and 86 of the point-end bending guide member 85, the upper portion 231*a* is bent as shown in FIG. 52. At this time, the tapes 240A and 240B begin to be cut at a broken line H (see FIG. 19).

Since the upper portion 231*a* of the clip plate 231 is formed with the hole 232, the upper portion 231*a* is easily bent at the position of the hole 232.

Figure 53:
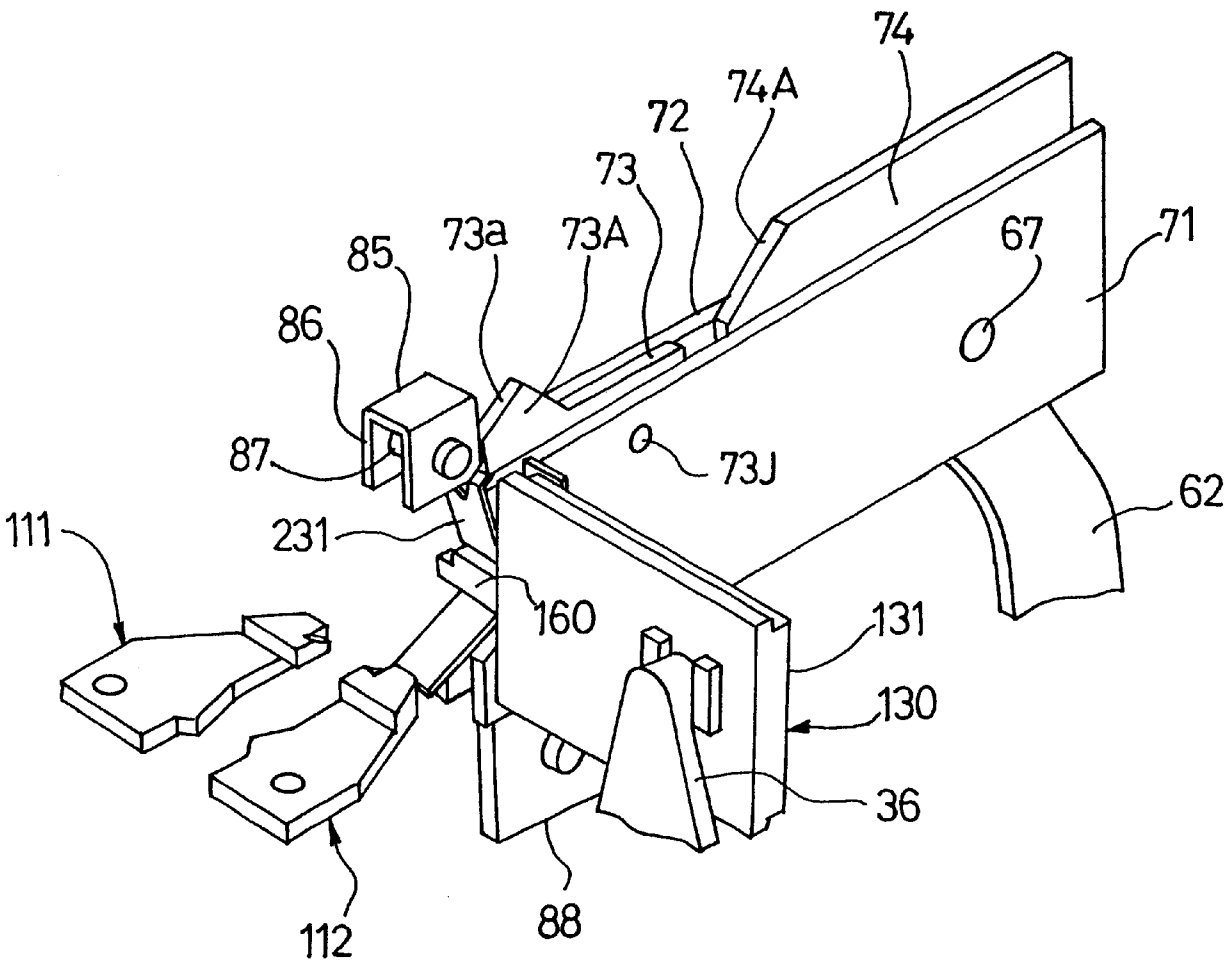
FIG. 53 is a perspective view showing a state in which the clip plate has been slightly bent.
Figure 54:
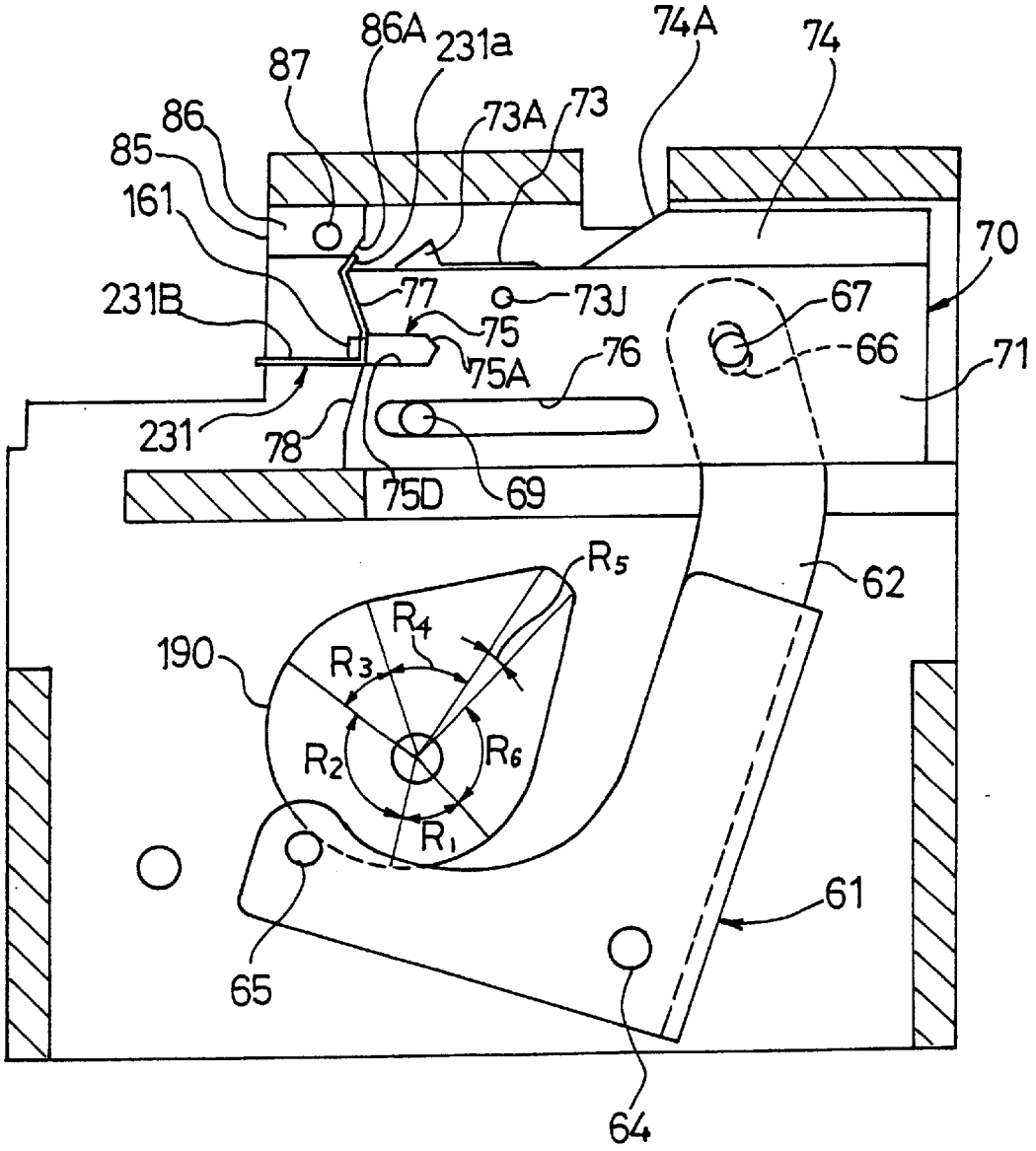
FIG. 54 is an explanatory diagram showing a state in which the clip plate shown in FIG. 52 has been further bent.
Figure 55A:
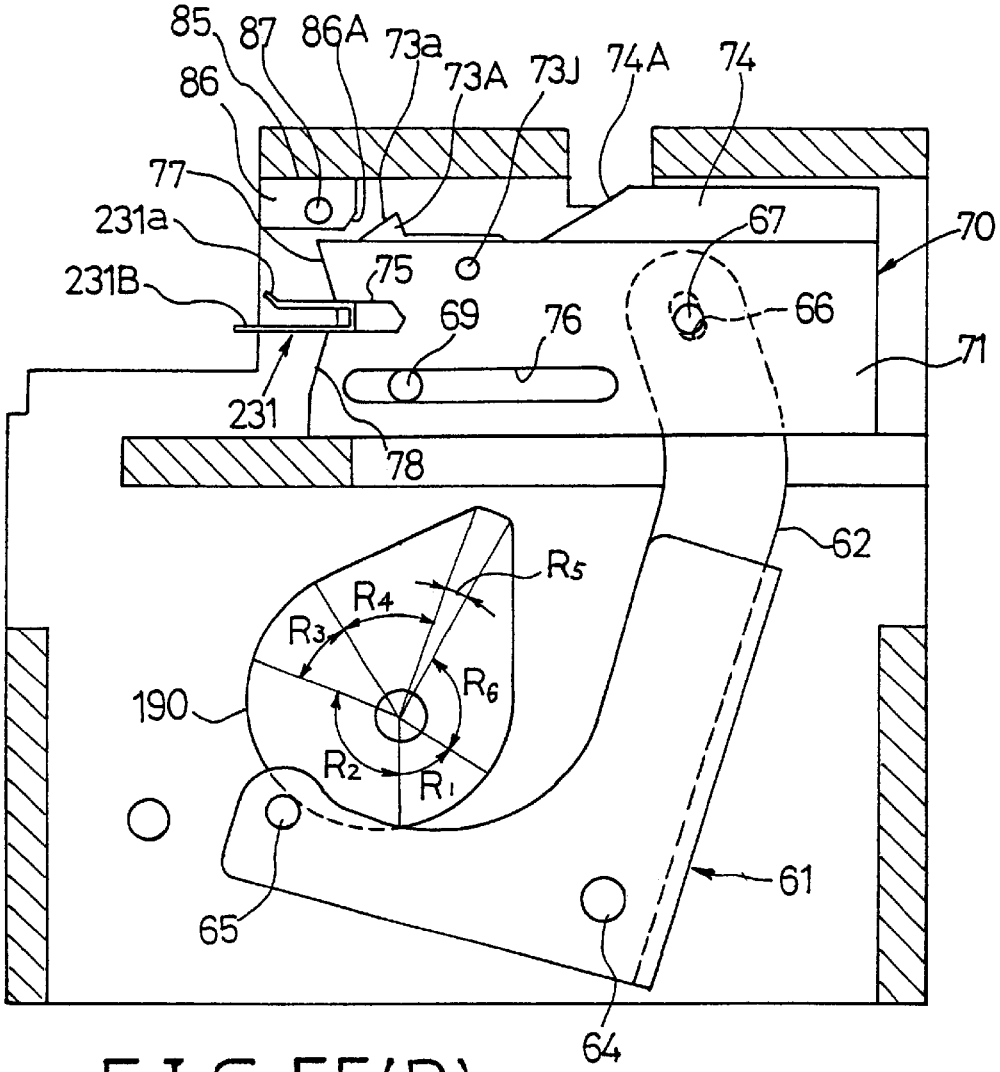
FIG. 55 is an explanatory diagram showing a state in which the clip plate has been bent into a U-letter shape.

And if the shaft 65 of the drive link 61 slides further along the circumferential surface of the first increasing portion R2 of the cam body 190, the drive link 61 will rotate further in the counterclockwise direction and the forming body 70 will move further forward. As shown in FIGS. 53 and 54, the lower portion 231B of the clip plate 231 is horizontally bent by the bottom surface 75D of the cutout 75 of the forming plates 71 and 72 and the anvil portion 161. Furthermore, if the drive link 61 rotates in the counterclockwise direction and therefore the forming body 70 moves forward, as shown in FIGS. 55 and 56, the clip plate 231 will be bent into a U-letter shape by the cutout 75 of the forming plates 71 and 72 and the anvil portion 161, because the back surface of the clip plate 231 has abutted on the rear guide plate 88.

Figure 55B:
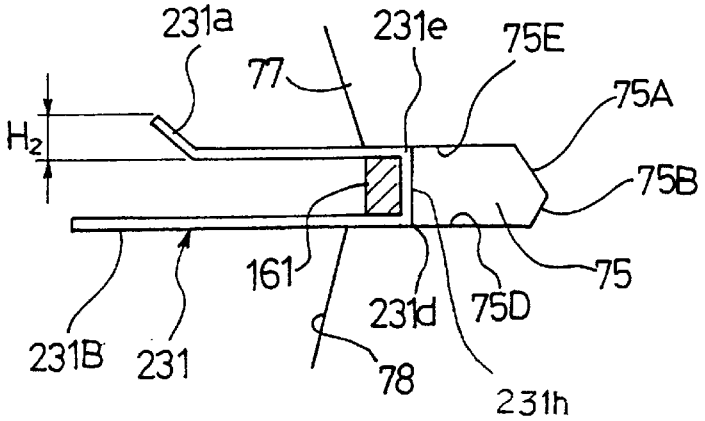
Figure 56:
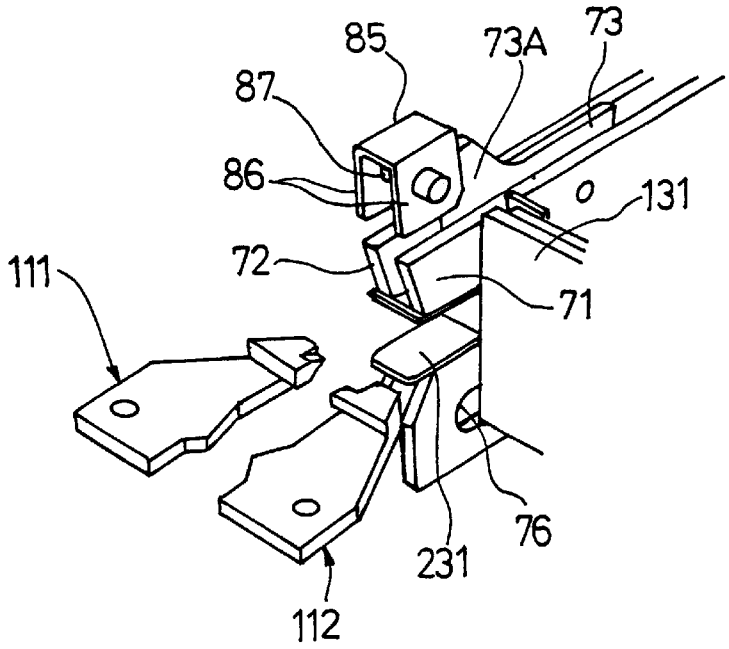
FIG. 56 is a perspective view showing a state in which the clip plate shown has been bent into a U-letter shape.

Since the cross section of the anvil portion 161 is rectangular in shape, also the bottom surface 75D and upper surface 75E of the cutout 75 of the forming plates 71 and 72 are horizontal, and furthermore the back surface of the clip plate 231 has abutted on the rear guide plate 88, the clip plate 231 is reliably bent into a U-letter shape as shown in FIG. 55(B). With this bending, corner portions 231*d* and 231*e* are formed on the clip plate 231, and the clip plate 231 is creased.

Figure 57:
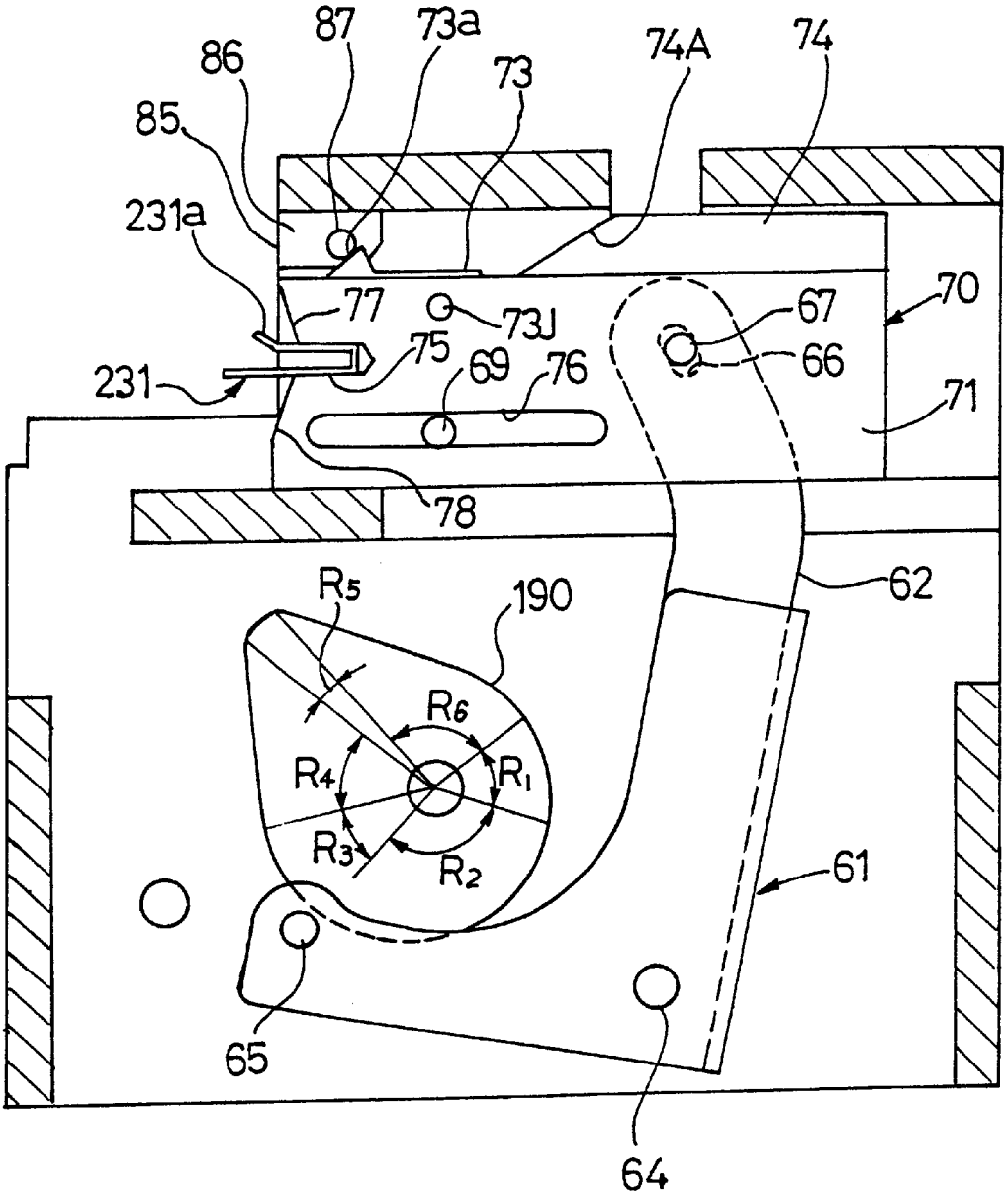
FIG. 57 is an explanatory diagram showing a state in which the clip plate bent into a U-letter shape has been fed forward.

In this state, if the shaft 65 of the drive link 61 slides further along the circumferential surface of the first increasing portion R2 of the cam body 190, the drive link 61 will rotate further in the counterclockwise direction and the forming body 70 will move further forward The clip plate 231, bent into a U-letter shape by the forming plates 71 and 72, is fed out into a position shown in FIG. 57. And the inclined surface 73*a* of the pressure plate 73 of the forming body 70 abuts on the roller 87 of the point-end bending guide member 85.

Figure 61:
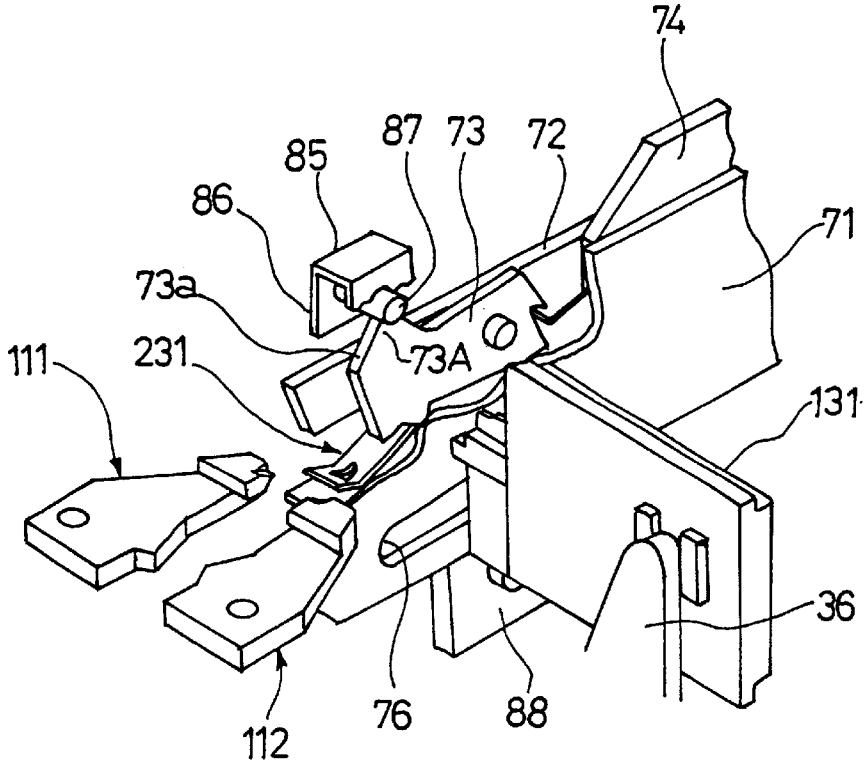
FIG. 61 is a perspective view showing a state in which the clip plate is crushed by the pressure plate.

On the other hand, when the cam body 190 rotates from the position shown in FIG. 55 to the position shown in FIG. 57, the point end portion 31*b* of the arm portion 31A of the first link member 31 goes into the first large-radius portion 183C of the cam groove 183, and the slider 130 moves into the original home position. If the shaft 65 of the drive link 61 slides along the circumferential surface of the large-radius portion R3 of the cam body 190, the forming body 70 will advance little by little. As shown in FIG. 61, since the inclined surface 73*a* of the pressure plate 73 has abutted on the roller 87, the pressure plate 73 rotates in the counterclockwise direction along with the advancement of the forming body 70. With this rotation, the pressure plate 73 crushes little by little the rear portion 231*h* of the clip plate 231 bent into a U-letter shape.

During this period, the point end portion 31*b* of the arm portion 31A of the first link member 31 goes into the maximum-radius portion 183E past the second large-radius portion 183D of the cam groove 183, and the slider 130 returns to the home position.

That is, when the slider 130 returns to the home position, the advancement of the forming body 70 is slight, so the forming body 70 is prevented from pressing down the anvil 161, and the slider 130 can reliably return to the home position.

Figure 60:
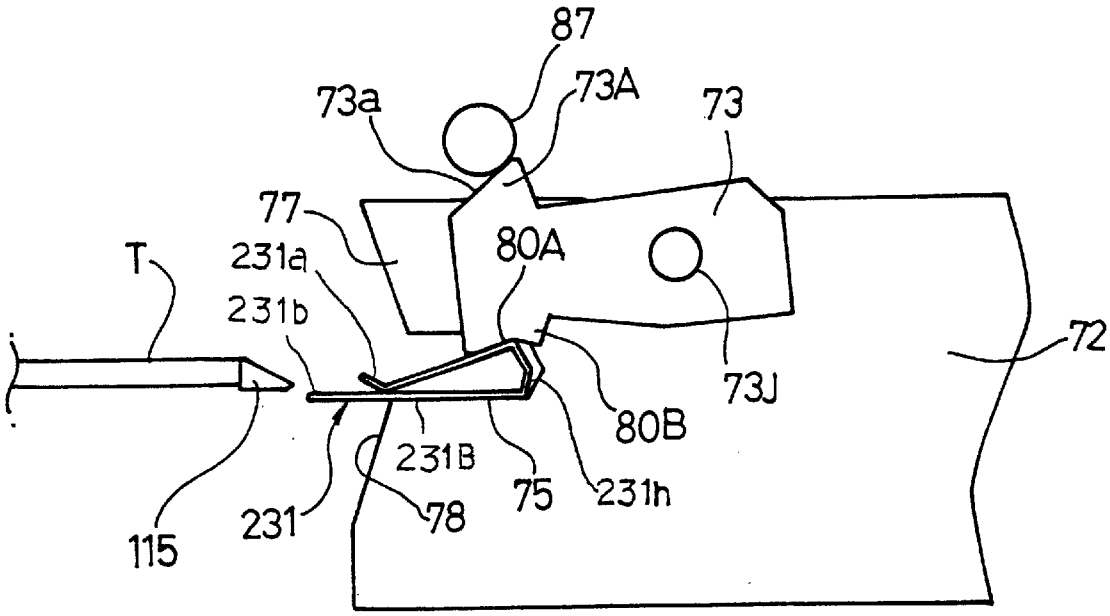
FIG. 60 is an explanatory diagram showing a state in which the clip plate is crushed by the pressure plate.
Figure 59:
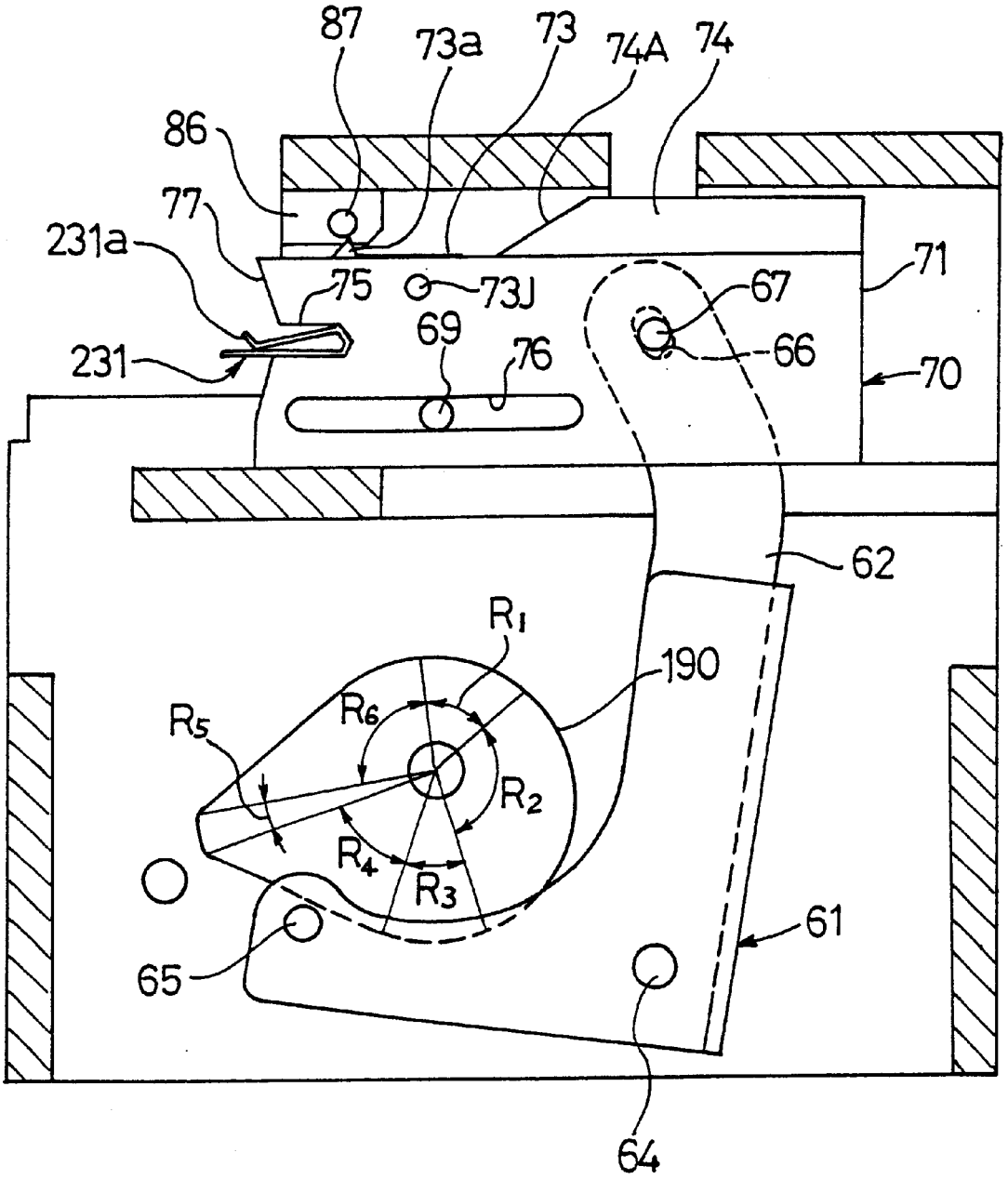
FIG. 59 is an explanatory diagram showing a state in which the clip plate bent into a U-letter shape has been fed slightly forward from a position shown in FIG. 57.

Incidentally, if the shaft 65 of the drive link 61 slides along the circumferential surface of the large-radius portion R3 of the cam body 190, the drive link 61 will rotate in the counterclockwise direction from the position shown in FIG. 57 to the position shown in FIG. 59, and the forming body 70 will move further forward. If this forming body 70 moves forward from the position shown in FIG. 57, the pressure plate 73, along with the advancement of the forming body 70, will rotate in the counterclockwise direction with the shaft 73J as center, as shown in FIGS. 60 and 61, because the inclined surface 73*a* of the pressure plate 73 has abutted on the roller 87 of the point-end bending guide member 85. Also, the pressure portion 80 of the pressure plate 73 moves downward, while moving forward.

For this reason, the inclined surface 80A and protruding portion 80B of the pressure portion 80 crush the rear portion 231*h* of the clip 231, while pushing out the rear portion 231*h* forward. As a result, the point end portion 231*b* of the lower end 231B of the clip plate 231 does not float off the bottom surface 75D. The rear portion 231*h* of the clip plate 231*a* is crushed and bent into a dogleg shape (inverted dogleg shape in FIG. 60). And the clip plate 231 is folded in two with the point end portion 231*a* and the lower portion 231B closed together and also with the rear portion bulged.

Figure 62:
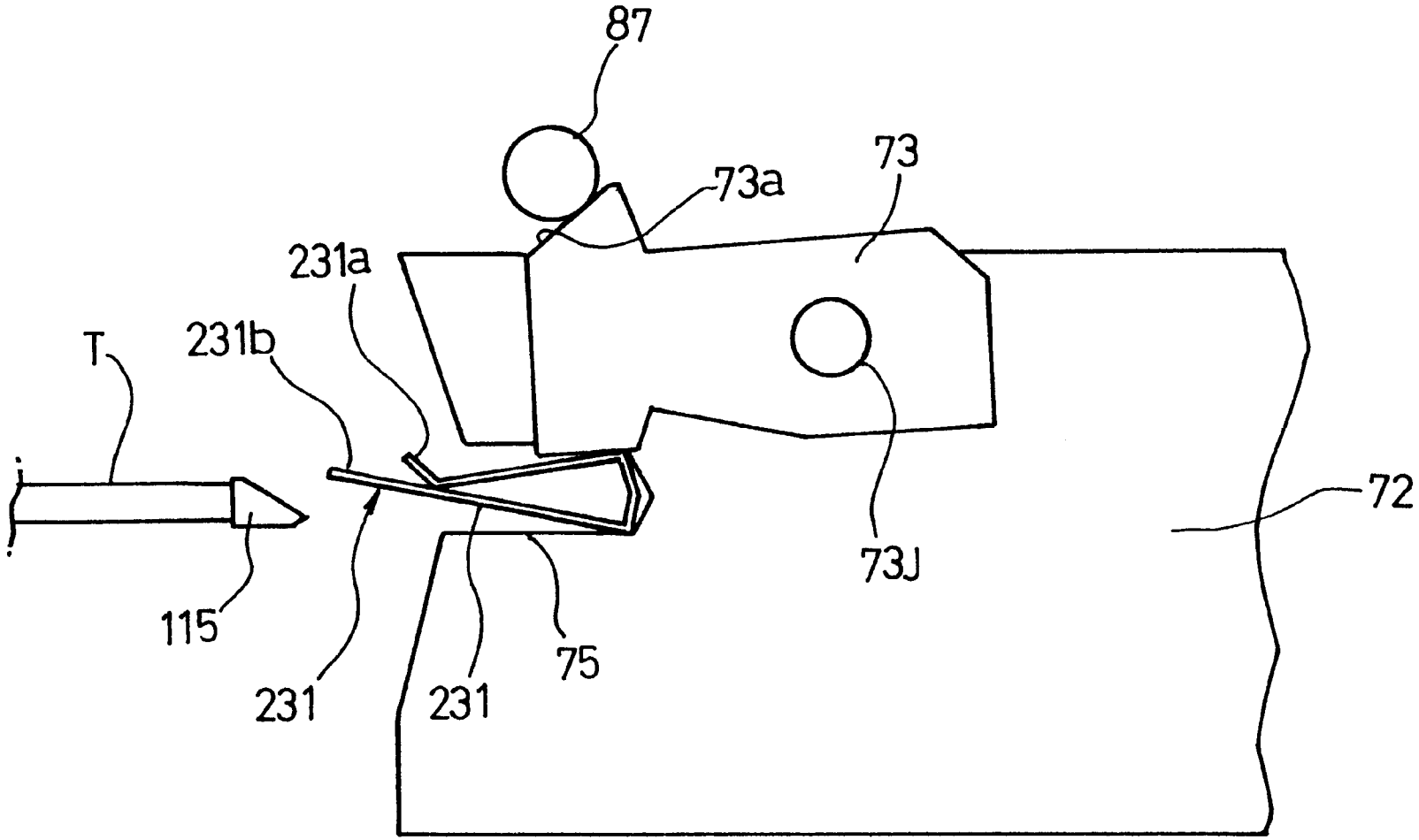
FIG. 62 is an explanatory diagram showing a state in which the point end portion of the clip plate floats.

Incidentally, if the bottom surface of the pressure portion 80 of the pressure plate 73 is flat, the point end portion 231*b* of the clip plate 231 will float as shown in FIG. 62.

Figure 63:
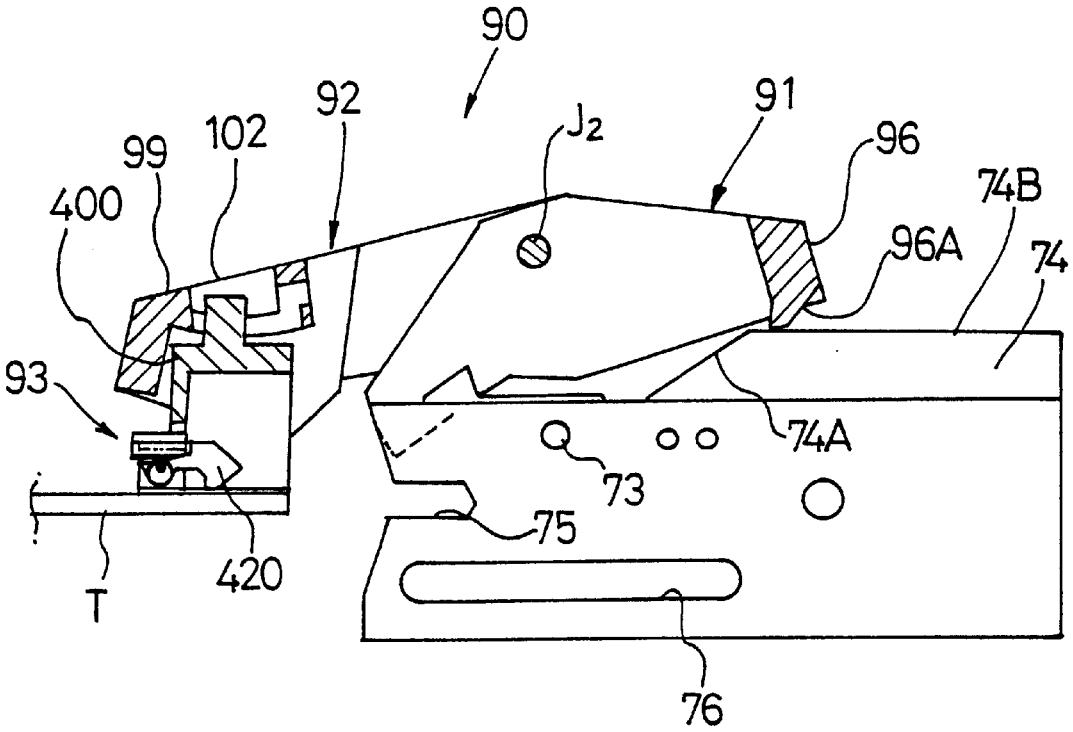
FIG. 63 is a sectional view showing a state in which a sheet bundle is pressed by the press member of a press mechanism.
Figure 64:
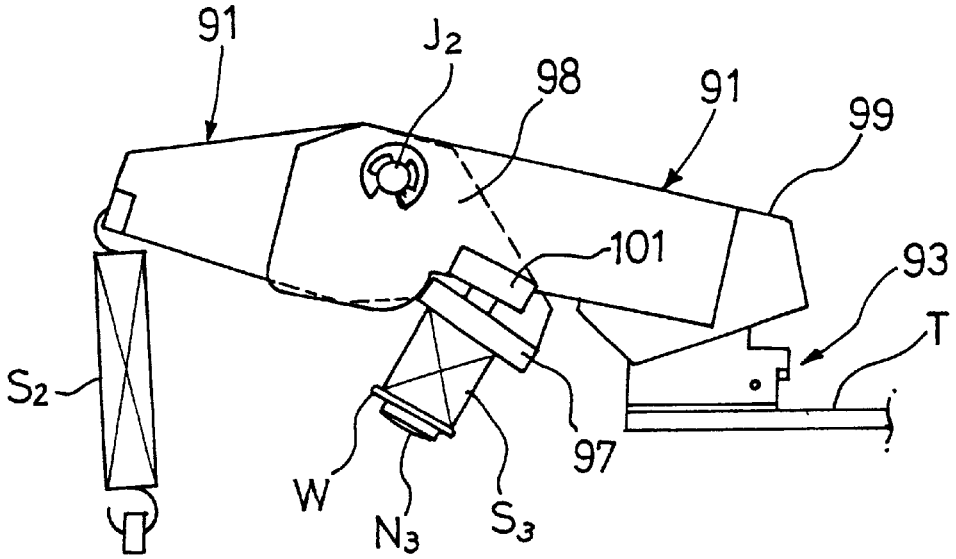
FIG. 64 is an explanatory diagram showing a state in which the sheet bundle is pressed by the press member of the press mechanism.

On the other hand, if the shaft 65 of the drive link 61 slides along the circumferential surface of the first increasing portion R2 of the cam body 190, as shown in FIG. 41, the inclined surface 96A of the stopper piece 96 of the first press link 91 will abut on the inclined surface 74A of the link plate 74 of the forming body 70, and along with the first press link 91 the second press link 92 will rotate in He counterclockwise direction (in FIG. 45) with the shaft J2 as center. And as shown in FIG. 57, if the shaft 65 of the drive link 61 slides along the circumferential surface of the large-radius portion R3 of the cam body 190, the inclined surface 96A of the stopper piece 96 of the first press link 91 will ride on the upper surface 74B of the link plate 74, as shown in FIGS. 63 and 64. Also, along with the first press link 91 the second press link 92 rotates further in the counterclockwise direction, and the press member 93 is placed onto a sheet bundle T. This press member 93 presses the sheet bundle T.

Since the press member 93 is hung on the hold portion 99 of the second press link 92 and is freely movable along the slit 103 formed in the hold portion 99, the entire bottom surface of the press member 93 will abut onto the sheet bundle T regardless of the thickness of the sheet bundle T.

Also, because the first press link 91 can rotate relatively against the second press link 92, the forning body 70 can advance independent of the thickness of the sheet bundle T and there is no obstacle in rotation of the drive cam 180. In other words, before the inclined surface 96A of the stopper piece 96 of the first press link 91 rides on the upper surface 74B of the link plate 74 of the forming body 70, even if the press member 93 were placed on the sheet bundle T and also rotation of the second press link 92 were stopped, the first press link 91 will rotate relatively against the second press link 92 and therefore the forming body 70 can advance. For this reason, there is no obstacle in rotation of the drive cam 180.

Figure 65:
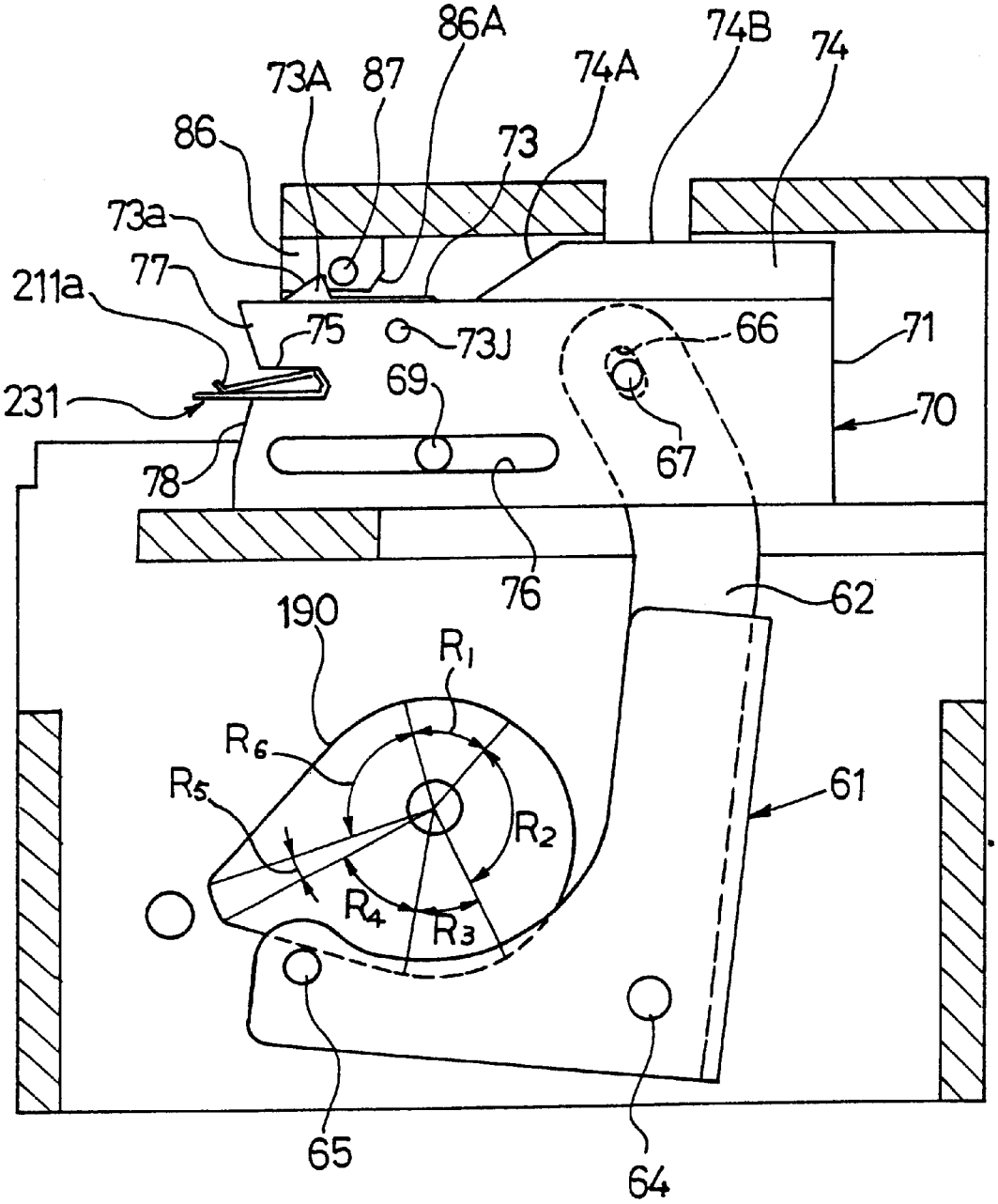
FIG. 65 is an explanatory diagram showing a state in which the clip plate has been fed into a position at which the crushing of the clip plate by the pressure plate is released.
Figure 66A:
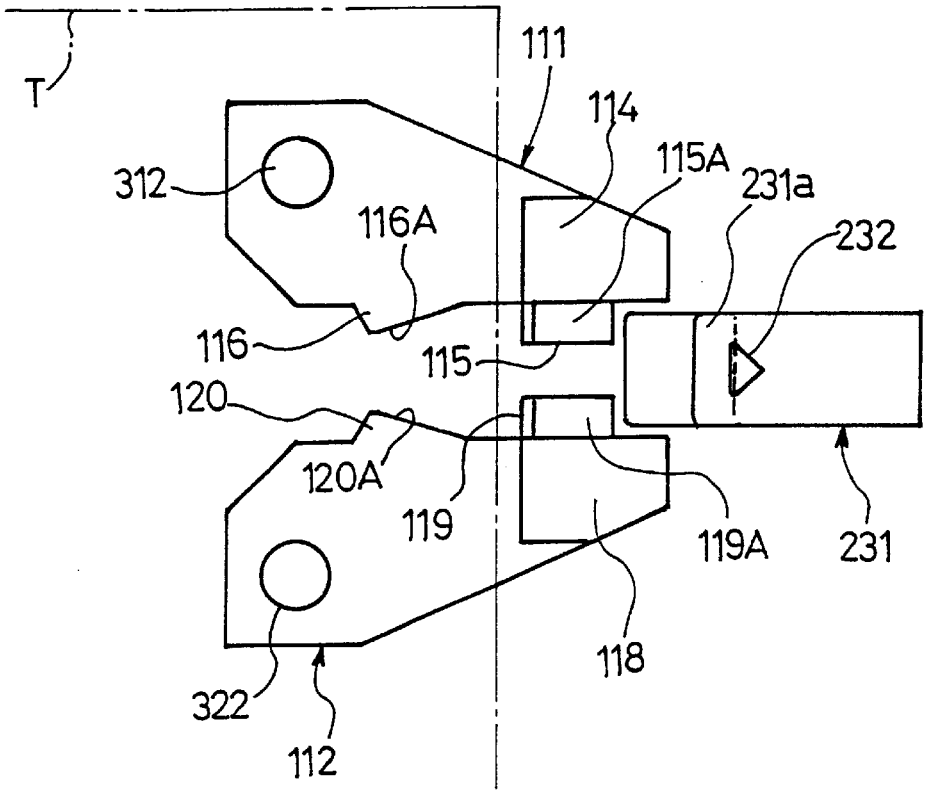
FIG. 66(A) is a plan view showing the positional relation between the clip plate and the guide member shown in FIG. 65.
Figure 66B:
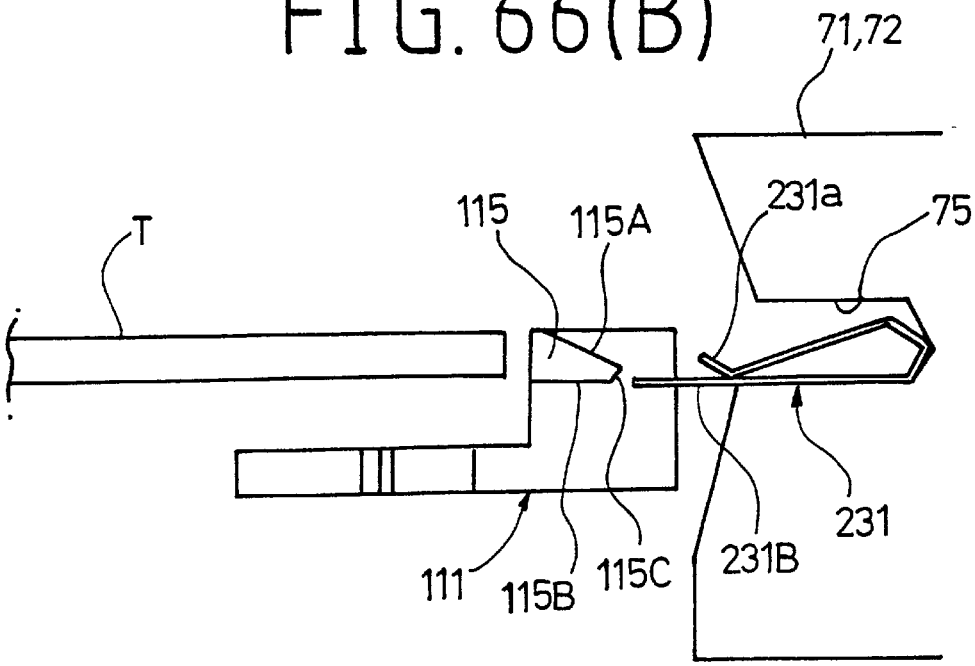
FIG. 66(B) is a side view showing the positional relation between the clip plate and the guide member shown in FIG. 66.

If the shaft 65 of the drive link 61 slides further along the circumferential surface of the large-radius portion R3 of the cam body 190, as shown in FIG. 65, the roller 87 of the point-end bending guide member 85 will be disengaged from the inclined surface 73*a* of the pressure plate 73, also the crushing of the clip plate 321 by the pressure portion 80 of the pressure plate 73 will be released, and furthermore, the clip plate 321 folded in two by the forming body 70 will be fed into a position shown in FIG. 66.

Figure 67:
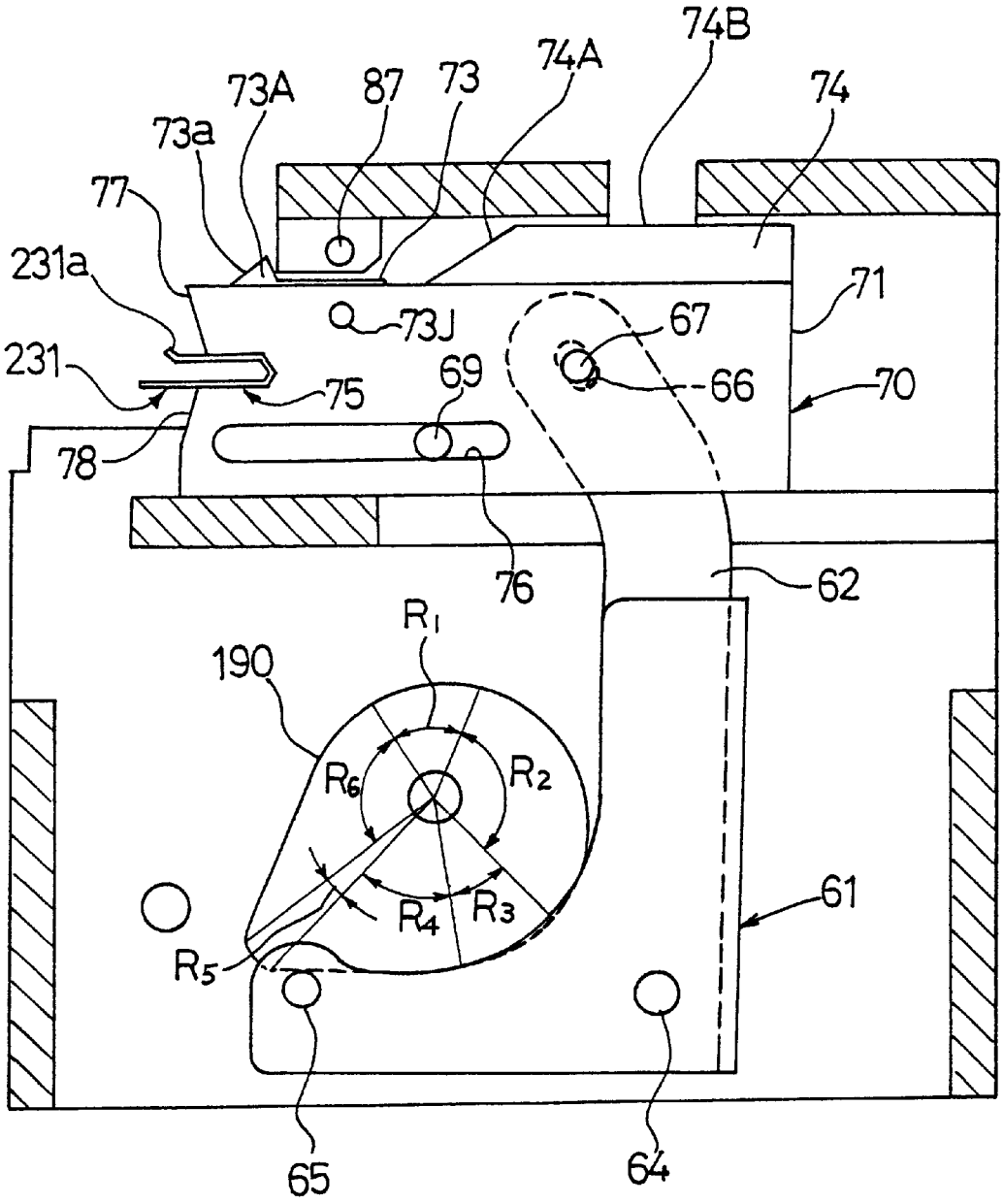
FIG. 67 is an explanatory diagram showing a state in which the lip plate has been fed further forward from a position shown in FIG. 66.
Figure 68:
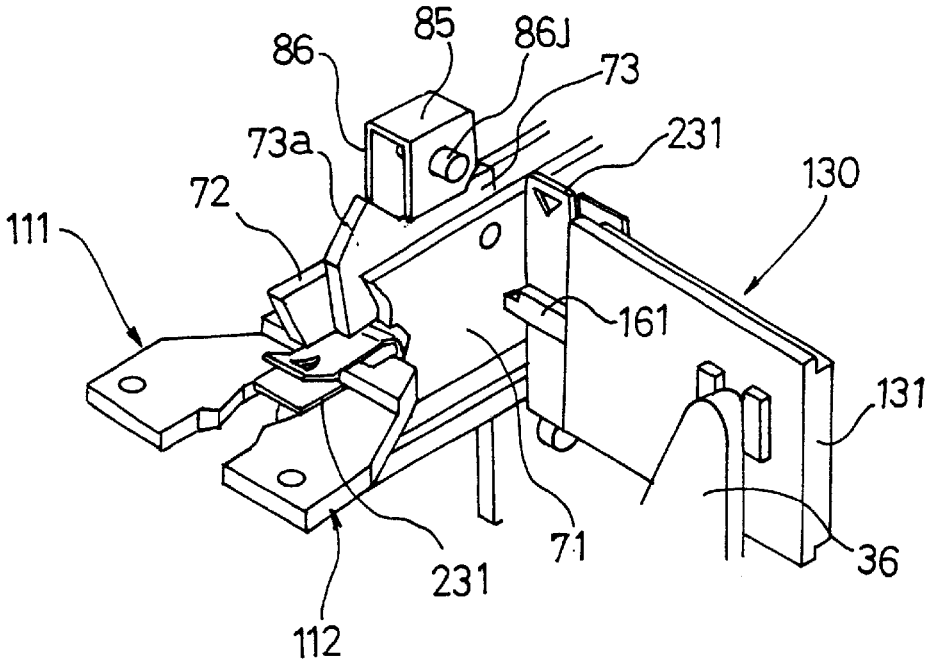
FIG. 68 is a perspective view showing a state in which guide protrusions have been moved into between the upper portion and lower portion of the clip plate.

And as shown in FIG. 67, if the shaft 65 of the drive link 61 slides along the circumferential surface of the second increasing portion R4 of the cam body 190, along with the forming body 70 the clip plate 321 will be fed out further forward and the point end portion 231*b* of the lower portion 231B of the clip plate 231 will be guided to the inclined surfaces 115C and 119C of the guide protrusions 115 and 119 of the widening members 111 and 112 and moved under the lower sides (bottom surfaces 115B and 119B) of the guide protrusions 115 and 119. On the other hand, the upper end portion 231*a* of the clip plate 231 is guided to the inclined surfaces 115A and 119A of the guide protrusions 115 and 119, and the upper portion 231A of the clip plate 231 is moved along the upper surfaces of the guide protrusions 115 and 119. Therefore, as shown in FIGS. 68 and 69, the guide protrusions 115 and 119 are moved into the space between the upper portion 231A and lower portion 231B of the clip plate 231.

Figure 69A:
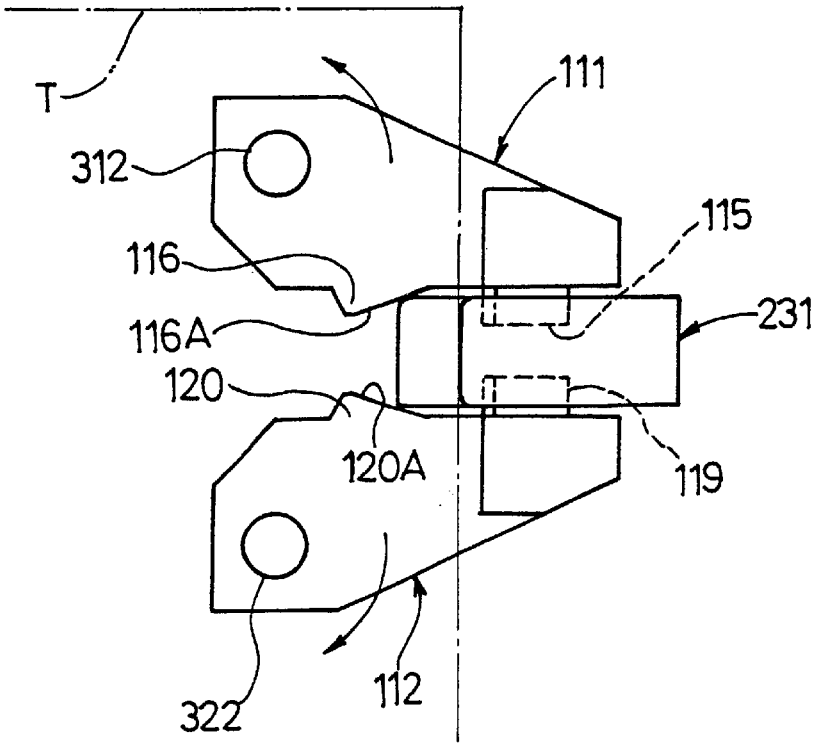
FIG. 69(A) is a plan view showing a state in which the guide protrusions have been moved into between the upper portion and lower portion of the clip plate.
Figure 69B:
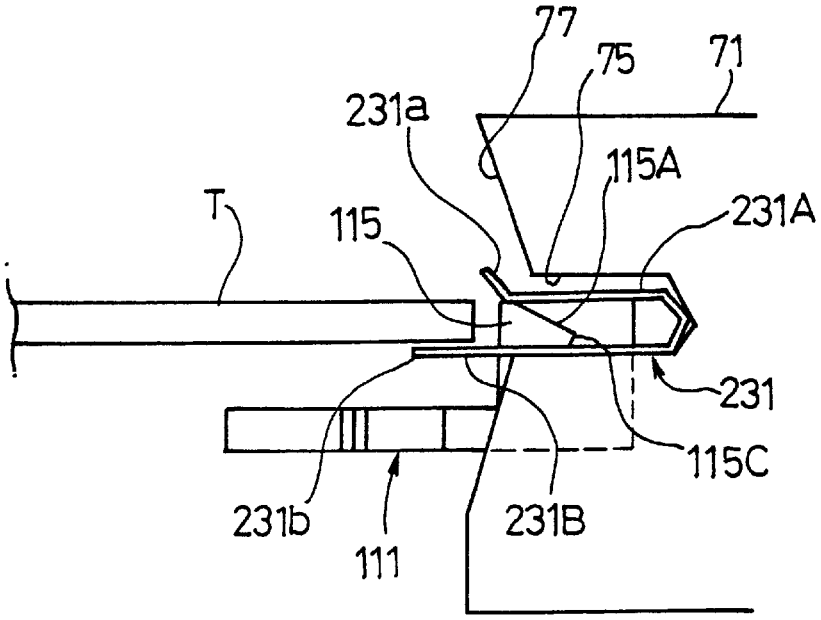
FIG. 69(B) is a side view showing a state in which the guide protrusions have been moved into between the upper portion and lower portion of the clip plate.

For this reason, as shown in FIG. 69(B), the point end portion 231*a* of the upper portion 231A of the clip plate 231 and the point end portion 231*b* of the lower portion 231B are opened (or widened).

Figure 70:
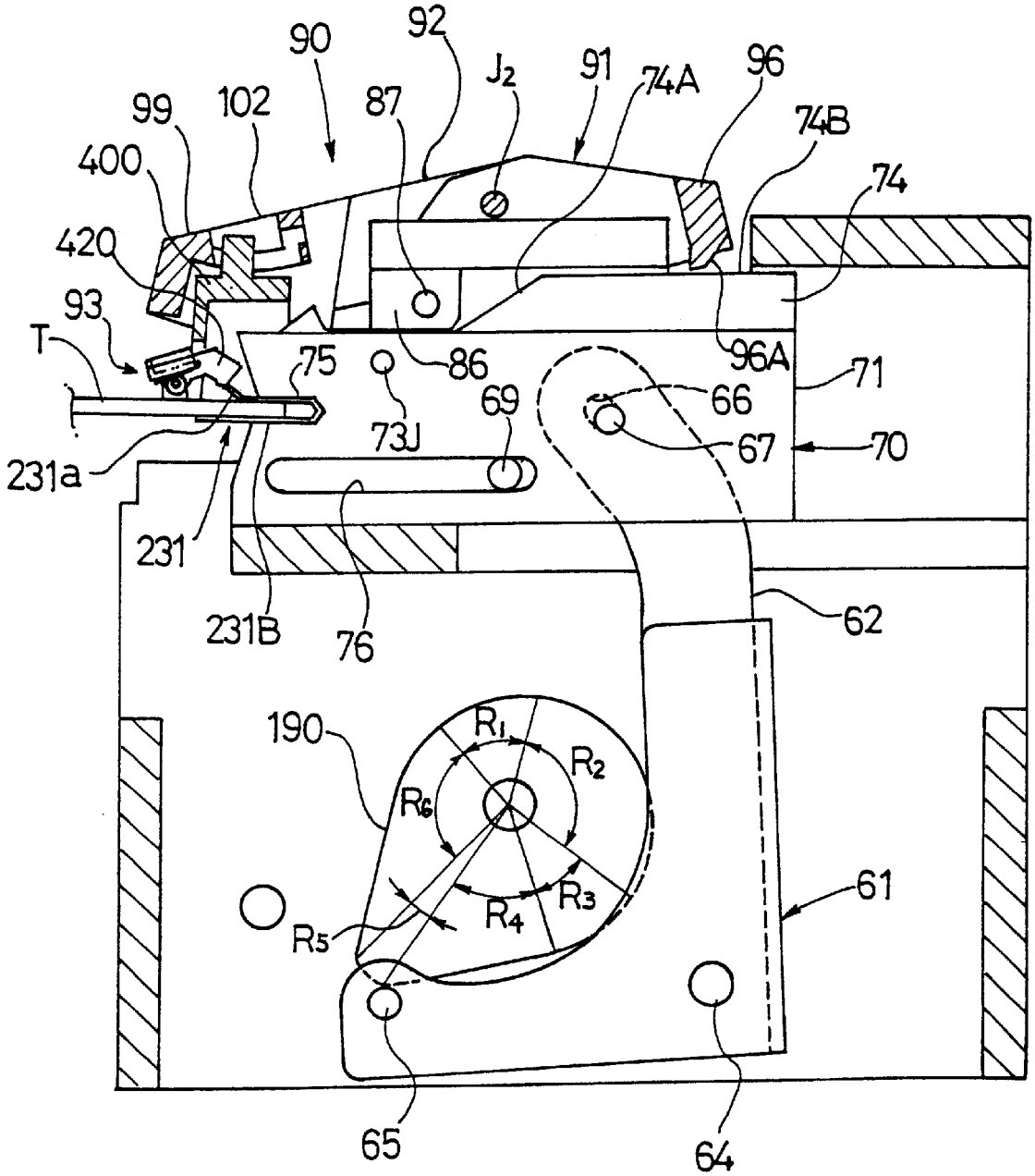
FIG. 70 is an explanatory diagram showing a state in which a hook member has been rotated.

As shown in FIG. 70, until the shaft 65 of the drive link 61 reaches the circumferential surface of the maximum-radius portion R5 of the cam body 190, the clip plate 231 with the opened point end portions 231*a* and 231*b* is fed out further forward along with the forming body 70, and the sheet bundle T is inserted into between the upper portion 231A and lower portion 231B of the clip plate 231.

Figure 72:
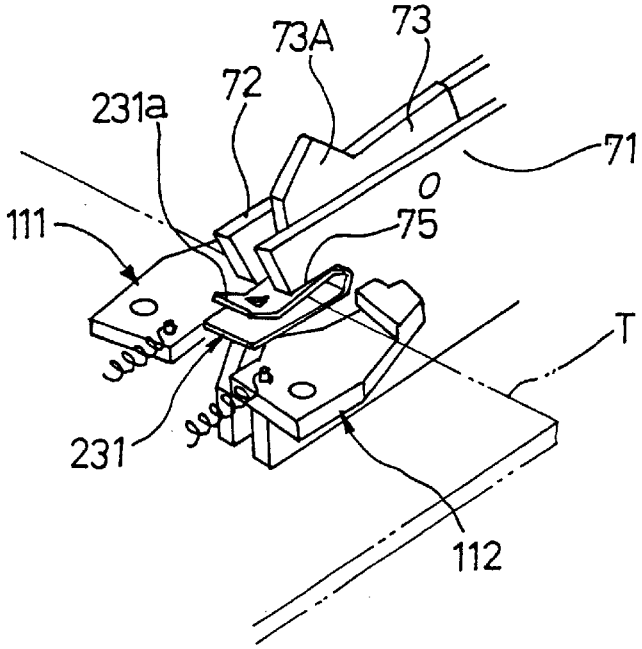
FIG. 72 is a perspective view showing a state in which the guide members have been opened by the forming plates.
Figure 71:
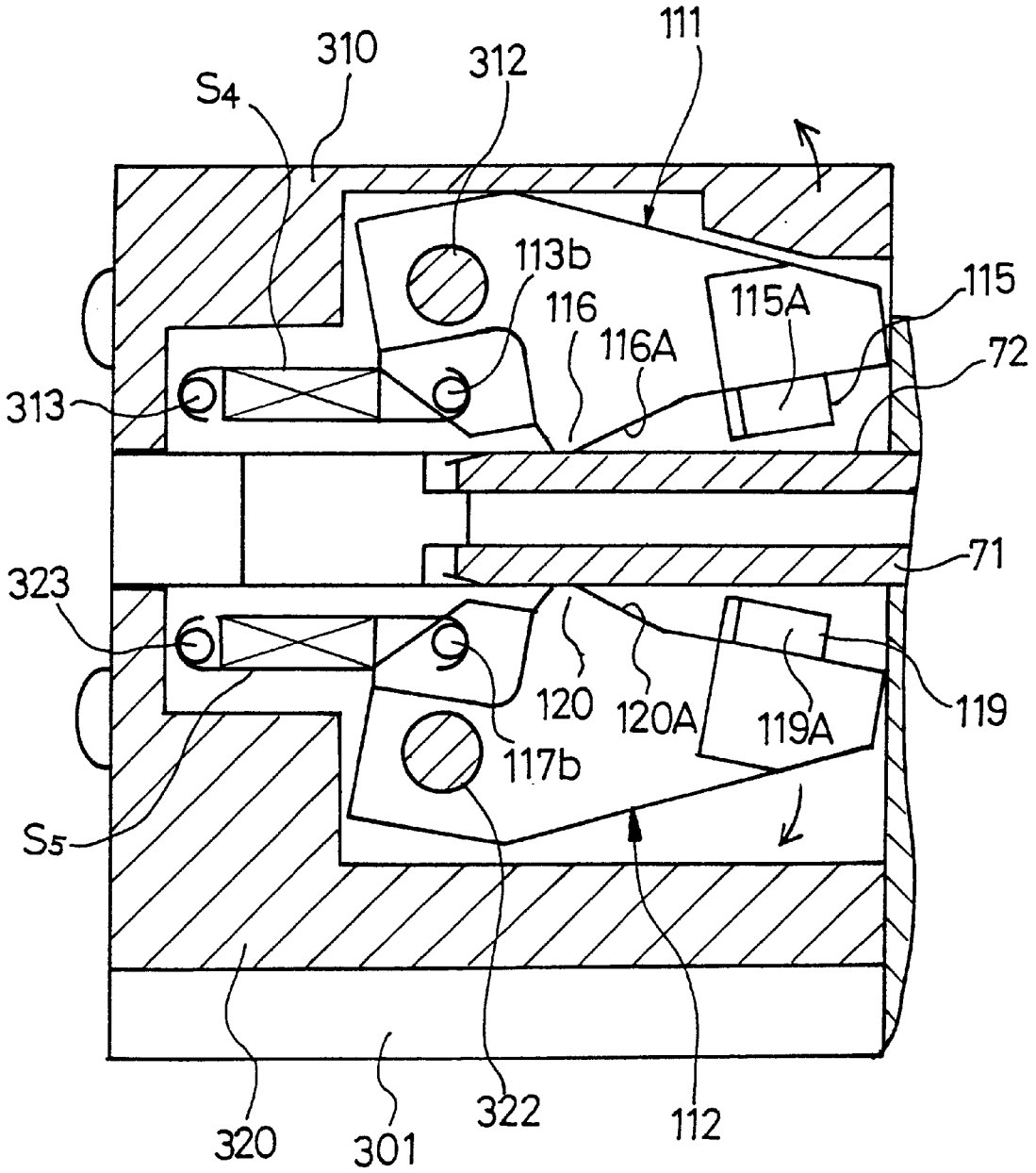
FIG. 71 is an explanatory diagram showing a state in which guide members have been opened.
Figure 73A:
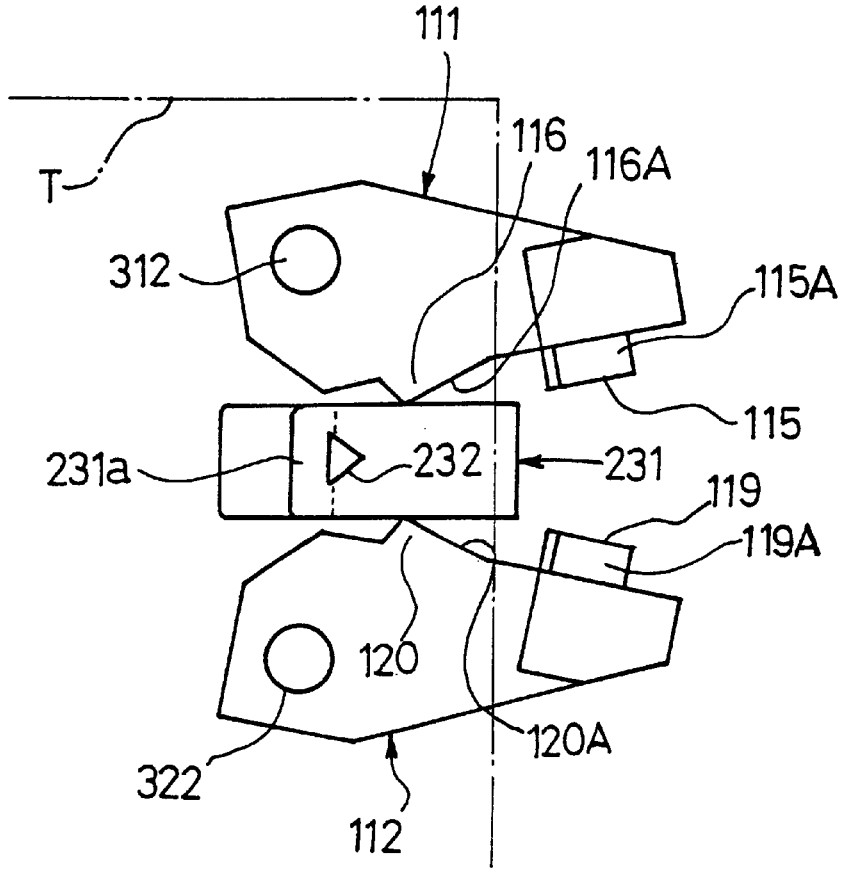
FIG. 73(A) is a plan view showing a state in which a sheet bundle has been clipped by the clip plate.

On the other hand, if along with the forming body 70 the clip plate 231 advances further from the position shown in FIG. 69, the upper portion of the point end portion of the forming body 70 (point end portions 71A and 72A of the forming plates 71 and 72) will be moved into the cage body 400, and as shown in FIG. 71, the protruding portions 116 and 120 of the widening members 111 and 112 will abut on the forming plates 71 and 72, so that the widening members 111 and 112 will be rotated and opened in directions indicated by arrows. In other words, as shown in FIGS. 72 and 73, the widening members 111 and 112 are opened, while the sheet bundle T is being inserted into between the upper portion 231A and lower portion 231B of the clip plate 231.

Since the widening members 111 and 112 are opened, the guide protrusions 115 and 119 are removed from between the upper portion 231A and lower portion 231B of the clip plate 231 and therefore the clip plate 231 clips the sheet bundle T.

Also, as shown in FIG. 70, when the upper portion of the point end portion of the forming body 70 is moved into the cage body 400 of the press member 93, the point end portion 231*a* of the clip plate 231 abuts on the inclined surface 421A of the hook member 420 and therefore the hook member 420 is rotated in the counterclockwise direction. And as shown in FIG. 74, if the shaft 65 of the drive link 61 slides along the circumferential surface of the maximum-radius portion R5 of the cam body 190, the hook member 420 will ride across the point end portion 231*a* of the clip plate 231 and the hook portion 421 of the hook member 420 will engage with the hole 232 of the clip plate 231, as shown in FIG. 75.

Figure 74:
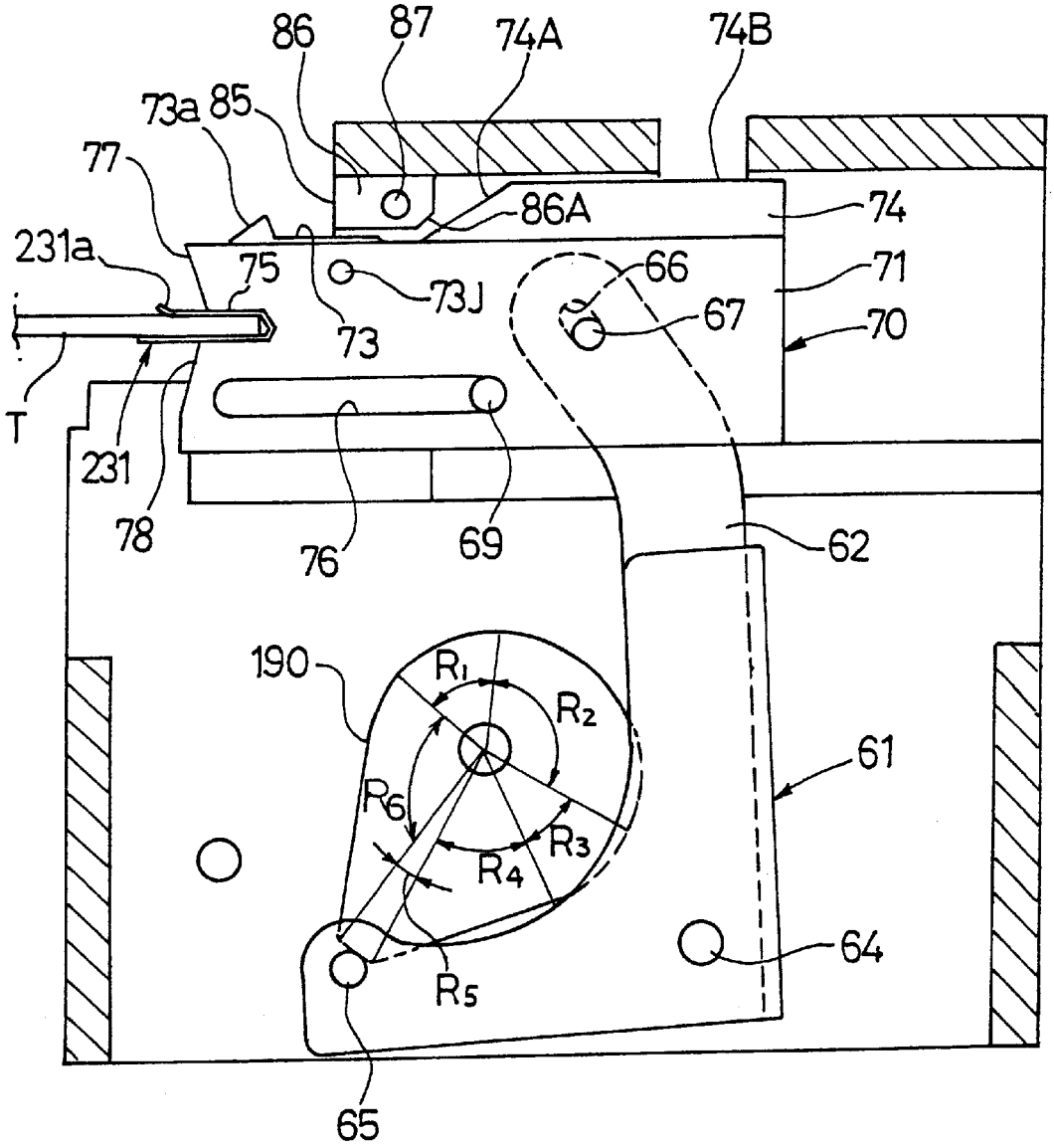
FIG. 74 is a side view showing the relation between the cam body and the drive link.
Figure 75:
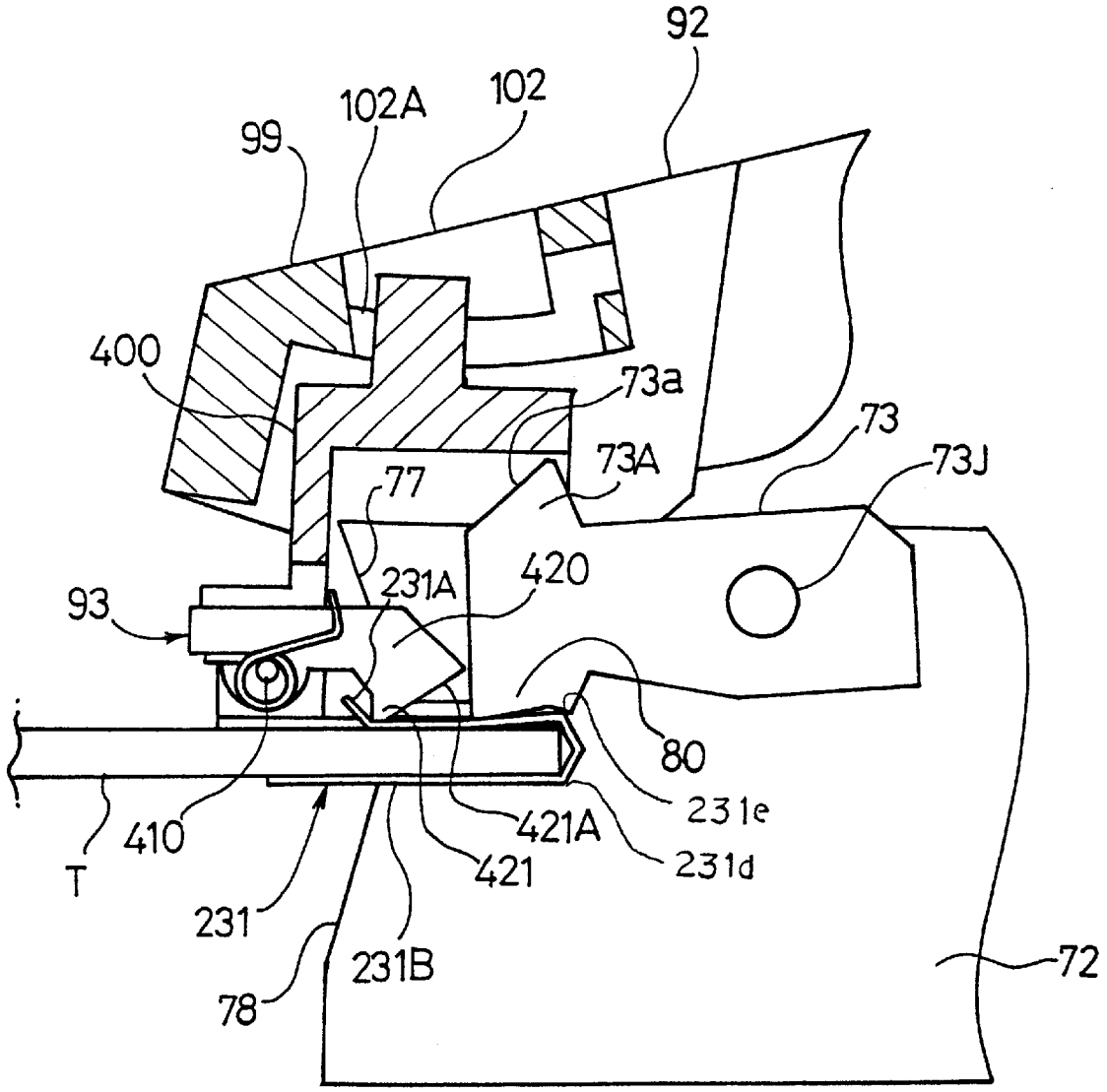
FIG. 75 is an explanatory diagram showing a state in which the hook member engages with the hole of the clip plate.
Figure 76:
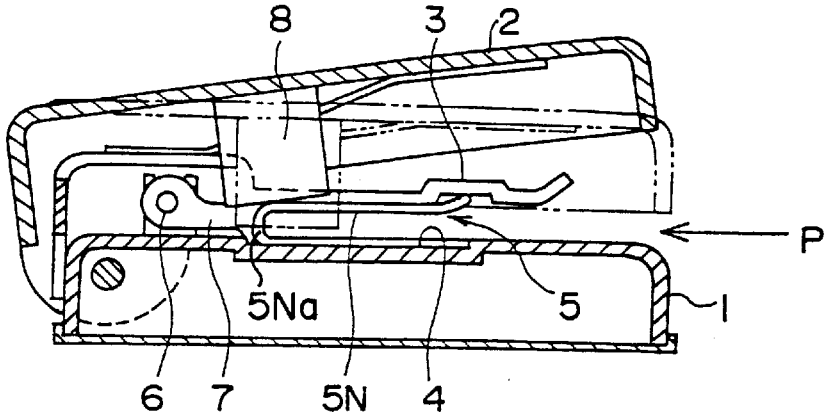
FIG. 76 (PRIOR ART)
FIG. 76 is a sectional view showing a conventional clip device.
Figure 77:
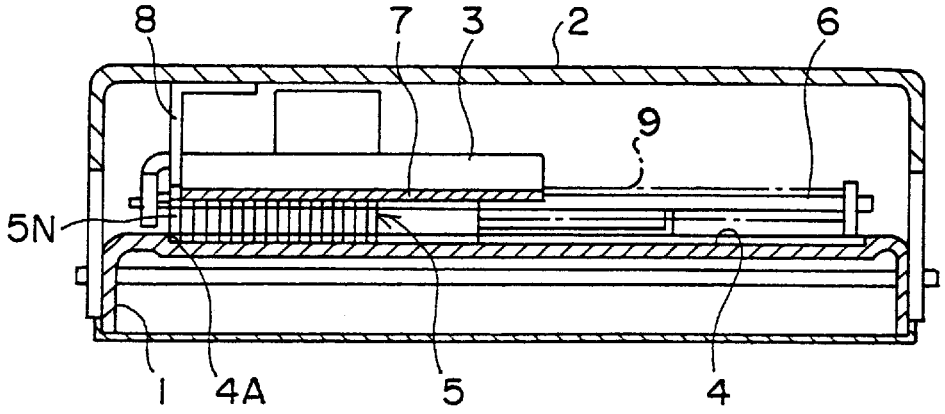
FIG. 77 (PRIOR ART)
FIG. 77 is a sectional view showing the rough construction of the conventional clip device.
Figure 78:
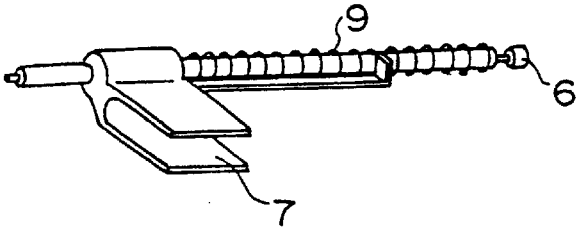
FIG. 78 (PRIOR ART)
FIG. 78 is an explanatory diagram showing the clamp member and the press rod shown in FIG. 77.

And if the shaft 65 of the drive link 61 begins to slide along the circumferential surface of the reducing portion R6 of the cam body 190 by rotation of the drive cam 180, the forming body 70 will be retracted backward (right direction) from the position as shown in FIG. 74. At this time, since the hook portion 421 of the hook member 420 has engaged with the hole 232 of the clip plate 231, the separation of the clip plate 231 from the clipped sheet bundle T is prevented when the forming body 70 is retracted.

If the shaft 65 of the drive link 61 slides further along the circumferential surface of the reducing portion R6 of the cam body 190 by further rotation of the drive cam 180 and arrives near the minimum-radius portion R1 of the cam body 90, the forming body 70 will return to its home position. On the other hand, when the forming body 70 is returning to the home position, the inclined surface 96A of the stopper piece 96 of the first press link 91 abuts on the inclined surface 74A of the link plate 74 of the forming body 70, so that along the first press member 91 the second press member 92 rotates in the clockwise direction (in FIG. 45) with the shaft J2 as center, whereby the press member 93 is returned to the home position (see FIG. 11). And the drive of the drive motor 171 is stopped.

Incidentally, since the clip plate 231 clipping the sheet bundle T has been creased by the corner portions 231*d* and 231*e*, it can clip the sheet bundle T with strong force.

In addition, after the flat clip plate 231 has been bent into a U-letter shape, the upper point end portion 231*a* and lower point end portion 231*b* of this clip plate 231 are closed and also the clip plate 231 is folded in two with the rear portion bulged. Thereafter, the point end portions 231*a* and 231*b* are opened and then the sheet bundle T is inserted into the opened clip plate 231, thereby clipping this sheet bundle T. Therefore, the clip plate 231 can clip the sheet bundle T with more than a predetermined force regardless of the thickness of the sheet bundle T.

In this embodiment, the flat clip plate 231 housed in the cartridge 200 is fed out into a predetermined position by the slider 130, and the sheet bundle T is clipped by bending the fed clip plate 231 into a U-letter shape with the forming body 70, etc. Therefore, the sheet bundle T can be clipped if only the flat clip plate 231 is housed in the cartridge 200. For this reason, the number of clip plates 231 that are housed in the cartridge 200 can be increased. In addition, in this embodiment, a plurality of clip plates 231 are bonded and interconnected by ribbon tape 240, and the clip plates 231 wound in roll form are housed in the cartridge 200. For this reason, the number of clip plates 231 can be further increased and there is no need to supply clip plates to the cartridge 200 frequently.

Figure 73B:
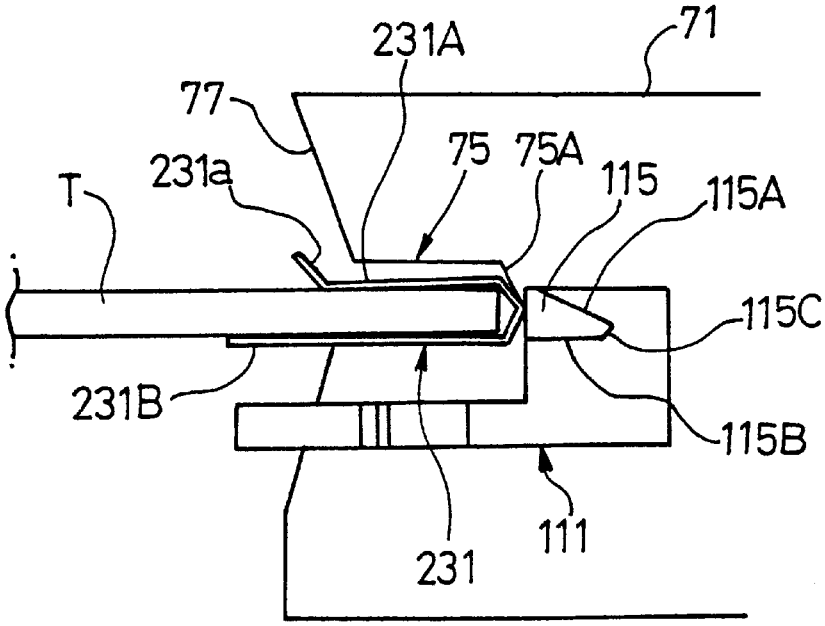
FIG. 73(B) is a side view showing a state in which the sheet bundle has been clipped by the clip plate.

Furthermore, since the point end portion 231*a* of the clip plate 231 clipping the sheet bundle T is bent as shown in FIG. 73(B), the clip plate 231 can be easily removed from the sheet bundle T by catching the finger on the point end portion 231*a*. Therefore, this clip plate 231 can be reused. When it is reused, a sheet bundle can be clipped by inserting the sheet bundle into between the upper point end portion 231*a* and lower point end portion 231*b* of the clip plate 231, and the clip plate 231 can be used many times. Also, because the point end portion 231*a* of the clip plate 231 has been bent, a sheet bundle can be easily inserted into between the point end portions 231*a* and 231*b*.

While this embodiment has been described as the clip device 10 which bends the clip plate 231 and clips the sheet bundle T, the present invention can be used as a clip manufacturing device which bends the clip plate 231 and manufactures the bent clip plate 231, as shown in FIGS. 59 and 60. That is, if the sheet bundle T is not placed on the sheet tables 310 and 320, the bent clip plate 231 will be manufactured as shown in FIGS. 59 and 60, and this clip plate 231 can be used in the above-mentioned manner.

Incidentally, when the slider 130 is at the home position (position shown in FIGS. 25 and 26), the inclined plate portion 154 of the feed pawl plate 150 does not abut on the protruding portions 23B and 23B of the front wall 22 of the housing 12. For this reason, the point end portions 153*a* and 153*a* of the feed pawls 153 and 153 have been retracted from the back surface of the anvil plate 160 toward the front surface side. Therefore, the present invention can prevent the disadvantage that, when the cartridge 200 is removed, the point end portions 153*a* and 153*a* of the feed pawls 153 and 153 are caught on the clip plate 231 present in the conveyor path 211 of the cartridge 200 and therefore the clip plate 231 is pulled out of the cartridge 200.

(Clip)

Now, the clip that is employed in the above-mentioned clip device will be described based on the drawings.

This clip is loaded into the clip device which automatically binds a sheet bundle such as a paper bundle. Before the intermediate portion of the clip is bent, one of the opposite end portions is made easily bendable in a direction opposite to the bending direction. With this, the object of the present invention is to render it easier to insert a sheet bundle into a clip through the opposite end portions closely attached by bending and render the cost inexpensive even when a large number of clips are used.

The first feature of this clip resides in that it is a flat clip which is bent at its longitudinally intermediate portion and can bind a sheet bundle and in that a deformation promoting portion consisting of a notch or a hole is formed in either one or the other of the opposite end portions of the clip.

According to the first feature of the clip, either a notch or a hole is provided near an end portion of the clip. For this reason, when the end portion with either this notch or hole is deformed in a direction opposite to the bending direction of the clip, the deformation can be made easier. Also, if the clip is bent into a general U shape at its intermediate portion and if one end portion with a notch or a hole is deformed in a direction away from the other end portion, insertion of a sheet bundle will become easier.

Consider a clip device in which: a clip is arranged between a female member having a forming recess for bending the intermediate portion of the clip and a male member for pushing the intermediate portion of the clip into the forming recess; the clip is bent by moving the female and male members toward each other; and after the male member has been removed from the clip, the closed opposite end portions of the clip are opened to insert a sheet bundle. In the case where a clip is employed in such a clip device, when the clip binding a sheet bundle is separated from the recess, it can be easily separated from the forming recess if a hook member is hooked on the notch or hole formed in the clip. Note that in the case where notches or holes are provided in the opposite end portions, the clip can be set without limiting the up-and-down direction of the clip.

The second feature of the clip resides in that a tongue portion protruding toward the bent intermediate portion is provided in the notch or hole.

According to the second feature of the clip, the tongue portion is provided. Therefore, in the case where a sheet bundle is bound with the clip, the tongue portion is caught on the sheet bundle, so that the sheet bundle is prevented from being separated easily from the clip.

The third feature of the clip resides in that, in the clip bent into a general U shape so that the opposite end portions contact each other, the length of one end portion from the center of the bent portion is shorter than that of the other end portion, also either the above-mentioned notch or hole is formed in at least the shorter and portion, and furthermore, the margin of the notch or hole is warped in a direction away from the longer end portion.

According to the third feature of the clip, the longer end portion and the shorter end portion from the bent portion are provided and also the shorter end portion is warped in the direction away from the longer end portion. When a sheet bundle is inserted into the clip, it is guided by the end portions and therefore the insertion becomes easier.

The fourth feature of the clip resides in that the clip is formed by a punching machine so that a burr protrudes from a surface which is located inside when the clip is bent.

According to the fourth feature of the clip, the burr produced by punching protrudes inside the bent clip, so a clipped sheet bundle is difficult to be separated from the clip.

Figure 79:
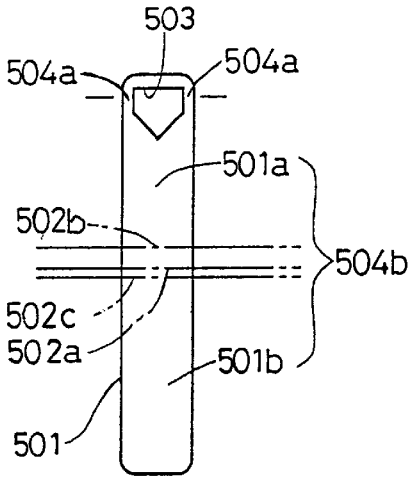
FIG. 79 is a plan view of a flat clip according to an embodiment of the present invention.

FIG. 79 shows the above-mentioned clip. This clip 501 is formed from iron, stainless steel, or aluminum and consists of a flat rectangular plate with a lateral width of about 3 to 5 mm and a length of about 20 to 30 mm. The four corners of the clip 501 are chamfered.

Figure 80:
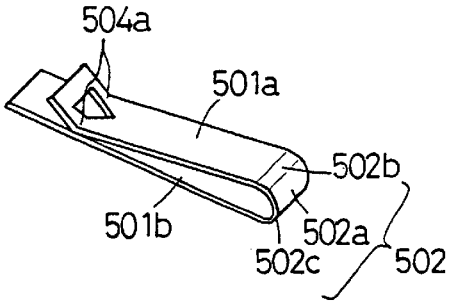
FIG. 80 is a perspective view showing a state in which the clip of FIG. 79 has been bent so as to have a short piece portion and a long piece portion.

The clip 501 has a bent portion 502 at a position slightly offset from the center portion. In this embodiment, when the bent portion 502 is bent into a general U shape, as shown in FIG. 80, it has a portion 502*a* whose radius of curvature is short and a portion 502*b* whose radius of curvature is long. The portion 502*a* with a short radius of curvature is provided on the side of a long piece portion 501*a*, while the portion 502*b* with a long radius of curvature is provided on the side of a short piece portion 501*b*. The portion 502*a* with a short radius of curvature is the center of bending. When the clip 501 is bent, the longpiece portion 501*a* and short piece portion 501*b* increase force witch clamps a sheet bundle such as a paper bundle. The portion 502*b* with a long radius of curvature increases the selection range of the thickness of a paper bundle to be bound. Note that the bent portion 502 may be bent into a general U shape.

Figure 81:
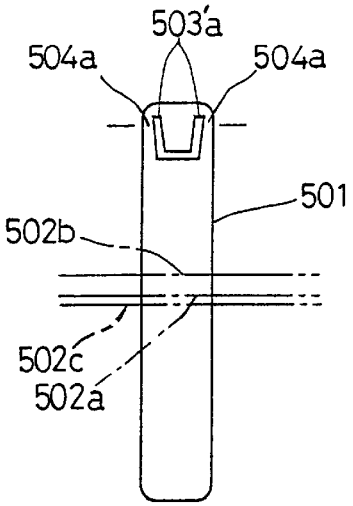
FIG. 81 is a plan view showing a clip which has a tongue portion provided in a hook hole.

A hook hole 503 is formed in the short piece portion 501*b* near the bent portion 502. The hook hole 503 is triangular in shape. The base 503*a* of the triangle is formed in parallel to the end of the clip 501. Although the hook hole 503 is punched into a triangular shape, it may be rectangular, circular, etc. Also, as shown in FIG. 81, a hook hole 503' may be formed so that a tongue portion 503'*b* is formed, without cutting off the base 503'*a* of a trapezoid. Also, although the hook hole 503 is formed so that the point end portion of the short piece portion 501*b* of the clip 501 can be easily deformed, a notch may be provided. This notch may be a semicircular, rectangular, trapezoidal, L-shaped, or J-shaped alit.

Since the marginal portion 504*a* of the hook hole 503 is weaker in rigidity than the remaining portion 504*b* because of the hook hole 503, a portion near the hole 503 can be easily deformed as compared with the remaining portion, even if a distance from the end portion were short. If this hook hole 503 is formed, the marginal portion 504*a* in the short piece portion 501*b* can be warped in a direction away from the long piece portion 501*a* when the clip 501 is bent. By warping the marginal portion 504*a* in the direction away from the long piece portion 501*a*, a paper bundle can be easily inserted into the clip 501 bent into a general U shape. Also, since the clip 501 is bent so that a burr is formed inside, the clip 501 can be prevented form being separated easily from the clipped paper bundle or sheet bundle.

Figure 83:
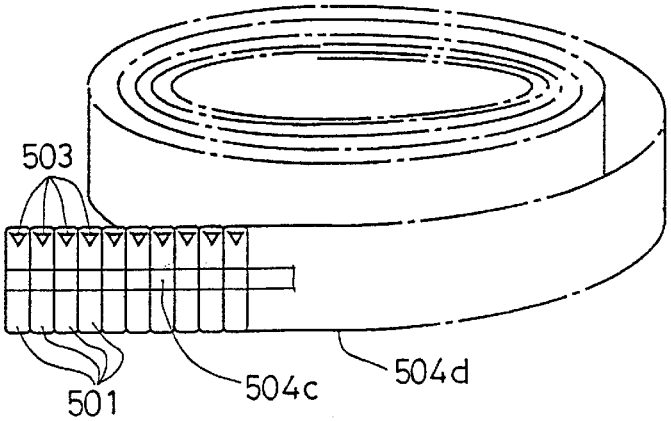
FIG. 83 is a perspective view showing flat clips wound in roll form.

Clips 501 are arranged at rear intervals in a right-and-left direction, and as shown in FIG. 83, they are connected together in a width direction by plastic film tape 504*c* and constitute a belt 504*d*. The molecules of the plastic resin of the plastic film tape 504*c* are oriented so that the plastic film tape 504*c* can be easily cut in the longitudinal direction of the clip 501. Therefore, a plurality of connected clips 501 can be easily cut. The clips 501 connected by the plastic film tape 504*c* are wound in roll form and loaded into a clip device 501 shown in FIGS. 84 through 86.

Figure 82:
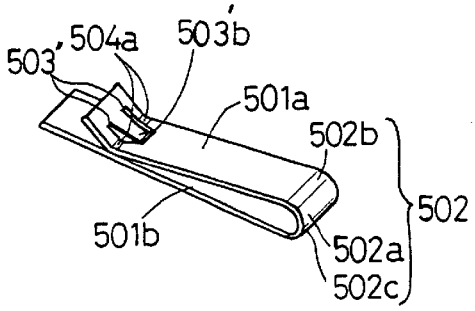
FIG. 82 is a perspective view showing a state in which the clip of FIG. 80 has been bent so as to have a short piece portion and a long piece portion.
Figure 84:
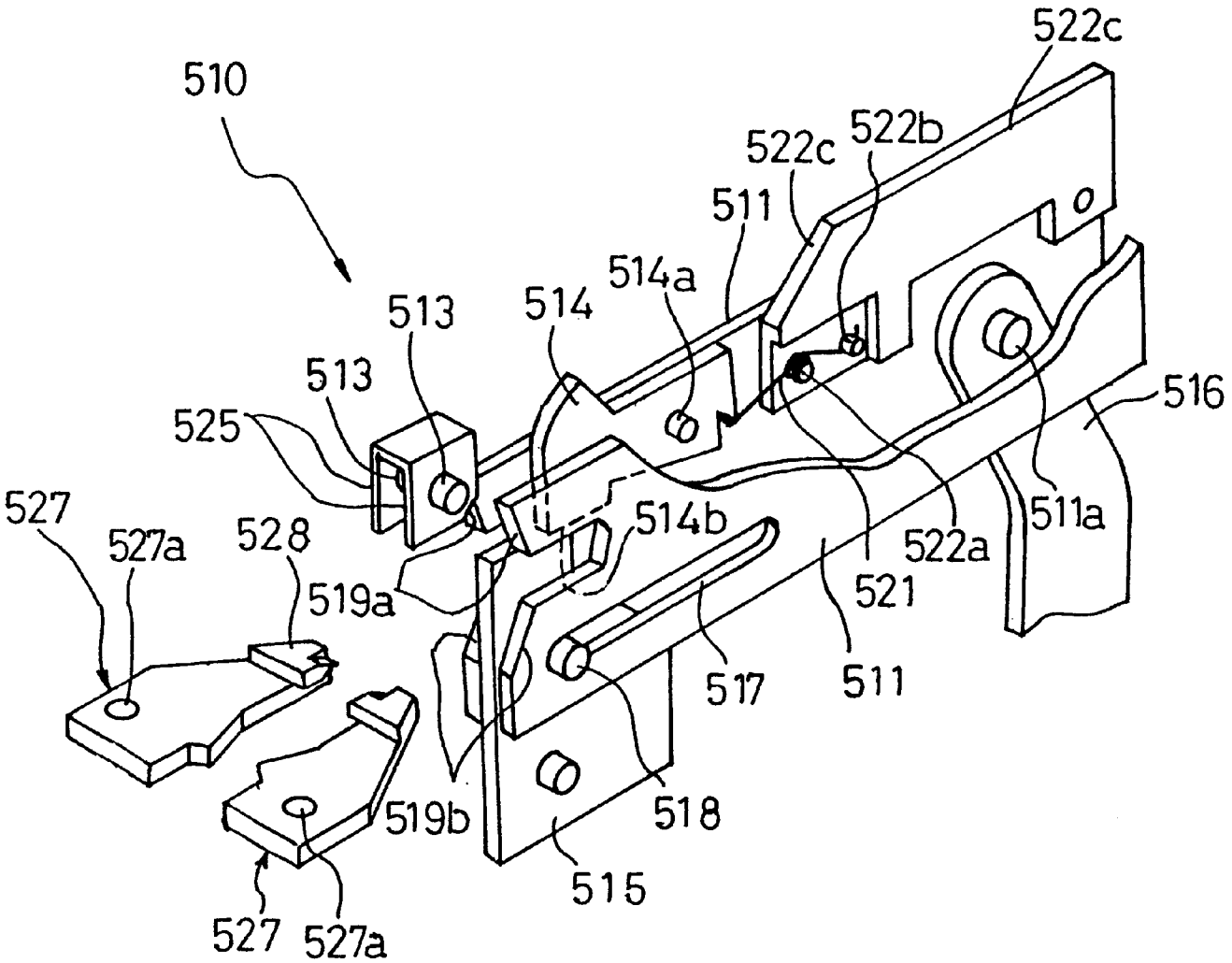
FIG. 84 is a perspective view showing the essential parts of a clip device which perform an operation of bending the clip shown in FIGS. 79 through 83, the forming plates being in a home position.
Figure 85:
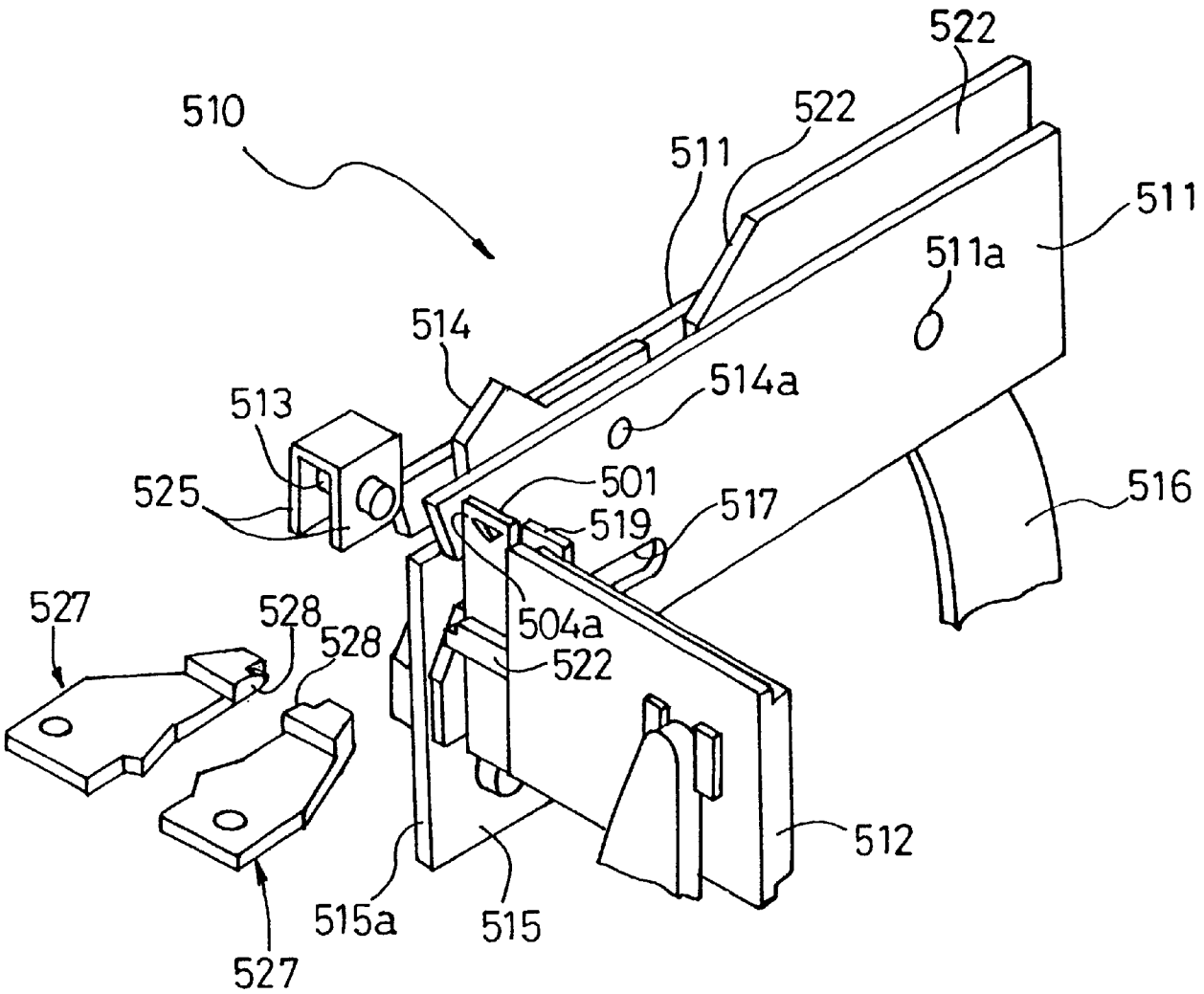
FIG. 85 is a perspective view showing the essential parts of a clip device which perform an operation of bending the clip shown in FIGS. 79 through 83, the slider being in a state immediately before the clip is supplied to the forming plates.
Figure 86A:
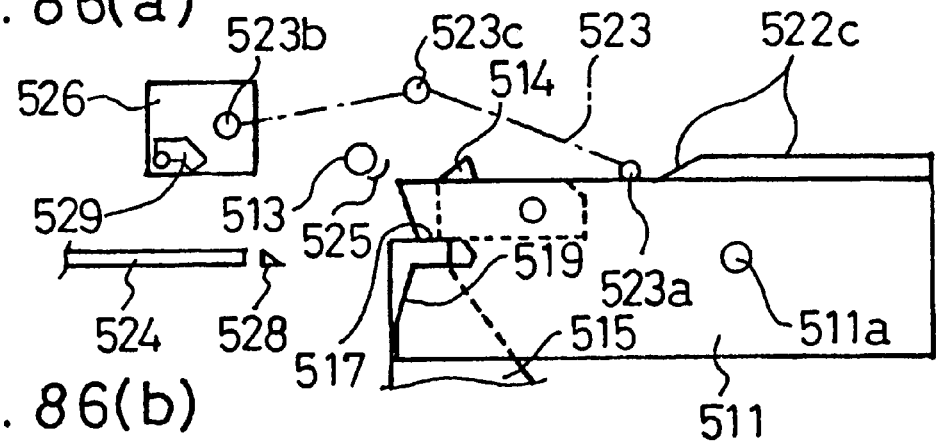
FIGS. 86(*a*) through 86(*g*) are explanatory diagrams showing an operation of bending a clip by the forming plates and the anvil and an operation of inserting a paper bundle into the bent clip by the pressure plate.
Figure 86B:
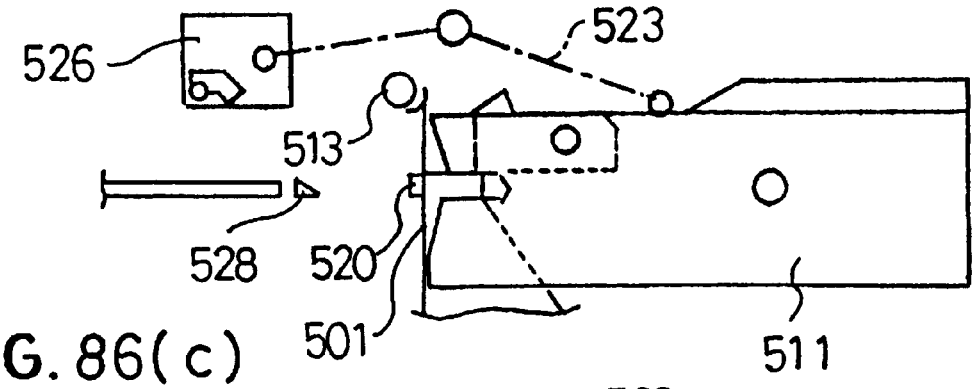
Figure 86C:
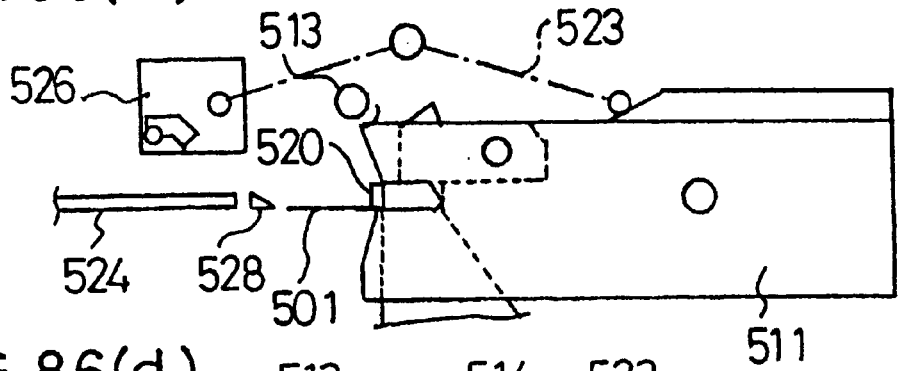
Figure 86D:
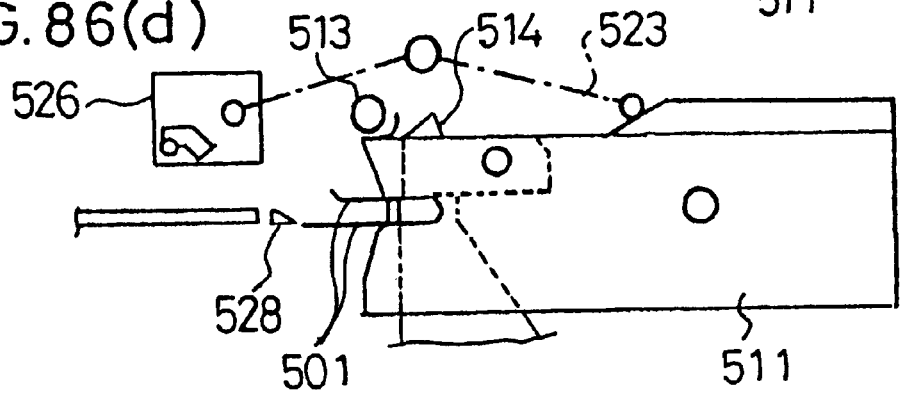
Figure 86E:
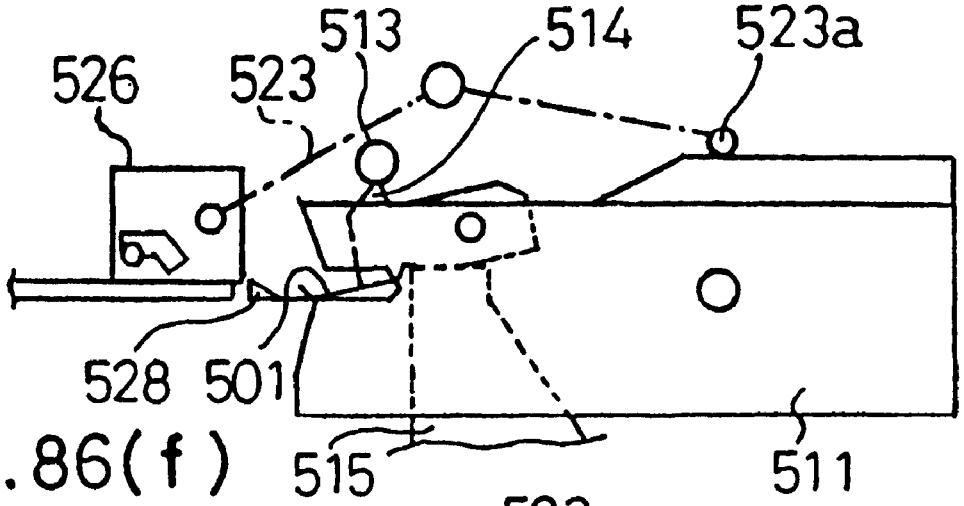
Figure 86F:
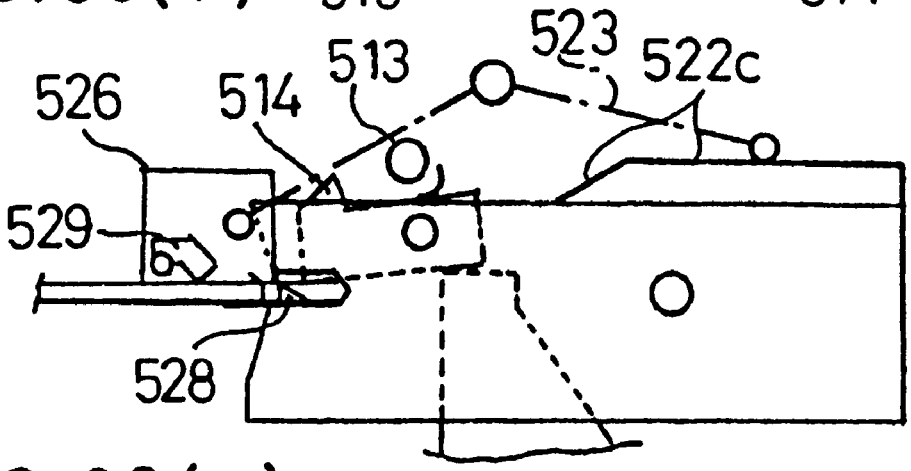
Figure 86G:
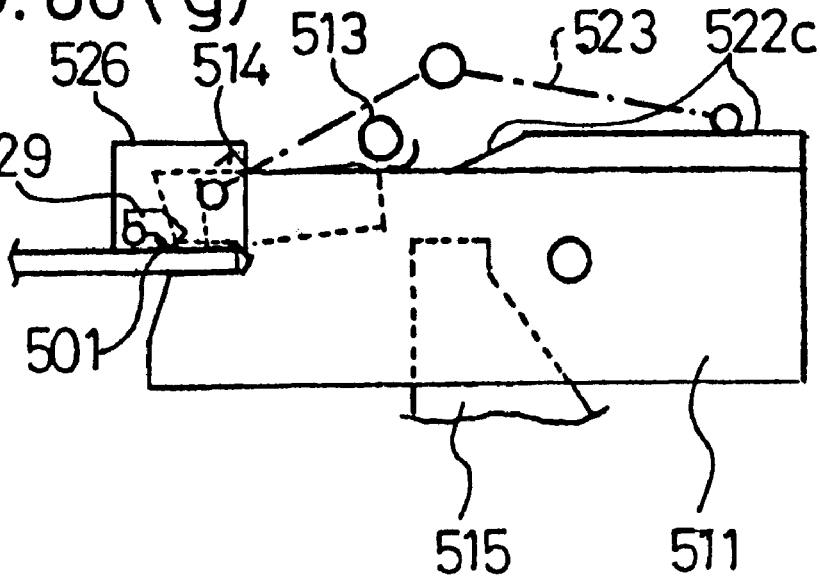

FIGS. 84 through 86 show the clip device 501 for bending the flat clip 501 as shown in FIGS. 80 and 82. The clip device 510 has forming plates 511 (female members), a slider 512 (see FIG. 85), a guide shaft 513, a pressure plate 514, a rear guide plate 515, and a link plate 516.

The forming plates 511, along with the slider 512, bend the clip 501 into a general U shape. The forming plates 511 are connected together by the link plate 516 and a shaft 511*a*. The rear guide plate 515 is arranged between the forming plates 511, and the forming plates 511 advance in the longitudinal direction thereof by rotation of the link plate 516. The slider 512 is moved toward or away from the end portion 515*a* of the rear guide plate 515 in a direction perpendicular to the moving direction of the forming plates 511. The rear guide plate 515 is fixed to a frame structure (not shown). As previously described, the rear guide plate 515 is interposed between a pair of forming plates 511, and each of the forming plates 511 is formed with a guide hole 515 extending in the longitudinal direction of the forming plate 511. A guide protrusion 518 protruding from the rear guide plate 515 in a right-and-left direction is fitted into the guide hole 517 so that it is freely slidable. The guide hole 517 and guide protrusion 518 guide the forming plate 511 when the link plate 516 is rotated.

The front end portion of each of the forming plates 511 is formed with a forming recess 519 for bending the clip 501. The marginal portions 519*a* and 519*b* of this forming recess 519 are obliquely formed with respect to a vertical direction so that the clip 501 can be easily bent. The slider 512 is used to supply the clip 501 to the end portion 515*a* of the rear guide portion 515 in a direction perpendicular to the forming plate 511. An anvil (male member) 520 protrudes from the slider 512 and is used to push the intermediate portion of the clip 501 into the forming recess 519 and form the bent portion of the clip 501.

That is, when the slider 512 slides so that the clip 501 is fed to the end portion 515*a* of the rear guide plate 515, the forming plates 511 are located at a position away from the end portion 515*a* of the rear guide plate 515 When the slider 512 moves to the end portion 515*a* of the rear guide plate 515 so that the clip 501 is interposed between the anvil 520 and the end portion 515*a*, the forming plates 511 slide to the end portion 515*a* of the rear guide plate 515. Since the clip 501 is interposed between the anvil 520 and the end portion 515*a*, the clip 501 is pushed by the marginal portions 519*a* and 519*b* of the forming plates 511 and begins to bend into a general U shape. As a result, the upper and lower bent portions 502*b* and 502*c* are formed on the upper and lower ends of the bent portion 502 of the clip 501. Furthermore, the bent portion 502*a* with a small radius of curvature is formed between the upper and lower bent portions 502*b* and 502*c* by the pressure of the pressure plate 514.

The front end of the pressure plate 514 is formed with a pressure portion 514*b*. The pressure portion 514*b* is used to form the upper and lower bent portions 502*a* and 502*c* on the intermediate bent portion 502 of the clip 501. If the marginal portions 519*a* and 519*b* of the forming plates 511 slide toward the end portion 515*a* of the rear glide plate 515 and arrive at a predetermined position, the pressure portion 514*b* will be guided and lowered by a guide shaft 513. With this, the clip 501, pushed into the forming recess 517 by the anvil 520, is bent in a slightly caulked state, and the short piece portion 501*a* of the clip 501 in an urged state is brought into contact with the long piece portion 501*b*.

A shaft 514*a* is held between the forming plates 511 and 511. The rear portion of the pressure plate 514 is supported on the shaft 514*a* so that it is freely rotatable. Also, the rear portion of the pressure plate 514 is urged upward by a torsion spring 512. The torsion spring 512 is held by the fulcrum shaft 522*a* of a link plate 522 fixed between the forming plates 511 and 511, and the other end of the torsion spring 512 is connected to the protrusion 522*b* of the link plate 522.

The portion of the link plate 522 from its front upper corner portion to its upper portion constitutes a cam surface 522*c*. As shown in FIG. 86, one end 523*a* of a lever 523 slides along the cam surface 522*c*. The other end 523*b* of the lever 523 is provided with a press plate 526 for pressing down a paper bundle 524 shown in FIG. 86. The lever 523 rotates on a fulcrum 523*c*. The press plate 526 is constructed so that it can clamp the paper bundle 524 along with a table (not shown) arranged above a pair of guide plates 527 and 527 shown FIGS. 84 and 85.

The opposite ends of the guide shaft 513 are fixed to a frame structure (not shown). A point-end guide 525 is fixed near the opposite ends of the guide shaft 513 so that it does not rotate. The point-end guide 525 is used to deform the marginal portion 504*a* of the short piece portion 501*a* of the clip 501 in a direction away from the long piece portion 501*b*. The point-end guide 525 has a rectangular gate-type cross section so that it is opposed to the marginal portions 519*a* and 519*a* of the front end portions of the forming plates 511 and 511. The pressure plate 514 moves into the point-end guide 525 and makes contact with the guide shaft 513. The upper corner portions of the marginal portions of the forming plates 511 and 511 pass under the rectangular gate type cross section of the point-end guide 525 and deforms the marginal portion 504*a* of the clip 501.

That is, as shown in FIG. 86(*b*), when the supplied clip 501 is pressed against the anvil 520 in a stopped state, the marginal portion 504*a* of the clip 504 is first pressed against the point-end guide 525 by the upper corner of the upper marginal portion 591*a*, thereby deforming the marginal portion 504*a* of the short piece portion 501*a* of the clip 501 rearward.

Furthermore, as shown in FIGS. 86(*c*) and 86(*d*), if the forming plates 511 slide forward, the clip 501 will be pushed by the anvil 520 and bent into the shape of the forming recess 519. In FIGS. 86(*c*) and 86(*d*), when the clip 501 is bent, the lever 523 rotates so that the press plate 526 moves downward, and the slider 520 moves away from the end portion 515*a* of the rear guide plate 515 and retracts from the inside of the bent clip 501.

As shown in FIGS. 86(*e*) through 86(*g*), if the forming plates 511 slide further forward, the press plate 526 will hold and press the paper bundle 524 along with the aforementioned table provided above the guide plates 527 and 527.

The guide plates 527 and 527 are equipped with wedge portions 528 and 528 which protrude toward the forming plates 511 and 511, respectively. The guide plates 527 and 527 are mounted on shafts 527*a* and 527*a* fixed to a frame structure and are freely rotatable. The wedge portion 528 are urged inward by a spring. As shown in FIG. 86(*e*), when the short piece portion 501*a* and long piece portion 501*b* of the clip 501 are urged toward each other, the wedge portions 528 widen the short piece portion 501*a*, sliding along the long piece portion 501*b*. When the wedge portions 528 ride across the short piece portion 501*a*, the paper bundle 524 supported on the aforementioned table (not shown) is clipped inside the clip 501 by the short piece portion 501*a*.

A hook pawl 529 is supported on a shaft within the pressure plate 526. When the forming plates 511 move away from the pressure plate 526, the hook pawl 529 is hooked on the hook hole 503 of the clip 501 and then pulls the clip 501 against the backward movement of the forming plates 511 so that the clip 501 is not separated from the paper bundle 524 with the clip 501 held in the forming recess 519. The hook pawl 529 is urged so as to press the paper bundle 524 by a spring (not shown). When the pressure plate 526 moves upward, the hook pawl 529 is moved away from the clip 501.

As described above, the clip 501 in this embodiment is provided with the deforming hole 503 near the end portion of the short piece portion 501*a*. For this reason, when the end portion with this deforming hole 503 is deformed in a direction opposite to the bending direction of the clip 501, the marginal portion 504*a* can be easily deformed. Also, if the clip 501 is bent into a general U shape at its intermediate portion and if the short piece portion 501*a* on the side of the deforming hole 503 is deformed in a direction away from the long piece portion 501*b*, insertion of the paper bundle 524 will become easier. Furthermore, in the case where the clip 501 is employed in the clip device 510 (in which the clip 501 is arranged between the forming plates 511 having the forming recesses 519 for bending the intermediate portion of the clip 501 and the anvil 520 for pushing the intermediate portion of the clip 501 into the forming recesses 519; the clip 501 is bent by moving the forming plates 511 and the anvil 520 toward each other; and after the anvil 520 has been retracted from the clip 501, the closed short piece portion 501*a* and long piece portion 501*b* of the clip 501 are opened to insert the paper bundle 524), the clip 501 can be easily pulled out from the forming recesses 519 if the hook pawl 529 is hooked on the hook hole 503 when the clip 501 binding the paper sheet 524 and the forming recesses 519 are separated from each other. In the case where hook holes 503 are provided in the opposite end portions of the clip 501, the clip can be set without limiting the up-and-down direction of the clip 501.

Also, if a tongue portion is provided in the clip 501, when the sheet bundle 524 is bound with the clip 501, the tongue portion is caught on the paper bundle 524 and therefore the clip 501 is prevented from being separated easily from the paper bundle 524.

In addition, the short piece portion 501*a* and long piece portion 501*b* are provided in the bent clip 501 and also the end portion of the short piece portion 501*a* is warped in the direction away from the long piece portion 501*b*. Therefore, when the sheet bundle 524 is inserted into the clip, it is guided by the short and long piece portions 501*a* and 501*b* and the insertion becomes easier. In the case where the clip 501 is a bent one, the portions 502*a* and 502*c* with a short radius of curvature can increase the clamping force between the long piece portion 501*a* and the short piece portion 501*b*, while the portion 502*b* with a long radius of curvature can increase the selection range of the thickness of the paper bundle 524 that can be bound.

Furthermore, according to the clip 501 formed by a punching machine so that a burr protrudes from an interior surface of the clip, the burr protrudes inside the bent clip and therefore the clip 501 is difficult to be separated from the paper bundle 524.

Accordingly, in the case where the clip 501 according to this embodiment is loaded in a clip device, the end portion of the short piece portion 501*a* can be easily deformed in a direction opposite to the bending direction before the intermediate portion of the clip 501 is bent. Therefore, even if the paper bundle 524 has a thickness of about 20 to 30 sheets, it can be easily inserted into between the dosed short piece portion 501*a* and long piece portion 501*b* of the clip 501. The clip 501 is inexpensive, so even if a great number of dips were employed, the cost would not be increased.

While the present invention has been described with reference to preferred embodiments thereof, the invention is not to be limited to the details given herein, but may be modified within the scope of the appended claims.

What is claimed is:

1. A method of clipping a sheet bundle by a clip device, said method comprising:

bending opposite end portions of a substantially flat clip plate into a shape in which only point end portions are closed and also a rear portion is bulged, opening said point end portions just after said clip plate is bent, and furthermore inserting said sheet bundle in a plane perpendicular to a thickness direction of said sheet bundle, into the bent clip plate just after said point end portions are opened.

2. A clip device comprising:

cartridge for housing a plurality of substantially flat clip plates connected with one another;

feed means for feeding the connected clip plates from said cartridge into a predetermined position;

bending means for separating at least one clip plate from said connected clip plates fed into said predetermined position and bending the separated clip plate into a shape in which only point end portions axe closed and also a rear portion is bulged; and clip means for clipping a sheet bundle by opening the point end portions of the bent clip and then inserting said sheet bundle into the opened point end portions.

3. The clip device as set forth in claim 2, wherein said bending means comprises:

an anvil member for supporting an intermediate portion of at least a leading clip plate of said connected dip plates, the anvil member being arranged near the leading clip plate of said connected clip plates fed from said cartridge;

a forming body having at its point end portion a recess for bending the clip plate supported by said anvil member, the forming body being arranged so that it can move toward or away from the clip plate supported by said anvil member from a side opposite to said anvil member; and end-portion bending means for bending at least either one or the other of the upper and lower end portions of the clip plate in a direction opposite to the bending direction of said clip plate when said forming body advances toward said anvil member to bend the clip plate supported by said anvil member.

4. The clip device as set forth in claim 2, wherein said bending means comprises:

an anvil member for supporting an intermediate portion of at least a leading clip plate of said connected clip plates, the anvil member being arranged near the leading clip plate of said connected clip plates fed from said cartridge;

a forming body having at its point end portion a recess for bending the clip plate supported by said anvil member, the forming body being arranged so that it can move toward or away from the clip plate supported by said anvil from a side opposite to said anvil member;

end-portion bending means for bending at least either one or the other of the upper and lower end portions of the clip plate in a direction opposite to the bending direction of said clip plate when said forming body advances toward said anvil member to bend the clip plate supported by said anvil member; and a rear guide member for supporting a bent portion of said clip plate and forming said bent portion into a rectangular shape along with said forming body, when said forming body bends said clip plate supported by said anvil member.

5. The clip device as set forth in claim 4, wherein said forming body has a pressure member which crushes the bent portion of said clip plate, when along with said clip plate said anvil member is introduced into said recess of said forming body and then said clip plate is bent.

6. The clip device as set forth in claim 2, further comprising clip anti-separation means for preventing said clip plate from being pulled out from said sheet bundle after said clip plate has been bent to clip said sheet bundle.

7. The clip device as set forth in claim 2, wherein said feed means is equipped with feed pawls for preventing the fed clip plate from moving backward when said feed means returns toward said cartridge after said plurality of connected clip plates have been fed from said cartridge into said predetermined position.

* * * * *